United States Patent [19]

Gilmour et al.

[11] 4,411,973

[45] Oct. 25, 1983

[54] ELEMENTS CONTAINING ORDERED WALL ARRAYS AND PROCESSES FOR THEIR FABRICATION

[75] Inventors: Hugh S. A. Gilmour, Rochester; Richard N. Blazey, Penfield, both of N.Y.

[73] Assignee: Eastman Kodak Company, Rochester, N.Y.

[21] Appl. No.: 293,080

[22] Filed: Aug. 17, 1981

Related U.S. Application Data

[63] Continuation-in-part of Ser. No. 196,947, Oct. 14, 1980, abandoned.

[51] Int. Cl.[3] ..... G03G 13/22; G03C 5/00; G03C 7/12

[52] U.S. Cl. ..... 430/7; 430/8; 430/31; 430/54; 430/207; 430/320; 430/338; 430/365; 430/375; 430/376; 430/390; 430/394; 430/396; 430/494

[58] Field of Search ..... 430/6, 7, 8, 31, 46, 430/54, 365, 394, 396, 494, 320

[56] References Cited

U.S. PATENT DOCUMENTS

| | | | |
|---|---|---|---|
| 1,003,720 | 9/1911 | Dufay . | |
| 1,112,540 | 10/1914 | Lehner | 430/7 |
| 2,306,869 | 12/1942 | Eckerlin | 430/6 |
| 2,385,687 | 9/1945 | Carnahan | 430/6 X |
| 3,138,459 | 6/1964 | Land . | |
| 3,210,186 | 10/1965 | Gorig | 430/6 |
| 3,284,208 | 11/1966 | Land . | |
| 3,509,276 | 4/1970 | Gabor | 430/494 X |
| 4,307,165 | 12/1981 | Blazey et al. | 430/31 X |

FOREIGN PATENT DOCUMENTS

| | | | |
|---|---|---|---|
| WO80/01614 | 8/1980 | PCT Int'l Appl. . | |
| 15027 | of 1913 | United Kingdom . | |
| 456968 | 11/1936 | United Kingdom | 430/7 |

OTHER PUBLICATIONS

James, *Theory of Photographic Process*, 4th Ed., Macmillan, 1977, p. 335.

*Primary Examiner*—Roland E. Martin, Jr.
*Attorney, Agent, or Firm*—Carl O. Thomas

[57] ABSTRACT

Radiation is directed toward a support through an ordered array of lateral walls to form interlaid radiation-exposed and shadowed microareas on the support. A first composition is then located on the support in either the shadowed or unshadowed microareas. At least one additional composition is then positioned on the support in laterally displaced microareas forming an interlaid pattern with the first microareas.

70 Claims, 35 Drawing Figures

FIG. 1A
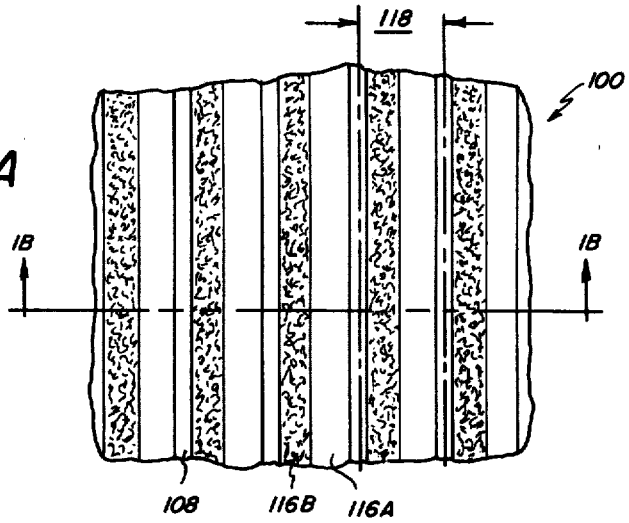
FIG. 1B
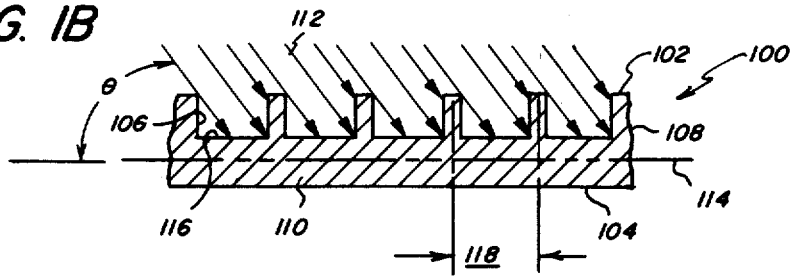
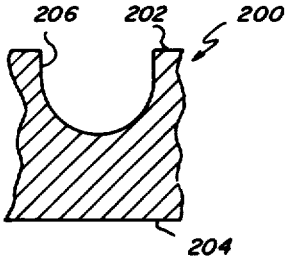
FIG. 2
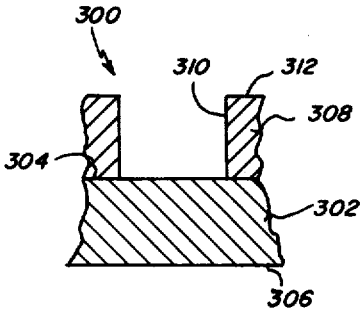
FIG. 3

FIG. 6B
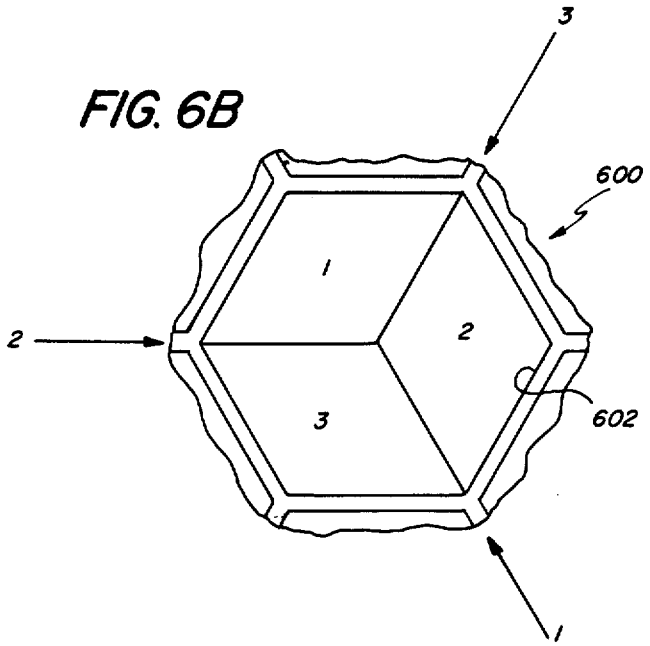
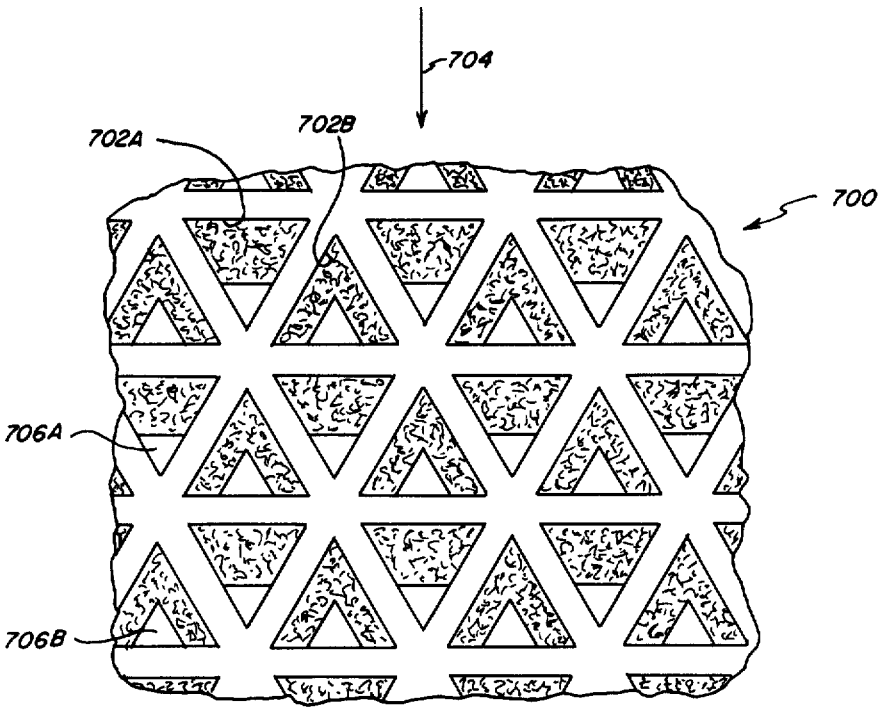
FIG. 7

FIG. 9
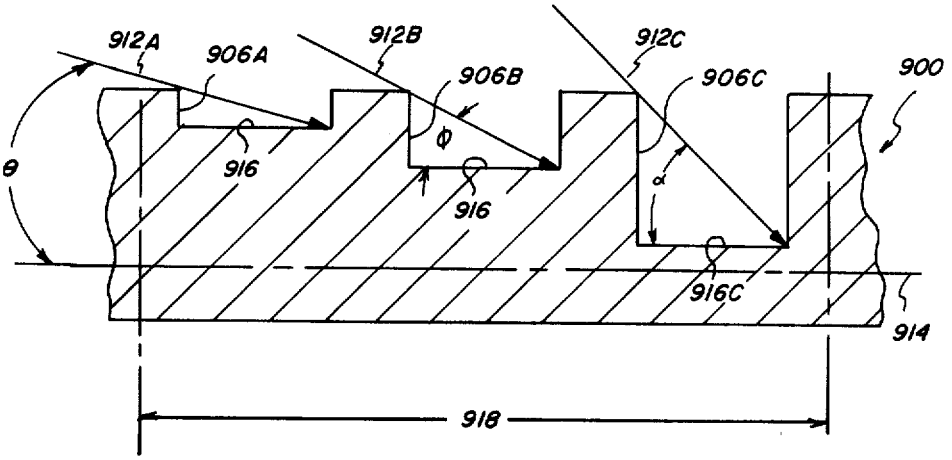
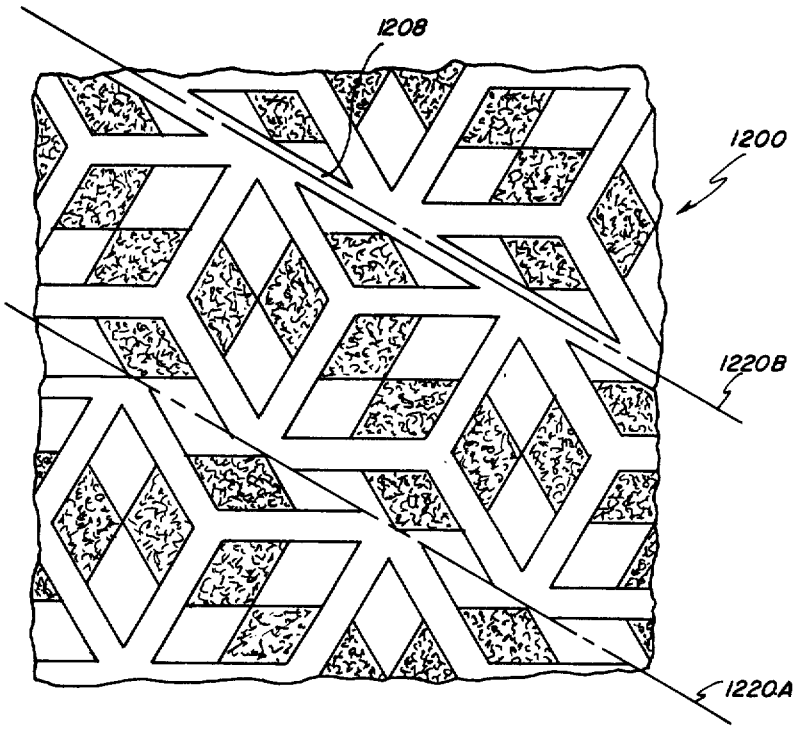
FIG. 12

ELEMENTS CONTAINING ORDERED WALL ARRAYS AND PROCESSES FOR THEIR FABRICATION

CROSS-REFERENCE TO RELATED APPLICATION(S)

This is a continuation-in-part of U.S. Ser. No. 196,947, filed Oct. 14, 1980, now abandoned.

FIELD OF THE INVENTION

This invention is directed to a process of forming on a support two or more laterally displaced, but highly interdigitated compositions. The invention is also directed to elements useful in practicing this process and to elements which are the products of this process. In a specific aspect this invention relates to elements useful in preparing photographic elements, processes of preparing photographic elements, and to the photographic elements produced.

BACKGROUND OF THE INVENTION

It is desirable for a number of purposes to locate two or more laterally displaced compositions in a highly interdigitated relationship on a support. In those instances where the compositions are divided into very small individual areas (e.g., microareas—here defined as areas too small to be readily individually resolved by the unaided human eye), the techniques for locating the compositions in a predetermined laterally displaced relationship have been both tedious and complex.

A specific illustrative application for highly interdigitated compositions is additive multicolor photography. In additive multicolor photography a multicolor filter is employed which can be comprised of three additive primary filters that are segmented and interlaid to form the smallest attainable discrete areas. By exposing through the multicolor filter a panchromatically responsive imaging material—such as a panchromatically sensitized silver halide emulsion—it is possible to form a multicolor image. For instance, a negative-working silver halide emulsion can produce a multicolor negative image following exposure and development when exposed and viewed through the multicolor filter. A direct-positive imaging material will similarly produce a positive multicolor image. This approach, commercialized under the name Dufaycolor, and variations of it are illustrated by Dufay U.K. Pat. No. 15,027 (1912), Dufay U.S. Pat. No. 1,003,720, Land U.S. Pat. No. 3,138,459, and James, *The Theory of the Photographic Process*, 4th Ed., Macmillan, 1977, p. 335.

Dufay and others recognized the desirability of providing segmented interlaid filters of the smallest attainable sizes. Disadvantages were encountered in achieving proper registration of filter segments. Lateral spreading of the materials forming the filter segments was recognized to pose limitations, since unwanted mixing of filter materials, even if confined to edge regions, can produce unwanted shifts in hue. Dufay and others generally employed planar support surfaces, but in some instances filter segments were located in grooves.

K. E. Whitmore U.S. Ser. No. 184,714, filed Sept. 8, 1980, now U.S. Pat. No. 4,362,806, issued Dec. 7, 1982, commonly assigned, titled IMAGING WITH NON-PLANAR SUPPORT ELEMENTS, which is a continuation-in-part of U.S. Ser. No. 008,819, filed Feb. 2, 1979, now abandoned, recognized that lateral spreading can be overcome by placing the filter materials in microcells (or microvessels).

Whitmore applies to photographic imaging the use of supports containing arrays of microcells opening toward one major surface. In a variety of different forms the photographic elements and components disclosed by Whitmore contain an array of microcells in which first, second, and, usually, third sets of identical microcells are interspersed to form an interlaid pattern. In a typical form three separate sets of microcells, each containing a different subtractive primary (i.e., yellow, magenta, or cyan) or additive primary (i.e., blue, green, or red) imaging component, are interlaid. Preferably each microcell of each set is positioned laterally next adjacent at least one microcell of each of the two remaining sets. The microcells are intentionally sized so that they are not readily individually resolved by the human eye, and the interlaid relationship of the microcell sets further aids the eye in fusing the imaging components of the separate sets of microcells into a multicolor image.

In one specifically preferred embodiment disclosed by Whitmore, cyan, magenta, and yellow dyes or dye precursors of alterable mobility are associated with immobile red, green, and blue colorants, respectively, each present in one of the first, second, and third sets of microcells, and the microcells are overcoated with a panchromatically sensitized silver halide emulsion layer. By exposing the silver halide emulsion layer through the microcells and then developing, an additive primary multicolor negative image can be formed by the microcellular array and the silver halide emulsion layer while cyan, magenta, and yellow dyes can be transferred to a receiver in an inverse relationship to imagewise exposure to form a subtractive primary positive multicolor image. The foregoing is merely exemplary, many other embodiments being disclosed by Whitmore.

A technique disclosed by Whitmore for differentially filling microcells to form an interlaid pattern calls for first filling the microcells of an array with a sublimable material. The individual microcells forming a first set within the array can then be individually addressed with a laser to sublime the material initially occupying the first set of microcells. The emptied microcells can then be filled by any convenient conventional technique with a first imaging component. The process is repeated acting on a second, interlaid set of microcells and filling the second set of emptied microcells with a second imaging component. The process can be repeated again where a third set of interlaid microcells is to be filled, although individual addressing of microcells is not in this instance required. This approach is suggested by Whitmore to be useful in individually placing triads of additive and/or subtractive primary materials in first, second, and third sets of microcells, respectively.

H. S. A. Gilmour U.S. Ser. No. 192,976, filed Oct. 1, 1980, commonly assigned, titled AN IMPROVEMENT IN THE FABRICATION OF ARRAYS CONTAINING INTERLAID PATTERNS OF MICROCELLS, now abandoned in favor of U.S. Ser. No. 375,423, filed May 6, 1982, improves on Whitmore's process of filling interlaid sets of microcells with differing imaging compositions by employing a thermally destructible membrane to close one set of microcells while another set is being filled with or emptied of imaging material.

R. N. Blazey et al U.S. Ser. No. 193,065, filed Oct. 2, 1980, commonly assigned, titled PLURAL IMAGING COMPONENT MICROCELLULAR ARRAYS, PROCESSES FOR THEIR FABRICATION, AND ELECTROGRAPHIC COMPOSITIONS, now U.S. Pat. No. 4,307,165, improves on the processes of Whitmore and Gilmour in eliminating the need to employ either a sublimable material or a destructible membrane. Blazey et al differentially electrostically charges differing sets of microcells and employs an electrographic imaging composition to fill selectively at least a first set of microcells. In a preferred form the microcells are formed in an organic photoconductor, the photoconductor is electrostatically charged in a nonimagewise manner, laser scanning is employed to dissipate the electrostatic charge from a first set of microcells, electrographic development introduces a first imaging composition into the first set of microcells, and the process is twice repeated to fill second and third sets of microcells with second and third imaging compositions.

Land U.S. Pat. No. 3,284,208 illustrates the formation of a multicolor filter array for additive primary imaging using a transparent lenticular support. The lenticules on one major surface of the support are used to focus radiation in discrete areas on the opposite surface of the support bearing a radiation-sensitive material. By removing unexposed radiation-sensitive material and dyeing the material which remains, a first segmented filter is formed. The procedure is then twice repeated with the support being held in a different attitude with respect to the exposing radiation source in each instance so that the lenticules focus the radiation in laterally displaced regions of the opposite surface. By using different additive primary dyes in each dyeing step, three segmented interlaid filters can be produced.

SUMMARY OF THE INVENTION

In one aspect this invention is directed to a process comprising locating adjacent support means, areally extended along an axial plane, a predetermined, ordered array of lateral wall means capable of defining microareas. A first composition is positioned in one set of microareas on the support means, and a second composition is positioned on the support means in another, laterally displaced set of microareas which form an interlaid pattern with the one set of microareas. The process is characterized by the improvement comprising directing radiation toward the array at an acute angle with respect to the axial plane of the support means, the lateral wall means interrupting a portion of the radiation to create a first, shadowed set of microareas on the support means while permitting impingement of an uninterrupted portion of the radiation on a second, unshadowed, interlaid set of microareas of the support means, and selectively positioning the first composition as a function of shadowing in one set of the microareas.

In another aspect this invention is directed to an element comprising support means, areally extended along an axial plane. A predetermined, ordered array of lateral wall means is positioned to interrupt radiation directed toward the axial plane at an acute angle to thereby shadow a first set of microareas of the support means while permitting the radiation to impinge a second, unshadowed set of microareas of the support means forming an interlaid pattern with the first microareas. A first composition is positioned on the support means in the first set of microareas, and a second composition is positioned on the support means in the second set of microareas.

In an additional aspect this invention is directed to a support comprising a first portion which is areally extended along an axial plane and which forms the bottom walls of a predetermined, ordered array of microcells and a second portion which forms the lateral walls of the microcells. The first and second portions cooperate to form first and second interlaid sets of the microcells of the array. The support is characterized by the improvement wherein the first and second sets of microcells are differentiated in at least one of depth, lateral extent along the axial plane, and orientation.

This invention can be better appreciated by reference to the detailed description of the preferred embodiments considered in conjunction with the drawings, in which FIG. 1A is a plan view of a first support;

FIG. 1B is a section taken along line 1B—1B in FIG. 1A;

FIG. 2 is a section of a pixel of an alternative form of the support;

FIG. 3 is a section of a pixel of an additional form of the support;

FIG. 6B is a plan view of a support identical to that of FIG. 6A, but showing a different exposure;

FIG. 7 is a plan view of an additional support;

FIG. 9 is a section of a further varied support;

Figure 11:
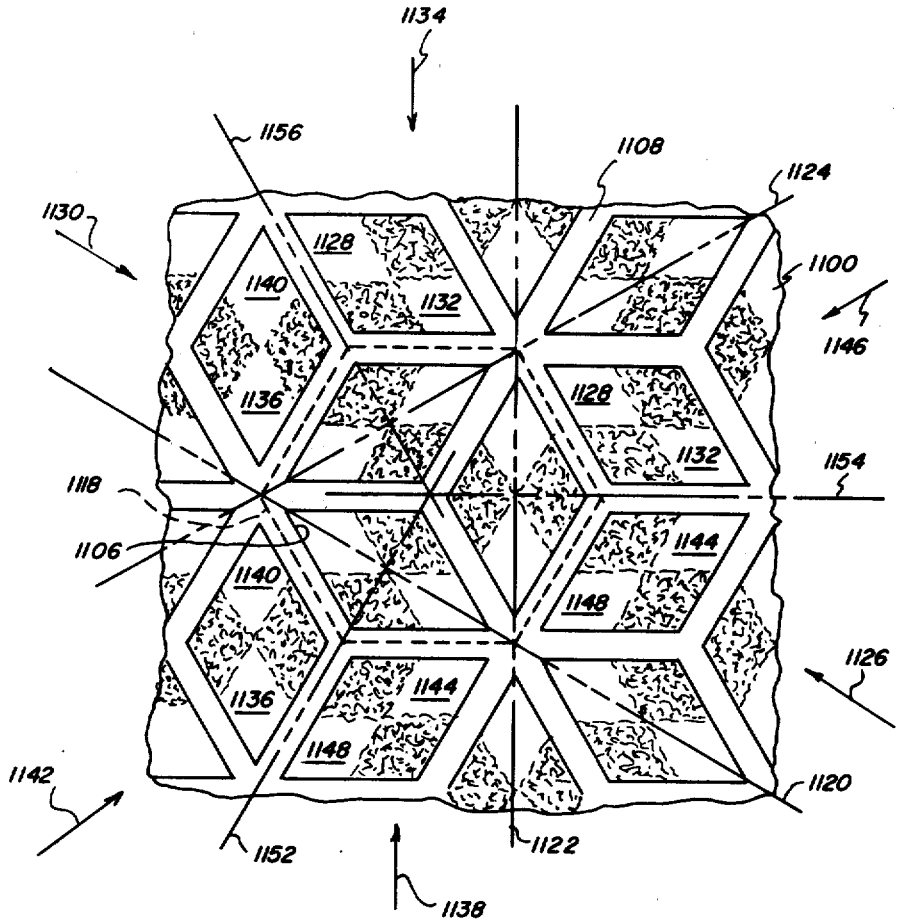
Figure 13:
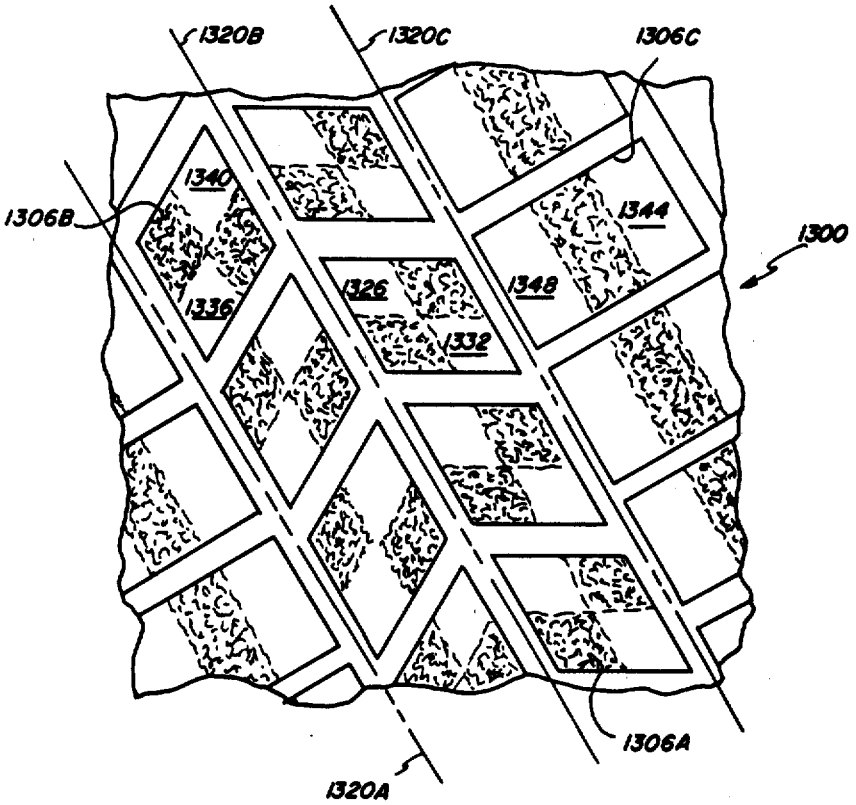
Figure 14A:
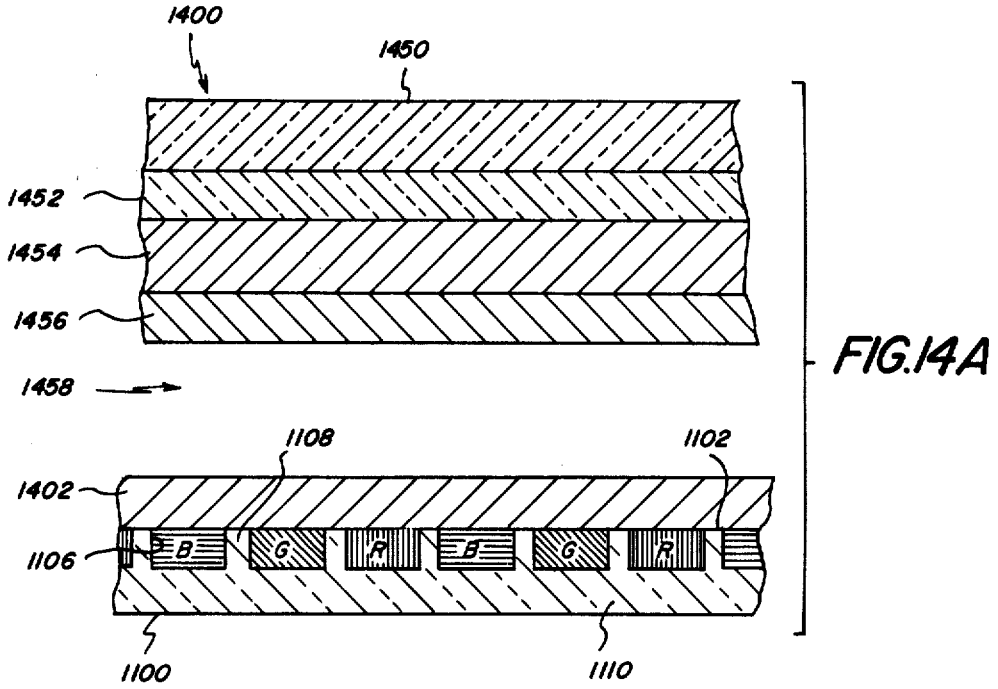
Figure 14B:
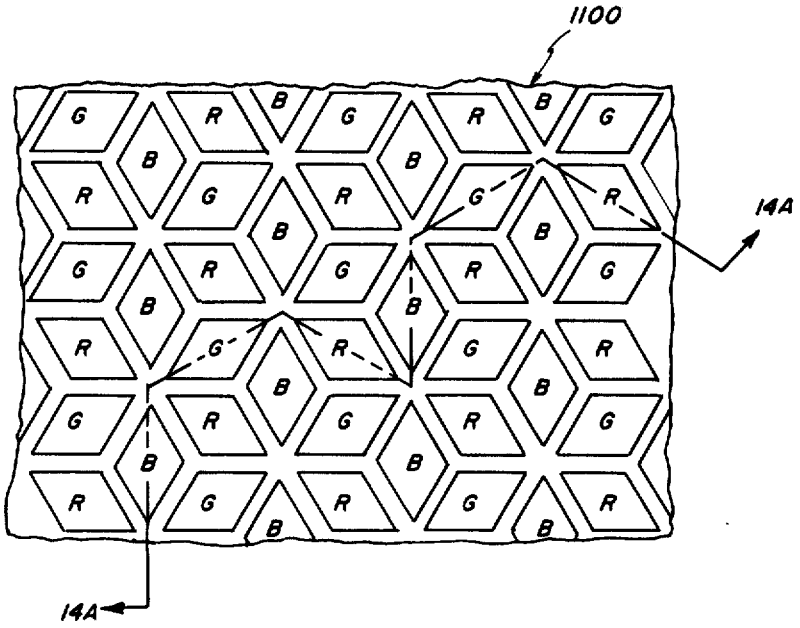

FIGS. 11, 12, and 13 are plan views of alternative preferred supports;

FIG. 14A is a sectional view of a color image transfer photographic element;

FIG. 14B is a plan view of the support shown in FIG. 14A; and

FIGS. 15A, 15B, 15C, and 15D are sectional views showing different stages of processing.

FIGS. 16A through 16D are plan views of the support of FIG. 11, exposed at different angles.

Figure 17:
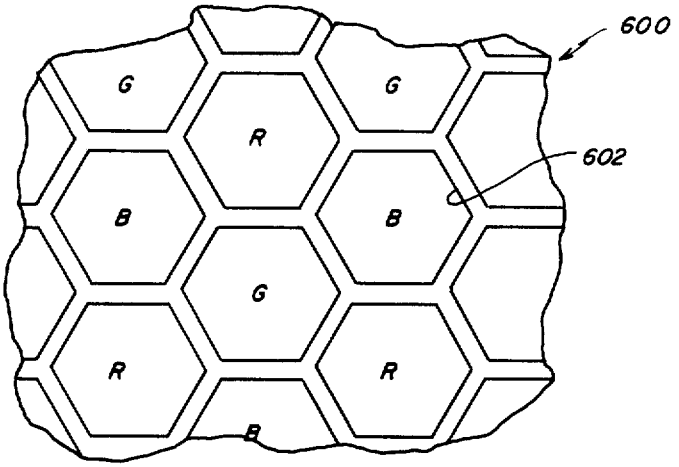

FIG. 17 is a plan view of the support of FIG. 6 in which red, green and blue materials are incorporated in an interlaid pattern.

Figure 18:
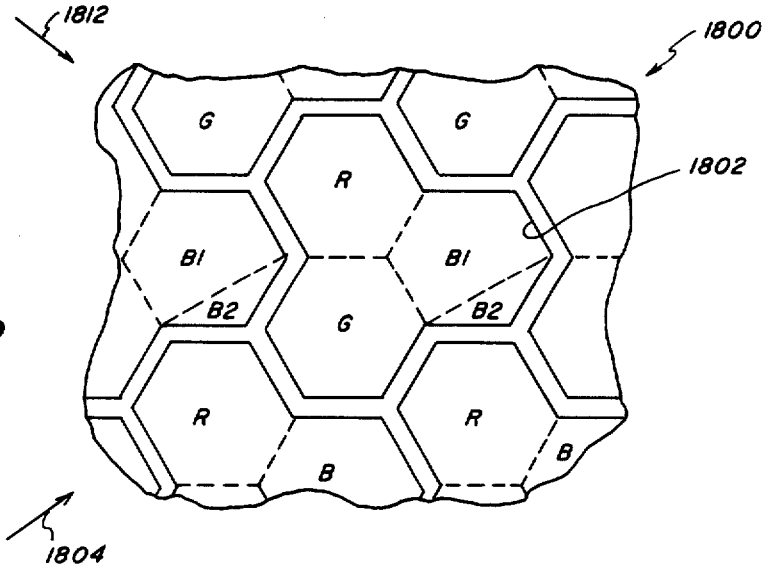
Figure 19:
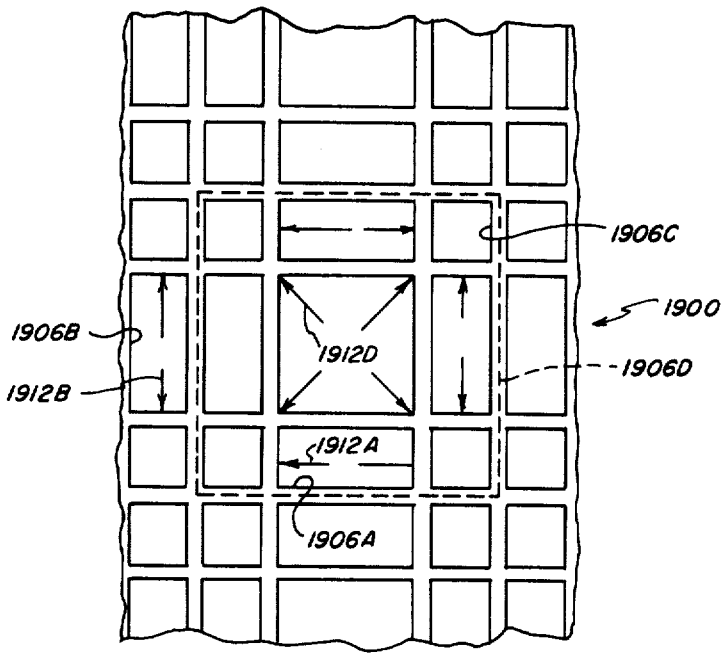
Figure 20:
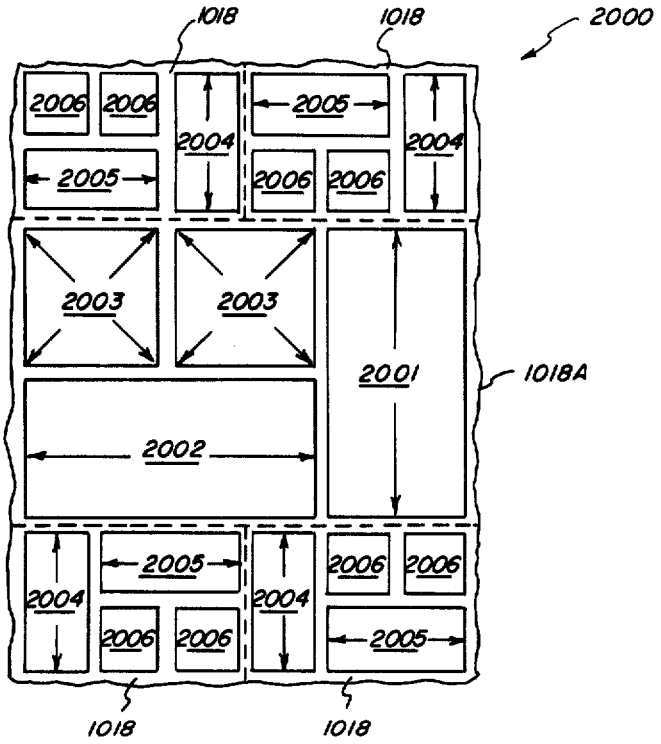

FIGS. 18, 19, and 20 are plan views of alternative supports.

The drawings are of a schematic nature for convenience of viewing. Since the individual microareas are too small to be viewed with the unaided human eye, the microareas and the elements in which they are contained are greatly enlarged. The depth of the microcells and microgrooves have also been exaggerated in relation to the thickness of the supports, which typically are from 50 to 500 or more times greater.

DESCRIPTION OF PREFERRED EMBODIMENTS

The present invention can be practiced with any support which is areally extended along an axial plane and has a predetermined, ordered array of lateral walls capable of interrupting radiation. The lateral walls can be an integral portion of the support or separate therefrom. The lateral wall array is positioned to create an interlaid pattern of shadowed and unshadowed areas when radiation is directed toward the support at an acute angle with respect to its axial plane. Further, the array is chosen to restrict dimensionally the individual shadowed and unshadowed areas of the interlaid pattern in at least one direction parallel to the axial plane so that they cannot be readily individually resolved by the unaided human eye. In other words, the lateral wall array is chosen to produce an interlaid pattern of shadowed and unshadowed microareas.

An illustrative simple support 100 is shown in FIGS. 1A and 1B. The support has substantially parallel first and second major surfaces 102 and 104. The support defines a plurality of parallel microgrooves 106, which open toward the first major surface of the support. The microgrooves are defined in the support by an array of lateral walls 108 which are integrally joined to an underlying portion 110 of the support.

In FIG. 1B the arrows 112 schematically designate radiation striking the support at an acute angle $\theta$ with respect to an axial plane 114 along which the support is areally extended. A portion of the radiation strikes the bottom walls 116 of the microgrooves in unshadowed microareas 116A while another portion of the radiation strikes the lateral walls 108 and is thereby interrupted, so that microareas 116B of the microgrooves are shadowed and do not receive radiation, at least not to the same extent, as the unshadowed microareas.

The lines 118 define the boundary of an area unit containing a single microgroove. The remaining depicted area of the support is formed by area units essentially identical to that within the boundary. Each area unit forms a pixel. The term "pixel" is employed herein to indicate an area which can be repeated to make up the support.

Certain features of the invention can be appreciated by reference to support 100. First, it should be noted that the lateral walls 108 lie along half the boundaries between adjacent microareas. Thus, if a material is contained in the microgrooves which is capable of lateral spreading, it is restrained from spreading between microareas over half of the boundaries therebetween. Similarly, radiation that might otherwise be scattered between adjacent microareas is also restrained where the lateral walls are present.

The acute angle $\theta$ at which the radiation is directed toward the support can be varied by repositioning either the radiation source and/or the support. As shown, the radiation is directed parallel to the section line 1B—1B and perpendicular to the major axes of the lateral walls 108. In this orientation the minimum angle of $\theta$ at which the radiation can strike the bottom walls 116 is determined by the relationship $\tan \theta = H/W$, where H is the height of the lateral walls 108 and W is the width of the bottom walls 116. It is therefore apparent that the proportion of the bottom walls that are unshadowed can be controlled by varying any one or combination of $\theta$, H, or W. Further, if the support is rotated 90° with respect to the radiation source so that the radiation is introduced perpendicular to the section line 1B—1B, no shadows are produced. It is therefore apparent that maximum shadowing for a given value of $\theta$ is achieved when radiation is introduced perpendicularly to the major axes of the lateral walls and that the degree of shadowing can be decreased by rotating the lateral walls of the support toward alignment with the radiation.

FIGS. 2 and 3 illustrate pixels of variant forms of supports generally similar to support 100. In FIG. 2 support 200 is shown having a first major surface 202 and a second major surface 204. A microgroove 206 is shown opening toward the first major surface. The support is formed with the microgroove having inwardly sloping walls which perform the functions of both the lateral and bottom walls of the microgrooves 106.

In FIG. 3 a pixel of a support 300 is shown. The support is comprised of a first support element 302 having a first major surface 304 and a second substantially parallel major surface 306. Joined to the first support element is a second support element 308 which is provided in each pixel with an aperture 310. The second support element is provided with an outer major surface 312. The walls of the second support element forming the aperture 310 and the first major surface of the first support element together define a microgroove. The support is comprised of repetitions of the pixel shown.

Referring to FIG. 1A, it can be appreciated that if the support 100 is resolved into two separate halves joined along the section line 1B—1B and one half is translated with respect to the other along the axial plane 114, the support continues to respond to angled radiation exposure substantially as described above—that is, it continues to satisfy the essential shadowing criteria described above. The plane represented by the section line 1B—1B thus constitutes a glide plane—herein defined as a plane separating two support portions which can be displaced relative to each other along the axial plane of the support without dimininishing the shadowing utility of the support. It is further observed that the support 100 can be resolved not just into halves, but into a large number of separate portions displaced along the axial plane without substantially altering its shadowing utility. It is thus apparent that the supports 100, 200, and 300 provide only simple examples of a large family of lateral wall arrays that provide roughly similar shadowing utility.

Figure 4:
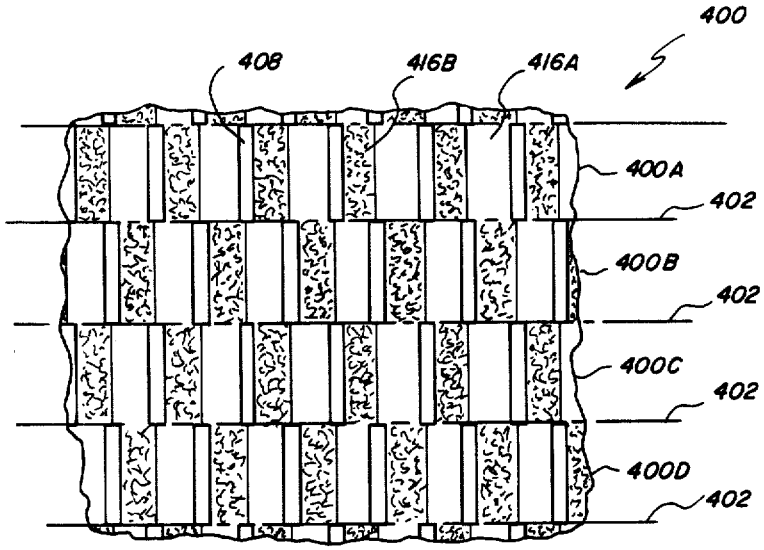
FIG. 4 is a plan view of an alternative support.

This is specifically illustrated in FIG. 4 in which support 400 is comprised of identical support regions 400A, 400B, 400C, and 400D joined along parallel glide planes 402. In comparing supports 100 and 400, it can be seen that the two supports are identical, except that the support regions 400A and 400C are laterally displaced with respect to the support regions 400B and 400D. This has the result of producing lateral walls 408 and microareas 416A and 416B which are limited in their maximum dimension in the form shown to the distance between glide planes 402. Thus, support 400 is superior to support 100 for applications in which the microareas are preferably limited in their longest dimension. For example, by positioning the glide planes between support regions at a spacing of 200 microns or less and the lateral walls within each support region at a center-to-center spacing of 400 microns or less, microareas limited in both length and width to 200 microns or less can be readily obtained. As a result of the relative translation of adjacent support regions, the support 400 contains no grooves, but only upstanding lateral walls. This illustrates that neither microgrooves nor any other type of areally limited depressions in the support are required for the practice of this invention. It is recognized that the support 400 can, if desired, appear in section essentially identical to any one of supports 100, 200, or 300.

In further comparing the microarea patterns of supports 100 and 400, it can be appreciated that the microareas 416A and 416B are interspersed to a greater degree than the microareas 116A and 116B. The microareas 416A and 416B are interlaid along two perpendicular axes, whereas the microareas 116A and 116B are interlaid along only one axis. The higher degree of interlay can represent a distinct advantage for specific applications requiring a high degree of interlay for desired optical or chemical properties.

Still further comparing the supports 100 and 400, it can be seen that the lateral walls 408 separate the first and second microareas 416A and 416B over a boundary approximately equal in length to that by which the lateral walls 108 separate the microareas 116A and 116B. However, in the support 400, because the microareas 416A and 416B are more highly interspersed, there is a larger boundary between adjacent microareas where no lateral walls are present. This feature of the support 400 can, however, be readily modified in a manner which does not diminish the shadowing utility of the support. If, for example, additional lateral walls are introduced along the glide planes 402 in FIG. 4, it can be seen that the lateral walls now extend over a much larger proportion of the boundaries between adjacent microareas. The result is to limit significantly the boundary region available for lateral spreading between adjacent microareas.

If additional lateral walls are provided for the support 400 along the glide planes 402, it is apparent that a predetermined, ordered array of microcells is created, each containing two microareas. The term "microcell" is herein defined as a cell or vessel too small in size to be readily individually resolved with the unaided human eye. In the geometrical form described the microcells produced on the modified support 400 are approximately square, but it is apparent that microcells of any geometric configuration can be employed. Thus, supports exhibiting any of the microcell or microvessel configurations disclosed by Whitmore, Gilmour, and/or Blazey et al in the copending patent applications cited above, can be employed in the practice of this invention. Hence all of the microcellular supports disclosed in these patent applications are useful in the practice of this invention. Polygonal (square, rectangular, and hexagonal), circular, and elliptical microcell configurations have been explicitly disclosed, although any other predetermined recurring microcell configuration (or combination of configurations, discussed below) can be employed in the practice of this invention.

Any predetermined, ordered array of lateral walls capable of interrupting radiation, whether or not microcells or microgrooves are formed by these walls, can be employed in the practice of this invention to produce two or more laterally displaced contiguously adjoining microareas (that is, microareas which over some boundary region are not separated by lateral walls). Supports having uniformly spaced lateral wall arrays, such as supports 100 and 400, or supports having a single repeated microcell configuration are particularly suited for forming two or more laterally displaced contiguous sets of microareas that are of uniform size in each individual occurrence.

FIGS. 1A, 1B, and 4 illustrate perhaps the simplest shadowing approach of this invention wherein the bottom walls of the supports are shown divided into two separate interlaid sets of uniform microareas of substantially equal area by a single exposure of the support to radiation directed toward the axial plane of the support at an acute angle. Where one composition is introduced into exposed microareas and a second composition is introduced into unexposed of shadowed microareas, an interlaid array of two separate compositions is produced. For some applications the microareas represented by the lateral walls can also be utilized, so that three separate useful sets of microareas are actually present.

Supports useful as described above can also be applied to applications requiring more than two laterally displaced compositions. For example, in FIGS. 1A and 1B it can be seen that by adjusting the angle of exposure $\theta$, the size of the microareas 116A exposed can be adjusted. If, for example, it is desired to place three separate strips of equal size of three separate compositions between adjacent pairs of lateral walls 108, the angle $\theta$ is adjusted so that the radiation strikes only one third of the area of each bottom wall 116. A first composition can then be selectively positioned in the microareas corresponding to the exposed portions of the bottom walls. The angle $\theta$ is then increased so that on a second exposure radiation strikes the area originally struck, now containing the first composition, and a contiguous one third of each bottom wall 116. A second composition is then selectively positioned in the microareas corresponding to the exposed areas not occupied by the first composition. The procedure can be repeated using radiation directed perpendicularly to the axial plane 114 to position a third composition in a third laterally displaced set of microareas, or the third composition can in many instances be introduced by a conventional technique for coating a single composition, such as doctor blade coating. Although described by reference to three compositions and a specific support, it is apparent that the procedure is generally useful with all of the supports containing lateral wall arrays herein described and with more than three compositions.

The procedure described above for positioning three or more laterally displaced compositions, while useful with all lateral wall array patterns, relies in part on the presence of a previously positioned composition to define a microarea resulting from a later exposure. Stated another way, the first and second exposures are in part areally overlapping. This limits the shadowing procedure described above to use with materials which allow the presence or absence of one composition to exclude a subsequent composition, as is possible in certain preferred embodiments of this invention. Exclusion and exhaustion effects are discussed more specifically below.

Figure 5A:
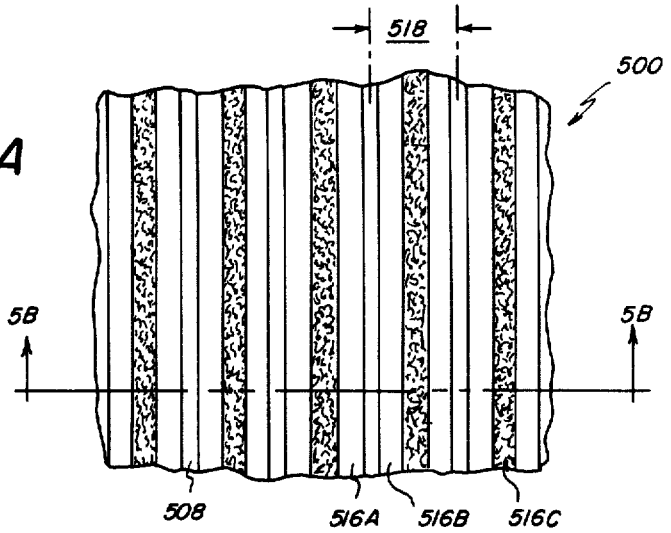
FIG. 5A is a plan view of another support.
Figure 5B:
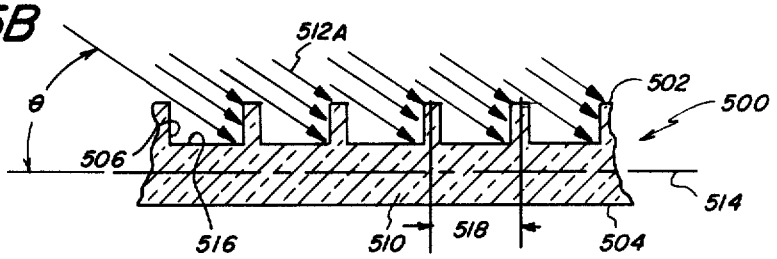
FIGS. 5B and 5C are sections taken along section line 5B—5B in FIG. 5A showing differing exposures.
Figure 5C:
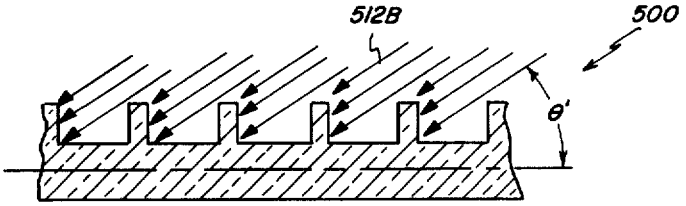

It is possible to address uniquely two or more areas of a support according to this invention so that no materials dependent exclusion effect is relied upon. An approach for uniquely addressing two separate sets of microareas with radiation while creating a third set of microareas by shadowing is illustrated in FIGS. 5A, 5B, and 5C. Except as otherwise noted below, the features bearing 500 series reference numerals are identical to those bearing the corresponding 100 series reference numerals in FIGS. 1A and 1B and are not redescribed in detail.

The support 500 as illustrated differs from support 100 solely in the use of an optional transparent underlying portion 510; however, the lateral walls 508 remain capable of interrupting radiation. In FIG. 5B radiation 512A is directed toward the axial plane 514 at an angle $\theta$ chosen to permit impingement of radiation only on the mircoareas 516A. The remaining area of each bottom wall 516 is shadowed by the lateral walls 508. Thus, exposure as shown in FIG. 5B creates one set of microareas 516A in an interlaid pattern with remaining support areas. A first composition can be selectively positioned in the first set of microareas.

In FIG. 5C the support is given a second exposure to radiation 512B at an acute angle $\theta'$. As shown, the radiation exposure patterns in FIGS. 5B and 5C are mirror images, although the angles $\theta$ and $\theta'$ need not be equal, except when the microareas 516A and 516B are intended to be equal. Instead of changing the direction of radiation between the first and second exposures, the support could alternatively be rotated 180° in the axial plane.

Radiation impinges on the bottom walls 516 only in the microareas 516B, creating a second set of radiation exposed microareas. A second composition can be selectively positioned in the second set of microareas. A third set of microareas 516C, not exposed by either the first or second exposures, is created concurrently with the second set of microareas. A third composition can be positioned in the third set of microareas, if desired. It is to be noted that the first composition is laterally spaced from the second microareas, and no exclusion property is required in order to position the second composition. It is appreciated that the angles $\theta$ and/or $\theta'$ can be increased to eliminate the microareas 516C without in any way altering the shadowing technique described above.

Using the supports 100, 200, 300, 400, and 500 only two interlaid sets of microareas can be uniquely addressed by shadowing techniques. By the term "uniquely addressed" it is meant that a set of microareas is exposed to only the single radiation exposure which defines its boundaries and no other microarea defining radiation exposure. It is possible, however, to produce three, four, five, six, or even more sets of uniquely addressed microareas in a single support containing microcells. For this purpose microcells of polygonal shape are preferred. Generally the number of sets of uniquely addressed areas that can be produced by shadowing in a single polygonal microcell is equal to its number of apices.

Figure 6A:
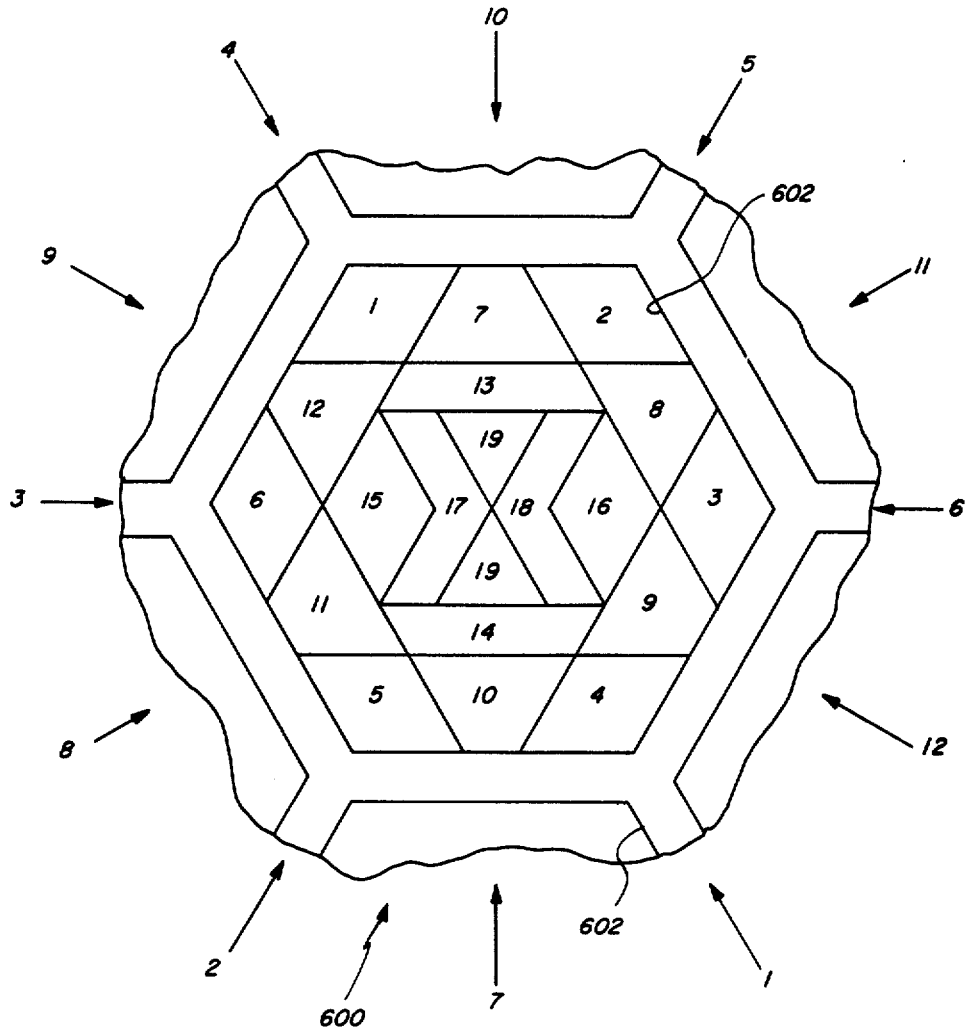
FIG. 6A is a plan view of still another support.

An illustration of the creation of microareas in a set of polygonal microcells by shadowing techniques of the type described above is provided in FIGS. 6A and 6B, in which a detail of a support 600 containing a predetermined, ordered array of microcells 602 of a regular hexagonal shape is shown. The support 600 in section can appear identical to the supports shown in FIGS. 1B, 2, 3, or 5B. Referring first to FIG. 6A, exposure of the support 600 in a direction parallel to arrow 1 at an acute angle with the axial plane of the support exposes the bottom wall of each microcell in only diamond-shaped area 1, the remainder of the wall of each microcell being shadowed. By changing the direction of exposure, as indicated by arrows 2, 3, 4, 5, and 6, but not the exposure angle, five more identical diamond-shaped exposed microareas 2, 3, 4, 5, and 6 are produced. The six diamond-shaped microareas provided in each microcell are of equal area, since each microcell is a regular hexagon and the angle of exposure is unchanged. It is to be noted that none of the six microareas impinges on any other of the six diamond-shaped microareas and therefore each is uniquely addressed by shadowing exposures. Thus, it is possible to place up to six separate compositions in each microcell 602 without relying upon any exclusion property.

Exposure can be terminated after the sixth exposure and the central area of each microcell can be left unexposed, if desired. In this instance the lateral spacing in the center of each microcell between compositions introduced into the six separate microareas can be relied upon to prevent or reduce boundary mixing of compositions. In an alternative form in which the central region is desired to receive material, one or more compositions can be employed capable of wandering from the diamond-shaped areas to cover the central portion of each microcell.

By using a combination of the procedures described above and exclusion effects, it is possible to produce additional microareas in each hexagonal microcell 602. As shown in FIG. 6A, a microarea 7 equal in area to the diamond-shaped areas is produced by exposing at the same acute angle in a direction indicated by arrow 7. The radiation overlaps both the microareas 1 and 2 in exposing additional microarea 7. By using exclusion effects a seventh composition can be located in only the microarea 7. Microareas 8, 9, 10, 11, and 12 are sequentially similarly formed by shadowing exposures along like numbered axes.

Thus far it can be seen that 12 microareas can be formed, six of which can be uniquely addressed and six of which depend on exclusion effects. At this point the central portion of each hexagonal microcell remains shadowed. If desired, the central portion of the microcell can be left shadowed and unfilled. Alternately, the central, shadowed portion of the microcell can be filled with a single composition. For example, if the microareas 1, 2, 3, 4, 5, and 6 receive a first composition and the microareas 7, 8, 9, 10, 11, and 12 receive a second composition, a third composition can be located in the central, shadowed portion of each microcell, and three compositions will occupy roughly equal areas of each microcell bottom wall.

By increasing the acute angle of exposure and relying on exclusion effects, it is possible to form additional microareas in the central, initially shadowed portion of each microcell. By exposing again in the direction indicated by arrow 7, but at an increased acute angle, the microarea 13 can be formed, which is roughly equal to the previously formed microareas. Similarly, by exposing in the direction indicated by arrow 10 microarea 14 can be formed. By exposure in the direction indicated by arrow 6 the microarea 15 can be formed, and by exposing in the direction indicated by arrow 3 the microarea 16 can be formed. Microareas 13, 14, 15, and 16 are all formed at the same acute angle of exposure and are approximately equal. By increasing the acute angle of exposure again, microareas 17 and 18 can be formed by exposing in the direction indicated by arrows 6 and 3, respectively. These microareas are roughly equal to the previously formed microareas. Two triangular microareas 19 remain unexposed which, together are roughly equal to the remaining microareas. By using shadowed microareas 19 as one microarea, 19 laterally spaced compositions can be placed on the bottom walls of each hexagonal microcell, each composition occupying an approximately equal area. The shown pattern is, of course, only exemplary. Shadowing exposures can produce microareas of differing configuration, size, and number.

The ability to uniquely address a plurality of sets of microareas so that the microareas cover an entire surface of a support, except for the areas occupied by lateral walls, is an obvious advantage in making maximum use of a support surface and in achieving a high degree of interdigitation of compositions. Some lateral wall patterns offer this capability and some do not. In referring to supports 100, 200, 300, 400, and 500, it can be seen that the lateral wall patterns permit the creation of uniquely addressed microareas which cover the entire support surface not occupied by the lateral walls. It is also apparent that microcells of square or rectangular configuration also offer this capability, since it has already been pointed out above that any two contiguous microareas in the same segment of the support 400 can be enclosed in a microcell without altering the shadowing capability of the support. Upon further reflection it can be appreciated that square and rectangular microcells are but special cases of lozenge (diamond-shaped) and parallelogram configuration microcells and that all such microcells can be uniquely addressed over their entire bottom wall areas. As shown in FIG. 6A, the uniquely addresed areas 1 through 6 of the hexagonal microcells 602 do not occupy the entire bottom surface of the microcell; but, referring to FIG. 6B, the identical support is uniquely addressed over the entire bottom walls of the microcells by three exposures at an acute angle with respect to the axial plane. Area 1 is addressed by exposure in a direction 1, area 2 by exposure in a direction 2, and area 3 by exposure in a direction 3. This demonstrates that uniquely addressing microcells over their entire bottom walls is a function not only of the shape of the microcells, but also a function of the angle and direction of exposure. Many microcell configurations, such as circular, elliptical, triangular, and trapezoidal microcells cannot be uniquely addressed over their entire bottom wall areas by shadowing techniques, regardless of the number or angle of shadowing exposures attempted.

Whitmore, Gilmour, and Blazey et al, cited above, employ support containing microcells which are not only identical in each occurrence, but are identically aligned in each occurrence. While the present invention can employ supports containing any of the microcell arrangements disclosed by Whitmore, Gilmour, and Blazey et al, it is additionally recognized that advantageous results can be obtained by using supports containing identical microcells which by their orientation can be resolved into interlaid sets that can be differentially addressed.

This is illustrated in FIG. 7, in which a support 700 is provided with a plurality of identical microcells which appear triangular in plan. As can be readily appreciated, however, the triangular microcells are not all similarly aligned. There are two interlaid sets of microcells 702A and 702B. When the support is addressed by radiation at an acute angle with respect to its axial plane, as indicated by arrow 704, radiation strikes the bottom walls of the microcells 702A in microareas 706A and strikes the bottom walls of the microcells 702B in microareas 706B. It is to be noted that the microareas are equal, but differ in their orientation similarly as the microcells in which they occur. While the trianglar microcells shown are each equilateral triangles, triangles of any desired type, including isosceles and right triangles, can be employed with similar results.

In each of the embodiments heretofore described at least two sets of microareas are contiguously adjoining—that is, they are not separated by a lateral wall over some portion of their boundary. Thus, the advantages which lateral walls have to offer in preventing lateral spreading either of materials or radiation are partially, but not entirely, realized. It is not possible using any of the supports disclosed by Whitmore, Gilmour, or Blazey et al to locate two or more compositions in two or more interlaid sets of microareas each entirely separated from the other by lateral walls by shadowing techniques of the type described above. The preferred supports of this invention are those which offer the capability of providing two or more interlaid sets of microareas by shadowing techniques, each of the microareas being entirely separated from microareas of other sets by lateral walls. Specifically preferred supports are those which allow three separate compositions to be interlaid by shadowing techniques in separate sets of microareas each separated from the other by lateral walls.

Figure 8A:
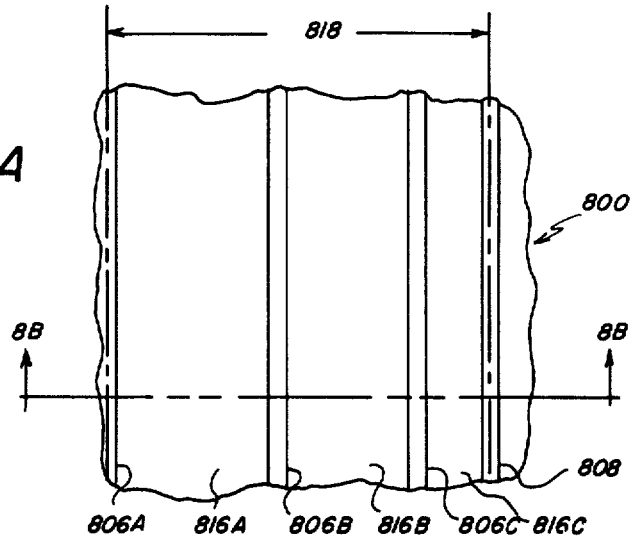
FIG. 8A is a plan view of yet another support.
Figure 8B:
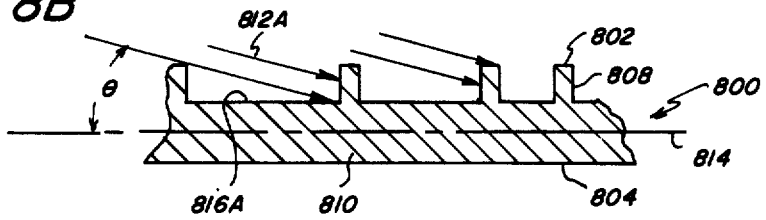
FIGS. 8B and 8C are sections taken along section line 8B—8B in FIG. 8A showing differing exposures.
Figure 8C:
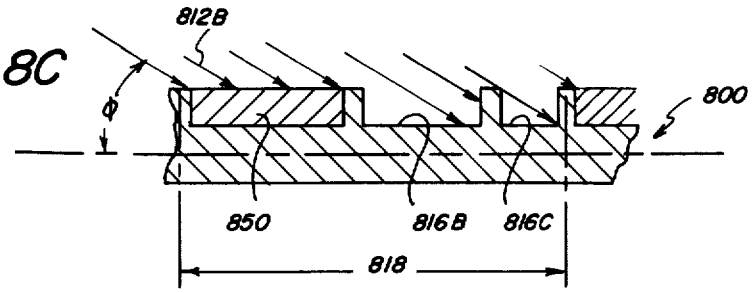

A simple support 800 capable of providing three interlaid sets of microareas each entirely separated from the other by lateral walls is illustrated in FIGS. 8A, 8B, and 8C. Except as otherwise noted, the features bearing 800 series reference numerals are identical to those bearing the corresponding 100 series reference numerals in FIGS. 1A and 1B and are not redescribed in detail.

The lateral walls 808 of the support are arranged in parallel relationship, but unlike the lateral walls in support 100, are unequally spaced in a predetermined, ordered manner. The widest spaced lateral wall pairs together with the connecting portion 810 form a first set of microgrooves 806A each having a bottom wall 816A. The next widest spaced pairs of lateral walls similarly form a set of microgrooves 806B each having a bottom wall 816B. The closest spaced pairs of lateral walls form a third set of microgrooves 806C having a bottom wall 816C.

When the support is exposed with radiation as indicated by arrows 812A in FIG. 8B, the acute angle $\theta$ with respect to the axial plane 814 is chosen so that the radiation strikes only the bottom walls 816A. The bottom walls 816A are shadowed, however, to some degree. The extent to which the bottom walls 816A are shadowed can be reduced significantly by performing a second exposure as described above in connection with support 500. For example, the support can be rotated 180° and given a second exposure at the same angle. By properly positioning the lateral walls and choosing the angle $\theta$, it is possible to expose all of the bottom walls 816A without exposing any portion of the bottom walls 816B and 816C. Once the bottom walls 816A have been selectively exposed, a first composition can be selectively located in the first microgrooves 806A.

With a first composition 850 in place, as shown in FIG. 8C, the support is given a second exposure to radiation 812B at an increased acute angle $\phi$ with respect to the axial plane. Radiation strikes the first composition in the first microgrooves and also the bottom walls 816B of the second microgrooves 806B, but is blocked by the narrowness of the third microgrooves 806C from striking the bottom walls 816C. Since a portion of the bottom walls 816B remain shadowed, the support can be rotated 180° and exposed again to increase the exposure of the bottom walls 816B as a function of exposure. The second set of microgrooves 816B can then be filled with a second composition. A third composition can be introduced into the third microgrooves 806C similarly as in positioning a third composition in the microareas 516C.

The area between the lines 818 forms a single pixel of the support 800. It is to be noted that the microareas 816A, 816B, and 816C of the pixel present unequal areas. In applications where a more nearly equal distribution of microareas is preferred, the support can be formed so that the number of occurrences of each microarea is varied to more closely balance the total areas presented by the separate sets of microareas. For example, a second microarea 816C can be added to each pixel 818, thereby doubling the area of the third set of microareas without in any way altering the shadowing capability of the support 800 described above.

An alternative support which responds to shadowing exposures identically as the support 800, described above, but which offers the further advantage of providing three interlaid sets of microareas that present equal areas in each individual occurrence is shown in FIG. 9. The support 900 is shown by reference to a single pixel 918, which contains three separate microgrooves 906A, 906B, and 906C. The only difference between the microgrooves is the depths of the bottom walls 916A, 916B, and 916C, which, as shown, are parallel to the axial plane 914 of the support.

Shadowing exposure of the support 900 can be appreciated by reference to the arrows 912A, 912B, and 912C which strike the intersections of the bottom and lateral walls of the microgrooves 906A, 906B, and 906C, respectively. By reference to the arrows it can be appreciated that an exposure to radiation at an angle greater than $\theta$, but less than $\phi$, will strike the bottom walls of the microgrooves 906A while leaving the bottom walls of the microgrooves 906B and 906C entirely in shadow. After a first composition is introduced into the microgrooves 906A, a second exposure at an angle with respect to the axial plane of greater than $\phi$ and less than $\alpha$ will permit the bottom walls 916B of the microgrooves 906B to be exposed without exposing any portion of the bottom walls 916C of the microgrooves 906C. After a second composition is introduced into the second microgrooves, a third composition can be introduced into the third microgrooves by any technique described herein for introducing a third composition.

It is apparent that the supports 800 and 900 can be resolved into separate segments along glide planes similarly as the support 100 is resolved along glide planes to form the support 400. Further, although described by reference to parallel lateral walls only, it is apparent that the use of the sets of microcells differing in lateral extent, in depth, or in any combination of both can be employed in the practice of this invention. Although described above in terms of three separate sets of microareas, it is appreciated that any one of the three sets of microareas in the supports 800 and 900 can be omitted to allow two compositions to be interlaid substantially as described.

Figure 10A:
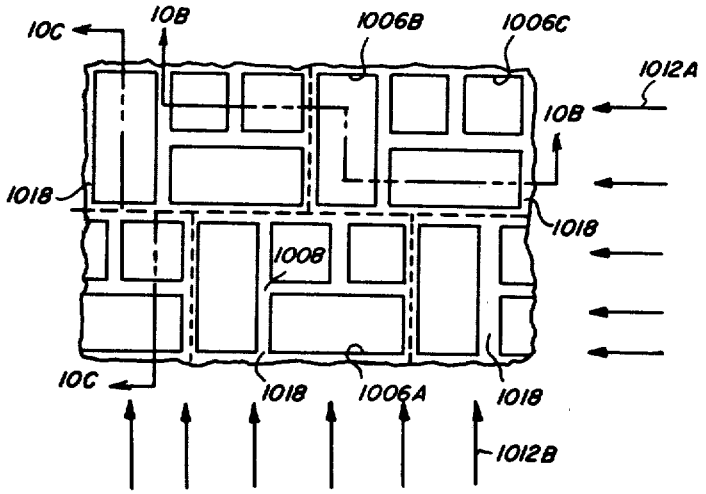
FIG. 10A is a plan of a preferred support.
Figure 10B:
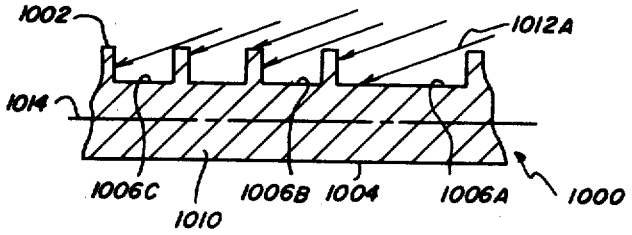
FIG. 10B is a section along section line 10B—10B in FIG. 10A.
Figure 10C:
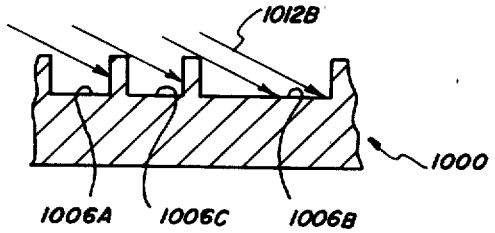
FIG. 10C is a section along section line 10C—10C in FIG. 10A.

FIGS. 10A, 10B, and 10C illustrate a preferred support 1000 for use in the practice of this invention which is (1) capable of entirely laterally separating three different compositions similarly as supports 800 and 900, (2) capable of providing equal composition microareas similarly as support 900, (3) capable of additionally providing equal microcell volumes of each composition within each pixel, (4) capable of being radiation exposed by shadowing techniques over the entire bottom wall area of each of three separate sets of microcells, and (5) capable of having two microcell sets uniquely addressed.

The support 1000 is comprised of substantially parallel first and second major surfaces 1002 and 1004. The support defines a first set of rectangular microcells 1006A, a second set of rectangular microcells 1006B, and a third set of square microcells 1006C. The microcells are defined in the support by an array of lateral walls 1008 which are integrally joined to an underlying portion 1010 of the support.

The microcells 1006A and 1006B as shown are identical in shape, but not in orientation. The major axis of each microcell of the first and second set is aligned with or parallel to the major axis of microcells of the same set and perpendicular to the major axis of each microcell of the other set. The set of square microcells is positioned so that an edge of each square is substantially parallel to an adjacent edge of a rectangular microcell.

The dashed lines in FIG. 10A separate the support into identical pixels 1018. Each pixel contains one rectangular microcell from each of the first and second sets and two square microcells of the third set.

By uniformly exposing the first major surface of the support in the direction indicated by the arrows 1012A, it is possible to expose selectively the bottom walls of the first set of microcells 1006A while the lateral walls prevent direct impingement of the radiation on the bottom walls of the remaining two sets of microcells. If desired to expose entirely the bottom walls of the first set of microcells, the support can be rotated 180° and exposed again at the same angle or the support can be exposed again at the same angle, but with the horizontal direction component of the radiation as shown in FIG. 10A reversed. After a first composition is positioned in the first set of microcells as a function of exposure, the bottom walls of the second set of microcells 1006B can be selectively exposed by uniformly exposing the first major surface of the support in the direction indicated by the arrows 1012B, and in the opposite horizontal direction at the same acute angle similarly as in exposing the bottom walls of the first set of microcells. The bottom walls of the first and third sets of microcells are not exposed. A second composition can then be selectively introduced into the second set of microcells as a function of exposure. The bottom walls of the third set of microcells can then be exposed by addressing the first major surface of the support in a direction perpendicular to its axial plane 1014. A third composition can then be introduced into the third set of microcells. It is to be noted that no exclusion property is required to introduce selectively the first and second compositions into the first and second sets of microcells, but that in using a third, perpendicular exposure the first and second compositions must exclude the third composition from the first and second sets of microcells, since the third set of microcells is not uniquely addressed, but is addressed concurrently with all the other microcells.

In considering the sequence of exposures disclosed above, certain more general parameters of the invention will become apparent. In exposing the microcells 1006A, it is apparent that it is their length and the height of the lateral walls which controls exposure of the bottom walls. Exposure is entirely independent of the width of the first set of microcells. It is therefore apparent that the width of the first set of microcells can be varied at will from very small to very large, depending upon the size of the microareas and the amount of the first composition desired. The width of the microcells of the first set in the direction of arrows 1012B can even be increased to a point where it exceeds the length of these microcells in the direction of arrows 1012A. The widths can, of course, be variable from one microcell to the next, if desired. The microcells 1006B of the second set can be of any desired length, but to avoid being exposed on their bottom walls while the first set of microcells are being addressed, the width of the second set of microcells must be no greater than half the length of the first set of microcells. Measured in a direction parallel to the major axes of the first set of microcells, the microcells of the third set can be up to one half the length of the microcells of the first set without being addressed on their bottom walls during exposure of the bottom walls of the microcells of the first set. The microcells of the third set similarly can be up to half the length of the microcells of the second set measured in a direction parallel to the major axes of the second set of microcells. In the preferred form shown the first and second sets of microcells are of equal length and the microcells of the third set are each substantially one half the length of both the first and second sets of microcells and thus square; however, the third set of microcells can be rectangular whether or not the first and second sets of microcells are of equal length. As suggested above, the rectangular microcells of the first and second sets are only an example of a general class of microcells of parallelogram configuration. The microcells of the third set, shown to be square, can be of either lozenge or parallelogram configuration. Stated another way, adjacent sides of the microcells need not be perpendicular, but to retain the functional capabilities disclosed, opposite sides of the microcells should remain parallel. The above discussion is limited to microcell dimensions that provide all the advantages of the support 1000 as shown. If less than the entire bottom wall of each microcell of the first and second set is to be addressed by radiation, then the dimensions of the second and third sets of microcells can be increased above the one half limits indicated.

A number of variations of the support 1000 and the shadowing technique for introducing compositions will readily be apparent. For example, instead of giving the support a third exposure to introduce the third composition, in many instances the third composition can be introduced without reference to any exposure pattern, simply relying on the first and second compositions to exclude the third composition from the first and second sets of microcells, as has been mentioned in connection with previously discussed supports. The support 1000 can be adapted to the use of two rather than three compositions merely by omitting any one of the three sets of microcells without otherwise altering the capabilities or shadowing techniques described above. It is to be noted that the placement of the individual microcells in relation to each other is entirely a matter of choice. For example, instead of placing pairs of square microcells side-by-side, as shown, they can be separated by intervening rectangular microcells. Alternatively, the square microcells can form columns and/or rows perpendicular to the columns which are not interrupted by rectangular microcells.

In looking at the support 1000, it is apparent that it is only exemplary of a large family of alternative support configurations capable of exhibiting some or all of the advantages of this invention. For example, if the microcells 1006B are arranged in an end-to-end pattern in parallel columns (this can be done by laterally displacing the support along the horizontal dashed line in FIG. 10A extending in the same direction in the axial plane as the arrows 1012A); it is apparent that glide planes exist in these columns. By laterally displacing the support on one side of a glide plane one-half the length of the microcells 1006B, the second set of microcells 1006B are transformed into a serpentine microgroove. The shadowing utility of the support is not affected, however. In like manner, it can be appreciated that if the square microcells are arranged in a row or column uninterrupted by rectangular microcells, glide planes exist in these rows or columns. By translating one portion of the support on one side of a glide plane with respect to the portion of the support on the other side, the square microcells are converted into a serpentine microgroove, but the shadowing utility of the support is not changed. If additional lateral walls are provided aligned with the glide planes, the serpentine microgrooves, formed by displacing halves of the first set of rectangular microcells, become rectangular microcells again, with two rectangular microcells being present where only one existed prior to displacement along the glide plane. In like manner, the serpentine microgroove formed by displacement along a glide plane running through the square microcells is replaced by a series of smaller rectangular microcells which are equal in length to the sides of the squares initially present, but smaller in width. The variants of the support 1000 that can be created by displacement along glide planes should be apparent by comparing supports 100 and 400 in light of the above description.

FIG. 11 illustrates a preferred support 1100 for use in the practice of this invention which is (1) capable of entirely separating three different compositions by intervening lateral walls, similarly as supports 800, 900, and 1000 (2) capable of providing equal microareas in each of three different sets, similarly as supports 900 and 1000, (3) capable of providing equal volumes in each of three separate microcell sets, similarly as support 1000, (4) capable of being uniquely addressed in each of three separate sets of microcells, a capability not shared by any of the supports previously discussed, and (5) capable of providing a more symmetrical distribution of three compositions than the support 1000.

The support 1100 can be resolved into a plurality of pixels 1118 each containing three identical microcells 1106 which are diamond-shaped in plan view. Each microcell within the pixel belongs to a separate set of microcells. A first set of the microcells is positioned so that the longest dimension of each microcell is aligned with or parallel to a first axis 1120. A second set of microcells is similarly positioned with respect to a second axis 1122, which intersects the first axis at a 60° angle. In like manner a third set of microcells is similarly positioned with respect to a third axis 1124, which intersects each of the first and second axes at an angle of 60°. If the support 1100 is viewed in section along any one of the first, second, or third axes it would appear similar to the sectioned support shown in FIG. 1B (ignoring wall structures outside of the section plane).

If the support 1100 is uniformly exposed at an acute angle with respect to its axial plane similarly as the support 100 in FIG. 1B or the support 500 in FIG. 5B in a direction indicated by the arrow 1126, which is parallel to the first axis, the bottom wall of each microcell of the first set can be exposed to radiation in the microarea 1128 while the bottom walls of the second and third sets of microcells remain entirely shadowed. If a second exposure is given at the same acute angle, but in the opposite direction, as indicated by arrow 1130, the bottom walls of the first set of microcells are again exposed, this time in only the microareas 1132. Again the bottom walls of the second and third sets of microcells remain entirely shadowed.

It can thus be seen that two uniquely addressed microareas can be formed by angled exposure of the bottom walls of the first set of microcells. After the first angled exposure, a first composition can, if desired, be introduced as a function of exposure so that it is selectively positioned in only the microareas 1128. After the second exposure a second composition can be similarly selectively positioned in only the microareas 1132. Alternatively, both the first and second exposures can occur before any composition is introduced, and a single composition can then be introduced so that it is selectively positioned in the microareas 1128 and 1132 only.

By analogy it is apparent that if the procedure described above is twice repeated, the second and third sets of microcells can be similarly uniquely addressed and up to four additional compositions placed in uniquely addressed interlaid sets of microareas. Uniform exposure in the direction indicated by arrow 1134, but otherwise identical to the first uniform exposure uniquely addresses microareas 1136 while leaving the remainder of the bottom walls in shadow. A reversed exposure in the direction indicated by arrow 1138 uniquely addresses microareas 1140 while leaving the remainder of the bottom walls in shadow. Uniform exposure in the direction indicated by arrow 1142 uniquely addresses microareas 1144 while a reversed exposure in the direction indicated by arrow 1146 uniquely addresses microareas 1148. Thus, six separate uniquely addressed microareas cnn be produced and six separate compositions can be introduced, each selectively positioned in a separate microarea. It is generally preferred to position three compositions in the microcells so that a different composition lies in each set of microareas.

In looking at the support 1110, it is apparent that it is merely representative of a family of possible supports having generally similar capabilities. For example, any one of the axes 1120, 1122, and 1124 shown in the drawings is merely one axis arbitrarily selected for purposes of illustration from among a family of identical parallel axes. Further, each family of axes constitutes a family of glide planes. By relatively displacing portions of the support in the axial plane of the support along one or up to the entire family of glide planes, essentially functionally identical supports can be created which have differently shaped microcells, microgrooves, and/or microareas. To avoid converting microcells into serpentine microgrooves by lateral displacement additional lateral walls can be located along the glide planes.

To illustrate the effect of displacement along glide planes, in FIG. 12 a support 1200 is shown differing from the support 1100 by lateral displacement of adjustment portions of the support along glide planes 1220A and 1220B. This displacement converts one set of microcells having major axes in the glide plane 1220A into serpentine microgrooves which cross and recross this glide plane. Along the glide plane 1220B an additional lateral wall 1208 is provided so that the one set of microcells having major axes in the glide plane are converted by displacement and the lateral walls to triangular microcells of approximately half the area, but twice the number, of the corresponding diamond-shaped microcells in support 1100. The additional lateral walls 1208 can be present along both glide planes 1220A and 1220B or omitted entirely. The first and second sets of microcells are identical to those of support 1100. The shadowing utility of the support 1200 is identical to that of the support 1100. Since the microcells of the first, second, and third sets are identical and form a symmetrical pattern in support 1100, it is apparent that identical patterns result from displacement along glide planes aligned with the major axis of any one of the three sets of microcells. In terms of capabilities and use the support 1200 is substantially the same as support 1100.

Referring again to support 1100, three axes 1152, 1154, and 1156 are present extending through or parallel to the minor axes of the three sets of microcells. These three axes intersect at 60° angles. Using any one of these axes as a glide plane and displacing the portions of the support lying on either side of the glide plane in the axial plane of the support, one set of microcells can be converted from diamond-shaped microcells to triangular microcells of approximately half the area, but twice the number. When this type of glide plane variation is undertaken, the result is a support that possesses the capabilities of support 1100, except the capability of uniquely addressing the triangular set of microareas produced by lateral displacement. The triangular microcells can still be addressed similarly as the square microcells in the support 1000, however.

In FIG. 13 an additional preferred support 1300 for use in the practice of this invention is illustrated. The support is provided with first and second sets of diamond-shaped microcells 1306A and 1306B. The microcells of each of the first and second sets have major axes lying along parallel axes, while the axes of one set intersect those of the other set at a 60° angle. A third set of microcells 1306C is rectangular in shape. The major axes of the rectangular microcells are substantially parallel to each other and intersect the axes of the first and second microcells at 60° angles. Thus, in terms of microcell content the support 1300 differs from the support 1100 in substituting for one set of diamond-shaped microcells a set of rectangular microcells. The first and second sets of microcells can be uniquely addressed in microareas 1326, 1332, 1336, and 1340, which are identical to corresponding microareas in support 1100. The rectangular microcells can be uniquely addressed in microareas 1344 and 1348, which differ in shape from the corresponding uniquely addressed microareas in the support 1100. In terms of relative placement of microcells, it can be seen that the microcells of each set form a separate column in the support 1300. Adjoining columns are shown separated by glide planes 1320A, 1320B, and 1320C. It is apparent that any column can be laterally displaced in the axial plane of the support without in any way affecting the remaining columns in their function. For certain applications, such as linear scanning, the columnar arrangement of the microcells in support 1300 is particularly advantageous. Although the microcell pattern of support 1300 is less symmetrical than that of support 1100, it otherwise offers all the capabilities of the support 1100.

Each of the supports 1100, 1200, and 1300 contain microareas within each microcell, shown as shadowed areas, which cannot be uniquely addressed. These areas are shadowed when the remaining bottom wall areas of each set of microareas is addressed with radiation at an acute angle with respect to the axial plane of the support. In some applications the shadowed areas can be left free of any composition. That is, one or two compositions can be introduced into a microcell in only the uniquely exposed microareas thereof without taking any further steps to introduce an additional composition in the remaining microareas. If the compositions introduced in uniquely addressed microareas are not capable of lateral spreading, the shadowed bottom wall portions remaining will have no composition associated therewith. Where compositions capable of lateral spreading are introduced into the uniquely addressed microareas, they can spread over the entire bottom wall of each microcell in which they are contained. For example, if a mobile cyan, magenta, or yellow dye is positioned in one uniquely addressed microarea of a microcell and a different mobile subtractive primary dye is placed in the remaining uniquely addressed microarea in the same microcell, one of three different additive primary colors, depending on the combination of subtractive primaries chosen, can be produced as the mobile dyes wander over the entire bottom wall of the microcell.

Where compositions are introduced into the uniquely addressed microareas of the supports 1100, 1200, or 1300 and it is desired to place a composition also in the shadowed areas remaining, this can be undertaken using techniques similar to those described above. For example, if the bottom walls of the support are transparent and colorants are placed in the uniquely addressed areas, it may be undesirable to have transparent microareas as well as colored microareas. It is possible to selectively position an additional, high density or opaque composition in all of the shadowed microareas remaining to eliminate transparent microareas in the support. Since the lateral walls are capable of interrupting radiation, radiation cannot penetrate these areas of the support. Where a technique is employed for positioning the additional composition that requires the initially shadowed microareas to be exposed to radiation, the support can be exposed in a direction substantially perpendicular to its axial plane and the exclusion properties of the previously positioned materials employed can be relied upon to position selectively the additional composition in the initially shadowed microareas. Where a technique is employed for positioning the additional composition in initially shadowed areas that allows a material to be selectively positioned in unexposed areas, the additional composition can be selectively positioned without relying upon any exclusion capability by any composition previously positioned and without exposing the initially shadowed areas to radiation.

In various embodiments described above it is suggested to expose the support substantially perpendicularly ot its axial plane where shadowing is not desired. In some instances this can be disadvantageous, since the radiation source is fixed at a particular acute angle for shadowing exposures and it may be inconvenient to provide a second radiation source or relocate the radiation source used for shadowing. An alternative is possible when the lateral walls are capable of interrupting radiation, but are not entirely opaque. For example, if transparent lateral walls are dyed to the extent necessary to provide shadowing, they may still be penetrable by radiation of increased intensity. In such instances it is contemplated to give the support a first uniform exposure at an acute angle, choosing a level of radiation intensity which permits the lateral walls to interrupt the radiation and provide shadowing as required. Thereafter, when exposure of the shadowed areas is required, the same radiation source at the same acute angle can be increased in intensity and used to reexpose the support. This time sufficient radiation penetrates the lateral walls to allow exposure of the initially shadowed areas. Instead of altering the intensity of radiation between exposures, a change in the wavelength or even type of radiation can be relied upon to allow shadowing in one instance, but not another. Transparent lateral walls containing an ultraviolet absorber can interrupt ultraviolet radiation while permitting penetration of visible light. Similarly lateral walls which are dyed to appear visibly opaque may nevertheless absorb little ultraviolet radiation.

In the preferred embodiments of the invention, described in connection with supports 800, 900, 1000, 1100, 1200, and 1300, one set of microareas can be entirely separated from all other sets of microareas by lateral walls. However, because of shadowing by the lateral walls, the entire bottom wall surface between these boundary forming lateral walls cannot be entirely exposed at one time. In some geometrical forms of the support, such as support 1000, the entire bottom wall surface between boundary forming lateral walls (e.g., the entire bottom wall of a microcell) can be addressed by a combination of two exposures if the support is rotated 180° or the second radiation source is changed in direction. In some instances, however, this still leaves bottom wall surfaces shadowed that are not intended to be differentiated from exposed microareas within the same lateral wall boundary. For example, the shadowed areas shown in the supports 1100, 1200, and 1300 can represent a significant inconvenience and limitation where it is desired to locate three compositions, each in a different set of microcells, so that each composition entirely covers the bottom walls of its microcell set.

In those instances where it is desired for an entire bottom wall surface bounded by lateral walls, such as the entire bottom wall surface of a microcell, to form a single microarea, but exposure at an acute angle casts a shadow over at least a portion of the microarea, it is specifically contemplated to modify the support to either spread the radiation itself or to spread whatever modifying effect the radiation produces over the entire microarea. The specific approach for accomplishing this objective can be varied, depending upon the specific application the support is intended to serve.

In another form, a removable cover, preferably hearing a semitransparent reflective coating, can be laid over the first major surface of the support to aid in reflecting, if desired. Exposure must, of course, occur through the cover. The lateral walls can be relied upon to prevent radiation from scattering beyond the intended boundary of the microarea.

Where the support or at least the bottom wall portion of the support is a photoconductor, as described by Blazey et al, cited above, a conductive layer which is at least partially transparent can be placed selectively on the bottom wall surfaces. Without the conductive layer present only the bottom wall portions actually exposed to radiation are increased in conductivity, but with the conductive layer present, if any portion of a lateral wall bounded bottom wall is struck by radiation to which the photoconductor is responsive, the effect in terms of static charge retention is as though the entire bottom wall had been radiation struck.

Another approach applicable to supports generally (i.e., not limited to reflective or photoconductive supports, but also fully applicable to transparent and insulative or conductive supports) is to locate a fluor on the bottom wall surfaces. Exposure in one microarea stimulates emission of radiation by the fluor and causes the entire bottom wall portion in the bounded area to be exposed to either direct or stimulated radiation. Again, the lateral walls can be relied upon to prevent radiation scattering beyond the intended boundary of the microarea.

In a very simple form of the invention the bottom walls of the supports can themselves be relied upon to distribute radiation over a bottom wall surface. It is generally recognized that even a polished transparent support will reflect some radiation. For applications requiring very little radiation, the inherent light scattering property of unmodified bottom walls can be sufficient to distribute a useful amount of radiation over the entire bottom wall surface. Scattering of radiation by the bottom walls can be significantly increased by roughening the bottom walls of the support.

The supports of this invention can be applied to any application requiring two or more compositions to be laterally related in a highly interdigitated manner. The supports are generally useful for the same purposes as those of Whitmore and Blazey et al, cited above, here incorporated by reference and, except for the unique features specifically described above, can be formed in the same manner using the same or similar materials. For purposes of disclosing specified preferred embodiments of an exemplary nature, the invention is hereinafter described in terms of employing the supports described above to form elements useful in multicolor photography.

A specific preferred photographic application of the invention can be illustrated by reference to FIG. 14A, wherein a multicolor image transfer photographic element 1400 is shown. The photographic element as shown employs support 1100 as it would appear if sectioned along the major axis of microcells forming each of the three sets—i.e., along section line 14A—14A as shown in FIG. 14B. The lateral walls 1108 of the support are capable of interrupting radiation, but the underlying portion 1110 which connects the lateral walls is substantially transparent. The first set of microcells R contain red colorant and a cyan dye precursor. The second set of microcells G similarly contain green colorant and a magenta dye precursor. The third set of microcells B contain blue colorant and a yellow dye precursor. The dye precursors can each be shifted between a mobile and an immobile form either in their dye or dye precursor forms. A panchromatically sensitized silver halide emulsion layer 1402 overlies the first major surface 1102 of the support. The support 1100, the contents of the microcells, and the silver halide emulsion layer together form an image generating portion of the photographic element.

An image-receiving portion of the photographic element is comprised of a transparent support (or cover sheet) 1450 on which is coated a conventional dye immobilizing layer 1452. A reflection and spacing layer 1454, which is preferably white, is coated over the immobilizing layer. A silver reception layer 1456, which contains a silver precipitating agent, overlies the reflection and spacing layer.

In a preferred, integral construction of the photographic element the image-generating and image-receiving portions are joined along their edges and lie in face-to-face relationship. After imagewise exposure a processing solution is released from a rupturable pod, not shown, integrally joined to the image-generating and receiving portions along one edge thereof. A space 1458 is indicated between the image-generating and receiving portions to indicate the location of the processing solution when present after exposure. The processing solution contains a silver halide solvent. A silver halide developing agent is contained in either the processing solution or in a position contacted by the processing solution upon its release from the rupturable pod. The developing agent or agents can be incorporated in the silver halid emulsion.

The photographic element 1400 is preferably a positive-working image transfer system and is described by reference to such a system. In such a system the silver halide emulsion is preferably negative-working and the dye precursors are positive-working, although a direct-positive emulsion and negative-working dye precursors also produce a positive-working image transfer system.

The photographic element 1400 is imagewise exposed through the transparent underlying portion of support 1100. The red, green, and blue colorants act as filters allowing the silver halide emulsion layer to be exposed selectively to red, green, and blue light in microareas corresponding to the like colored filters.

Upon release of processing solution between the image-forming and receiving portions of the element, development of the exposed silver halide is initiated. Silver halide development results in one exemplary form in a selective immobilization of the initially mobile dye precursor present in the adjacent microcells. In a preferred form the dye precursor is both immobilized and converted to a subtractive primary dye of a hue complementary to the filter. The residual mobile imaging dye precursor, either in the form of a dye or a precursor, migrates through the silver reception layer 1456 and the reflection and spacing layer 1454 to the dye immobilizing layer 1452. In passing through the silver reception and spacing layers the mobile subtractive primary dyes or precursors are free to and do spread laterally. Referring to FIG. 14B, it can be seen that each microcell containing a selected subtractive primary dye precursor is substantially surrounded by microcells containing precursors of the remaining two subtractive primary dyes. It can thus be seen that lateral spreading results in overlapping transferred dye areas in the dye immobilizing layer of the receiver when mobile dye or precursor is being transferred from adjacent microcells. Where three subtractive primary dyes overlap in the receiver, black image areas are formed, and where no dye is present, white areas are viewed due to the reflection from the spacing layer. Where two of the subtractive primary dyes overlap at the receiver an additive primart image area is produced. Thus, it can be seen that a positive multicolor dye image can be formed which can be viewed through the transparent support 1450. The positive multicolor transferred dye image so viewed is right-reading.

In the multicolor photographic element 1400 the risk of undesirable interimage effects attributable to wandering oxidized developing agent is substantially reduced, as compared to conventional multicolor photographic elements having superimposed color-forming layer units since the lateral walls of the support element prevent direct lateral migration between adjacent mircrocells. Nevertheless, the oxidized developing agent in some systems can be mobile and can migrate with the mobile dye or dye precursor toward the receiver and migrate back to an adjacent microcell. To minimize unwanted dye or dye precursor immobilization prior to its transfer to the immobilizing layer of the receiver it is preferred to incorporate in the silver reception layer 1456 a conventional oxidized developing agent scavenger.

Since the processing solution contains silver halide solvent, the residual silver halide not developed in the microcells is solubilized and allowed to diffuse to the adjacent silver reception layer. The dissolved silver is physically developed in the silver reception layer. Solubilization and transfer of the silver halide from the microcells operates to limit direct or chemical development of silver halide occuring therein. It is well recognized by those skilled in the art that extended contact between silver halide and a developing agent under development conditions (e.g., at an alkaline pH) can result in an increase in fog levels. By solubilizing and transferring the silver halide a mechanism is provided for terminating silver halide development in the microcells. In this way production of oxidized developing agent is terminated and immobilization of dye in the microcells is also terminated. Thus, a very simple mechanism is provided for terminating silver halide development and dye immobilization.

In addition to obtaining a viewable transferred multicolor positive dye image a useful negative multicolor dye image is obtained. In microcells where silver halide development has occurred, an immobilized subtractive primary dye is present. This immobilized imaging dye together with the additive primary filter offers a substantial absorption throughout the visible spectrum, thereby providing a high neutral density to these microcells. For examp'e, where an immobilized cyan dye is formed in a microcell also containing a red filter, it is apparent that the cyan dye absorbs red light while the red filter absorbs in the blue and the green regions of the spectrum. The developed silver present in the microcell also increases the neutral density. In microcells in which silver halide development has not occurred, the mobile dye precursor, either before or after conversion to a dye, has migrated to the receiver. The sole color present then is that provided by the filter. It is a distinct advantage in reducing minimum density to employ the silver reception layer 1456 to terminate silver halide development as described above rather than to relay on other development termination alternatives. If the image-generating portion of the photographic element 1400 is separated from the image-receiving portion, it is apparent that the image-generating portion forms in itself an additive primary multicolor negative of the exposure image. The additive primary negative image can be used for either transmission or reflection printing to form right-reading multicolor positive images, such as enlargements, prints, and transparencies, by conventional photographic techniques.

The foregoing description of photographic element 1400 illustrates the use of initially mobile subtractive primary dye precursors in addition to additive primary filter materials in interlaid sets of microcells. In alternative multicolor image transfer photographic elements the microcells can contain the silver halide precipitating agent. The subtractive primary dye precursors can either be initially mobile or immobile. Further, either mobile or immobile subtractive primary dyes capable of undergoing imagewise alterations in mobility can be substituted for the dye precursors. In this instance it is preferred to locate both silver halide and the subtractive primary dyes in the microcells so that exposing radiation strikes the silver halide before the dye, thereby avoiding competing absorption and any resulting decrease in speed. In still another variant form preformed image dyes can be shifted in hue so that they do not compete with silver halide in absorbing light to which silver halide is intended to respond. The dyes can shift back to their desired image hue upon contact with processing solution. If no additive multicolor retained image is desired, the additive primary filter materials can be omitted from the microcells in those instances where the silver halide is present in each set of microcells and in each set of microcells is responsive to only one of the blue, green, and red portions of the spectrum. A variety of techniques are known in the art for avoiding response by green and red sensitized silver halide emulsions to blue light, such as the use of silver chlorides and chlorobromides and the use of yellow filter materials. These techniques are described in more detail by Whitmore, cited above, and here incorporated by reference. When silver halide is located in the microcells, the oxidized developing agent scavenger is preferably coated over the microcells or can be located in the microcells above the silver halide. If no transferred multicolor dye image is desired, the layer 1456 can be substituted for the layer 1452 so that a transferred silver image can be viewed and all subtractive primary dyes or dye precursors can be omitted. Of course, if no transferred dye or silver image is desired, the entire image receiving portion of the photographic element as well as the subtractive primary dye or dye precursor can be omitted.

It is therefore apparent that a wide variety of different materials can be employed to form interlaid sets of microcells useful in even a specific application, such as multicolor photography. While the photographic element 1400 employs support 1100, any of the supports described above can be substituted without altering the overall performance of the photographic element, although some supports offer more advantages than others, as has already been discussed. Specific illustrations, of preferred multicolor image transfer systems are discussed by Whitmore, Gilmour, and Blazey et al, cited above, and here incorporated by reference.

If no transferred dye image is desired and the subtractive primary dyes or dye precursors are omitted from the photographic element 1400, it is apparent that only immobile primary colorants need remain in the microcells. However, as has been noted above in connection with previously described supports, the lateral walls can be dyed to provide one additive primary filter. It is therefore apparent that where the microcells contain only additive primary colorants, such as red, green, and blue, the function of one set of microcells can be performed merely by dyeing the lateral walls to provide the corresponding additive primary color. Thus, one set of microcells can be omitted from the support 1100 without affecting its performance. Since the microcell sets of support 1100 are identical, except for the additive primary contained therein, it is immaterial which set is omitted. It is apparent that for a similar application any set of microcells can be omitted from the supports 900, 1000, or 1300. Similarly in support 1200, either a diamond-shaped set of microcells can be removed or the microgrooves and/or microcells formed by lateral displacement along the glide planes can be removed. In support 1000 a distinct advantage is realized in some applications requiring unique exposures of the microcells, since the square microcells which cannot be uniquely exposed can be omitted, leaving only two rectangular sets of microcells, both of which can be uniquely addressed.

In one specific, illustrative form the photographic element 1400 can contain (1) in a first set of microcells a blue filter dye or pigment and an initially colorless, mobile yellow dye-forming coupler, (2) in a second, interlaid set of microcells a green filter dye or pigment and an initially colorless, mobile magenta dye-forming coupler and (3) in a third, interlaid set of microcells a red filter dye or pigment and an initially colorless, mobile cyan dye-forming coupler. A panchromatically sensitized negative-working silver halide emulsion layer 1402 is coated over the microcells. The layer 1456 contains a silver precipitating agent and an oxidized developing agent scavenger. The reflection and spacing layer 1454 can be a conventional titanium oxide pigment containing layer. The dye immobilizing layer 1452 contains an oxidizing agent.

The photographic element 1400 so constituted is first exposed imagewise through the transparent underlying portion of support 1100. Thereafter a processing composition containing a color developing agent and a silver halide solvent is released and uniformly spread in the space 1458. In exposed areas silver halide is developed producing oxidized color developing agent which couples with the dye forming coupler present to form an immobile dye. The filter dye or pigment, the immobile dye formed, and the developed silver thus together increase the optical density of the microcells which are exposed.

In areas not exposed, the undeveloped silver halide is solubilized by the silver halide solvent and migrates to the layer 1456 where it is reduced to silver. Any oxidized developing agent produced in reducing the silver halide to silver immediately cross-oxidizes with the oxidized developing agent scavenger which is present with the silver precipitating agent in the layer 1456.

At the sme time mobile coupler is wandering from microcells which were not exposed. The mobile coupler does not react with oxidized color developing agent in the layer 1456, since any oxidized color developing agent present preferentially reacts with the oxidized developing agent scavenger. The coupler thus migrates through layer 1456 unaffected and enters reflection and spreading layer 1454. Because of the thickness of this layer, the mobile coupler is free to wander laterally to some extent. Upon reaching the immobilizing layer 1452, the coupler reacts with oxidized color developing agent. The oxidized color developing agent is produced uniformly in this layer by interaction of oxidizing agent with the color developing agent. Due to lateral diffusion in the spreading layer, superimposed immobile yellow, magenta and cyan dye images are formed in the immobilizing layer and can be viewed as a multicolor image through the transparent support (or cover sheet) 1450 with the layer 1454 providing a white reflective background. At the same time, since only filter dye or pigment remains in the unexposed microcells, a useable additive primary negative transparency is formed by the support 1100.

To illustrate a variant system, a photographic element as described immediately above can be modified by substituting for the initially colorless, mobile dye forming couplers initially mobile dye developers. The dye developers are shifted in hue, so that the dye developer present in the microcells containing red, green, and blue filters do not initially adsorb light in the red, green, and blue regions of the spectrum, respectively. A dye mordant as well as an oxidant can be present in the dye immobilizing layer 1452. Since the dye image forming material is itself a silver halide developing agent, a conventional activator solution can be employed (preferably containing an electron transfer agent). The remaining features can be identical to those described in the preceding embodiment.

Upon imagewise exposure and release of the activator solution, dye developer reacts with exposed silver halide to form an immobile subtractive primary dye which is a complement of the additive primary filter material in the exposed microcell. Thus the optical density of exposed microcells is increased, and a negative multicolor additive primary image can be formed in the support 1100 by the filter materials. Silver halide development is terminated by transfer of solubilized silver halide as has already been described. In unexposed areas unoxidized dye developer migrates to the immobilizing layer 1452 where it is oxidized and mordanted to form a multicolor positive image. During processing the dye developers shift in hue so that they form subtractive primaries complementary in hue to the additive primary filter materials with which they are initially associated in the microcells. That is, the red, green and blue filter material containing microcells contain dye developers which ultimately form cyan, magenta and yellow image dyes. Hue shifts can be brought about by the higher pH of processing, mordanting, or by associating the image dye in the receiver with a chelating material.

Instead of using shifted dye developers as described above, initially mobile leuco dyes can be employed in combination with electron transfer agents to produce essentially similar results. Since the leuco dyes are initially colorless, hue shifting does not have to be undertaken to avoid competing light absorption during imagewise exposure.

Instead of employing initially mobile dyes or dye precursors as described above, it is possible to employ initially immobile materials. In one specific preferred form benzisoxazolone precursors of hydroxylamine dye-releasing compounds are employed. Upon cross-oxidation in the microcells with oxidized electron transfer agent produced by development of exposed silver halide, release of mobile dye is prevented. In areas in which silver halide is not exposed and no oxidized electron transfer agent is produced mobile dye release occurs. The dye image providing compounds are preferably initially shifted in hue to avoid competing absorption during imagewise exposure. Mordant immobilizes the dyes in the layer 1452. No oxidant is required in this layer in this embodiment. Except as indicated, this element and its function is similar to the illustrative embodiments described above.

Each of the illustrative embodiments described above employ positive-working dye image providing compounds. To illustrate a specific embodiment employing negative-working dye image providing compounds, a first set of microcells 1408 can contain a blue filter dye or pigment, a silver ion complex precipitating agent, and a redox dye-releaser containing a yellow dye which is shifted in hue to avoid adsorption prior to processing in the blue region of the spectrum. In like manner a second, interlaid set of microcells contain a green filter dye or pigment, the silver precipitating agent and a redox dye-releaser containing analogously shifted magenta dye,and a third, interlaid set of microcells containing a red filter dye or pigment, the silver precipitating agent, and a redox dye-releaser containing an analogously shifted cyan dye. The microcells are overcoated with negative-working panchromatically sensitized silver halide emulsion layer also containing an oxidized developing agent scavenger. The silver precipitating layer 1456 shown in FIG. 14 is not present. The reflection and spreading layer is a white titanium oxide pigment layer. The dye immobilizing layer 1452 contains a mordant.

The photographic element is imagewise exposed through the transparent support 1100. A processing solution containing an electron transfer agent and a silver halide solvent is spread between the image-generating and the image-receiving portions of the element. In a preferred form the pH of the processing solution causes the redox dye-releasers to shift to their desired image-forming hues. In areas in which silver halide is exposed oxidized electron transfer agent produced by development of exposed silver halide immediately cross-oxidizes with the oxidized developing agent scavenger. Thus, in microcells corresponding to exposed silver halide the redox dye-releasers remain unaltered in their initially immobile, shifted form. In areas in which silver halide is not exposed, silver halide solvent present in the processing solution solubilizes silver halide allowing it to form soluble silver ion complex (e.g., $AgSO_3^-$) capable of wandering into the underlying microcells. In the microcells physical development of solubilized silver halide occurs producing silver and oxidized electron transfer agent. The oxidized electron transfer agent interacts with the redox dye-releaser to release mobile dye which is transferred to the layer 1452, shifted in hue, and immobilized by the mordant. A multicolor positive transferred image is produced in the layer 1452 comprised of yellow, magenta, and cyan transferred dyes. A multicolor positive retained image is also produced, since (1) the silver density produced by chemical development in the emulsion layer is small compared to the silver density produced by physical development in the microcells and (2) with the image-generating portion separated from the image-receiving portion the redox dye-releasers remaining in their initial, immobile condition in the microcells can be uniformly reacted with an oxidizing agent to release mobile dye which can be removed from the microcells by washing.

To illustrate a simple technique for providing two or three sets of microareas each having a different colorant associated therewith, any one of the supports described above which provide two or more microareas that can be uniquely addressed can be initially coated first with a colorant immobilizing material, such as a mordant or oxidant, so that a thin layer that can be shadowed by the lateral walls is formed over the entire bottom wall of the support. Next the immobilizing layer is overcoated with a positive-working photoresist—that is, a photoresist which is selectively removable on development in exposed areas. Again, the photoresist is coated in a thin layer so that the lateral walls rise above the upper surface of the photoresist layer and are therefore capable of shadowing this layer. The photoresist layer is then selectively exposed to radiation to which it is responsive in a first set of microareas by shadowing techniques described above. Upon development the photoresist is selectively removed from the support in just these areas. By bringing the support into contact with a dye containing solution, dye can be imbibed into the immobilizing layer selectively in only those areas initially exposed. This selectively places immobilized dye in the first set of microareas. By repeating the procedure using shadowing techniques already described above two, three, or more interlaid displaced sets of uniquely addressed microareas can be produced capable of acting as filters in additive multicolor photographic applications. Either additive primary (i.e., red, green, and blue) dyes or combinations of subtractive primary (i.e., cyan, magenta, and yellow) dyes which give an additive primary color can be employed to form the filter colorants. Before each repetition it is preferred to uniformly expose all bottom wall areas of the support and to remove photoresist entirely by development. This avoids build up of overlaid photoresist layers.

By substituting a negative-working photoresist for the positive-working photoresist, dye can be selectively introduced into shadowed microareas instead of exposed microareas. This is fully satisfactory where two colorants are being positioned, but this procedure is not generally applicable to the supports described where three sets of colorants are being positioned in three separate sets of microareas.

An alternative approach for employing negative-working photoresists is to coat a mobile colorant initially on the support in place of the immobilizing layer described above and then to overcoat the negative-working photoresist layer in place of the positive-working photoresist layer described above. The negative-working photoresist upon exposure in a first set of microareas is rendered immobile on development, so that subsequent development removes photoresist in unexposed areas. Mobile colorant is removed on development in only those areas where the photoresist is also removed, leaving colorant in a first set of microareas initially exposed. By repeating the procedure described above using previously described exposure techniques, two, three, or more sets of colorants can be positioned in interlaid sets of microareas. The procedure is generally applicable to the supports described which provide two or more sets of microareas that can be uniquely addressed. Photoresists are preferably employed as described above to form microareas that are substantially coextensive with microcells or microgrooves.

Instead of using photoresists to form multicolor filter elements useful in additive multicolor photography, other radiation-sensitive materials can be employed which are capable of producing additive primary filter microareas as a function of selective exposure and shadowing. To illustrate a simple approach, the supports 1100, 1200, or 1300 can be coated with vacuum vapor deposited silver halide on the bottom and lateral walls of the microcells. The advantage of using vacuum vapor deposited silver halide is that a layer of radiation-sensitive materal can be substantially uniformly deposited on the walls of the microcells which is quite thin in comparison to the lateral walls of the microcells. If desired, a silver halide emulsion layer which is sufficiently thin in relation to the lateral walls to permit shadowing can be substituted for vacuum vapor deposited silver halide.

In use, a first shadowing exposure renders the silver halide developable on the exposed lateral walls and in the bottom walls of the one set of microcells exposed.

Development with a color developer containing a mobile dye former, such as one or more dye-forming couplers, produces a colorant selectively on the bottom walls of the first set of microcells and on the exposed lateral walls. Colorant produced on the lateral walls can be useful in enhancing their radiation interrupting capability during subsequent exposures. A dye-forming coupler can be chosen that produces an additive primary dye on reaction with oxidized color developing agent, or two dye-forming couplers can be employed each of which produce a different subtractive primary dye on reaction with oxidized color developing agent, so that their combined effect is to produce an additive primary filter colorant. By going through the shadowing exposure procedure already described above using different dye-forming couplers, two, three, or more sets of laterally displaced filter segments can be produced. Bleaching and/or fixing can be employed to reduce neutral densities attributable to silver.

It is important to note that in exposing a first set of microareas containing silver halide and processing as described all of the silver halide in these microareas can be developed. Thus, in subsequent processing it is immaterial whether these microareas are again addressed by radiation. For example, in exposing a second time both the first and second set of microareas can be addressed, but a second development produces dye in only the second set of microareas where the silver halide in the first set of microareas has already been exhausted in the first development step. Thus, the use of silver halide lends itself to forming microareas of differing colors where the configuration of the support does not lend itself to uniquely addressing each microarea. This capability of excluding a second or subsequent material based on depletion of an active component in a microarea is hereinafter referred to as an exhaustion effect.

In one form of the invention it is preferred to form multicolor filter elements so that filter colorant overlies the entire bottom wall of each microgroove or microcell. In some support forms, such as support 1000, this can be achieved without the provision of additional steps or materials. In other configurations some bottom wall areas receive no exposure and no colorant, unless this result is specifically sought. For example, in the embodiment shown in FIGS. 14A and 14B bottom wall areas which cannot be uniquely addressed are not differentiated from the bottom wall areas which can be uniquely addressed, although the techniques described above for forming three color filters with photoresists and silver halide require some further elaboration to achieve this result. By employing scattering and/or fluorescence, as described above, in combination with shadowing exposure, the entire bottom wall area of each microgroove or microcell is exposed so that filter colorant is uniformly distributed over the bottom wall.

In some applications bottom wall areas which are not uniquely addressed can remain transparent. Where the filter colorant is not distributed over the entire bottom wall area of each microgroove or microcell, it is generally preferred that the microareas which cannot be uniquely addressed be rendered substantially opaque.

Using silver halide as described above, opacification can be accomplished in an illustrative form by exposing the support perpendicularly to its axial plane after the desired colorants have been formed in the microgrooves or microcells of each set. In a final color development step a mixture of three different subtractive primary or two different additive primary dye-forming couplers can be employed to produce a substantially black colorant in the microareas not uniquely addressed. Silver produced in the final development step can also increase neutral density in these areas. It is therefore preferred to bleach silver from uniquely exposed areas providing additive primary filter microareas before the final development step and to avoid bleaching after the final development step.

Using a positive-working photoresist layer overlying a dye immobilizing layer as described above, opacification can be accomplished by giving the support a non-shadowing (perpendicular to the axial plane) exposure after the uniquely addressed colorant containing filter microareas are formed. Development removes any remaining positive photoresist. The positive-working photoresist is replaced by a negative-working photoresist layer. Prior shadowing exposures are repeated, but without the introduction of any colorants. Development leaves negative-working photoresist overlying and protecting only the microareas uniquely addressed, the microareas not uniquely addressed being open. One or a combination of dyes can then be imbibed into the immobilizing layer in the microareas not uniquely addressed, thereby opacifying the bottom walls of the support in microareas not occupied by the filters.

A preferred technique for positioning compositions as a function of exposure useful with every support configuration and shadowing exposure sequence heretofore described employs a support at least the bottom walls of which are photoconductive. This technique can employ any of the supports disclosed by Blazey et al, cited above, and here incorporated by reference, and is described herein by reference to an illustrative embodiment in which support 600 is provided with red, green, and blue colorants in microareas 1, 2, and 3 of each microcell 602, as shown in FIG. 6B. Additional features of the support and the procedure for positioning colorants can be better appreciated by reference to FIGS. 15A through 15D. A regular hexagonal array of microcells 602 are formed in a photoconductive portion 604 of the support 600 and open toward a first major surface 606. Adjacent microcells are separated by lateral walls 608 which are dyed to increase their ability to interrupt radiation. A substantially transparent underlying portion 610 connects the lateral walls and forms bottom walls 616 of the microcells.

In addition to the photoconductive portion, the support is formed by a thin, transparent conductive layer 612 and a transparent film base 614. Along at least one lateral edge of the support, not shown, the film base and the conductive layer can extend laterally beyond the photoconductive portion to facilitate attachment of an external conductor to the support. A charge control barrier layer, not shown, can be interposed between the conductive layer and the photoconductive portion. Depending on the choice of photoconductive and conductive materials employed, electrical biasing of one polarity can result in a charge injection from the conductive layer into the photoconductive layer rendering it conductive. The function of the charge control barrier layer is to intercept and trap injected charge—i.e., electrons or holes. Charge control barrier layers are well known in the art, as illustrated by Dessauer et al U.S. Pat. No. 2,901,348, Gramza et al U.S. Pat. No. 3,554,742, Humphriss et al U.S. Pat. No. 3,640,708, and Hodges German OLS No. 1,944,025, the disclosures of which are here incorporated by reference.

Although the support is shown to be comprised of the photoconductive portion, the conductive layer, and the film base, it is appreciated that it may be formed of only the photoconductive portion. For instance, once the microcells are filled to the extend desired, the conductive layer and/or film base can be stripped from the photoconductive portion, leaving it as a separate element. Alternatively, the photoconductive portion can form the entire support and be brought into contact, as required, with an electrode which forms no part of the support.

Figure 15A:
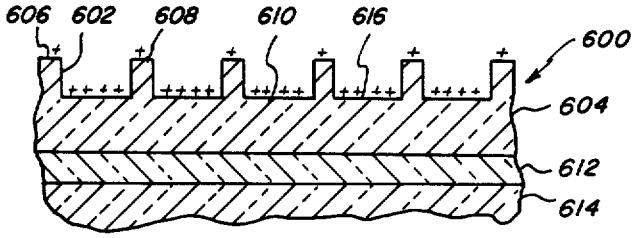

In FIG. 15A the support 600 is shown with the photoconductive portion 604 bearing on its outer surface a positive electrostatic charge, applied in a nonimagewise manner to provide a substantially uniform charge distribution. It is to be noted that the positive charge not only covers the bottom walls 616 of the microcells, but also covers the upper edges of the lateral walls 608. As is well understood by those skilled in the art, the electrostatic charge can be conveniently applied by passing the support through a corona discharge.

Figure 15B:
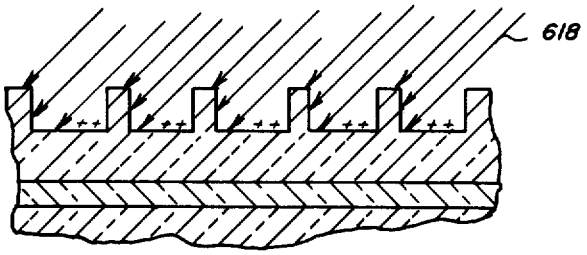

The next step of the process is to remove the electrostatic charge selectively from the bottom walls of the microcells in the first set of microareas 1 without disturbing the electrostatic charge in the other bottom wall microareas 2 and 3. This is accomplished as shown in FIG. 15B by exposing the support at an acute angle with respect to the bottom walls, as indicated by arrows 618. Radiation is employed for exposure to which the photoconductive portion is responsive. The radiation strikes only the first set of microareas at the bottom walls, the remaining microareas of the bottom walls being shadowed. The photoconductive portion of the support is thereby rendered conductive in the exposed first set of microareas. By grounding or negatively biasing the conductive layer 612, electrostatic charge can be conducted through the photoconductive portion in the first set of microareas leaving the first set of microareas substantially uncharged, as shown.

The shadowed exposure shown in FIG. 15B offers distinct advantages as compared to the exposure procedure disclosed by Blazey et al, cited above. Blazey et al in a preferred form employs a laser to address individual microcells sequentially. This involves careful alignment of the laser beam with the microcells. Since the support can be comprised of in the order of 1000 microcells per centimeter measured on the support surface, it is apparent that laser addressing individual microcells can be tedious and time consuming. Further, the laser addressing method of Blazey et al does not lend itself to addressing only a portion of the bottom wall of each microcell. Whereas Blazey et al might employ three different sets of masks to expose three interlaid sets of microcells, mask alignments are if anything more critical and tedious than laser alignments. The present invention offers the distinct advantage of allowing all of the first set of microareas to be addresed in a single exposure. Only a portion of the bottom walls of the microcells can be addressed, thereby adding a capability not shared by Blazey et al. Tedious alignments with individual microcells are entirely eliminated. Only the angle of exposure and the direction of alignment of the support, neither of which must be controlled precisely, provide the desired shadow pattern in the microcells.

Figure 15C:
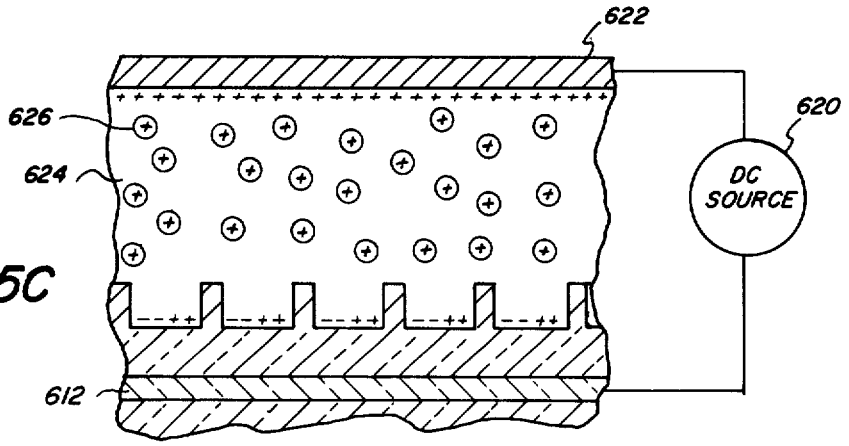
Figure 15D:
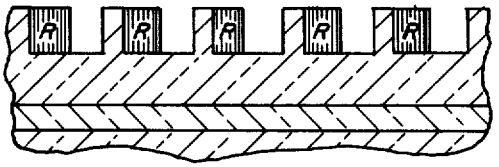

To introduce a first imaging composition selectively into the first set of microcells, a development procedure can be employed as illustrated in FIG. 15C. A direct current source 620 is connected between a development electrode 622 and the conductive layer 612 of the support so that the development electrode is positively biased with respect to the conductive layer 612. An electrographic developer containing a carrier liquid 624 and dispersed positively charged particles 626 of an electrographic imaging composition is interposed between the development electrode and the support 600 so that it can enter the microcells. The positive bias on the development electrode can be viewed as inducing a negative electrostatic charge on the bottom walls of the first set of microareas. (See Schaffert, *Electrophotography*, John Wiley and Sons, New York, p. 51.) The positively charged dispersed particles of electrographic imaging composition are therefore selectively attracted into the first set of microareas while being concurrently repelled from the remaining microareas 2 and 3, which contain a positive electrostatic charge. In FIG. 15D a first set of microareas of the support 600 are shown covered with a red electrographic imaging composition R.

To complete the preparation of an element containing green, red, and blue imaging compositions in first, second, and third interlaid sets of microareas the procedure described above can be twice repeated, except that the support is rotated 120° before each of the second and third exposures and a different additive primary electrographic imaging composition is employed in each instance. Although it is preferred to associate red, green, and blue compositions with the first, second, and third sets of microareas using the electrographic technique described above, it is appreciated that the second and third compositions can be positioned using any of the alternative techniques previously described.

It is to be appreciated that the description of the process of this invention by reference to FIGS. 15A through 15D is merely illustrative of certain preferred embodiments. Numerous variations will readily occur to those skilled in the art of electrophotography, once the invention is appreciated. For example, the polarity of charge on the photoconductive portions, electrographic imaging composition particles, and development electrode can be reversed without the exercise of invention. The use of a development electrode is not required. Reversal development through field fringing is known to be obtainable for small areas, such as line copy. Further, it is possible to choose the polarity of the electrographic imaging composition particles so that it is opposite that of the electrostatic charge on the photoconductive portion and therefore attracted to the remaining charged microareas not exposed rather than the microareas which are exposed. In such an alternative, particles are attracted to shadowed rather than exposed microareas. Any conventional electrographic imaging composition particle size less than the dimensions of the individual microareas can be employed. It is preferred to employ particle sizes of less than about 25 percent of the size of the microareas. Although electrographic developers containing liquid carrier vehicles are preferred, since smaller particle sizes compatible with the widths of the microcells are more readily employed, any conventional electrographic development technique, such as the use of aerosols and dry toners, can be employed. Liquid electrographic developers are particularly preferred which require no separate fusing step to hold the electrographic imaging composition particles in place in the microcells. A separate fusing step can be employed where all of the components of the electrographic imaging composition are intended to remain permanently in the microcells, as in a simple multicolor filter, such as 200 or 400, but it is preferred to avoid a separate fusing step intended to produce a high degree of fusing where one or more materials are to be removed from the microcells. Conventional biasing voltages are generally suitable for the practice of this process.

It is an advantage that second and subsequent electrographic imaging compositions do not enter the set or sets of microareas which have already received an electrographic imaging composition. As observed by Blazey et al, this is true even if the first set of microareas is again exposed to radiation, either intentionally or inadvertently, in rendering the photoconductive portion conductive in the second and/or third sets of microareas. This effect is referred to as the exclusion effect. Hercock et al U.S. Pat. No. 3,748,125 reports exclusion effects for xerographic photoconductive surfaces. The exclusion effect observed in the practice of this process does not appear related to any specific choice of electrographic toners or specific compositions applied to planar photoconductive surfaces. The exclusion effect observed in the practice of this process does not appear related to any specific choice of electrographic imaging compositions. Without wishing to be bound by any particular theory to account for the exclusion effect observed, it may result from photoconductive surface masking by the already deposited imaging compositions, field gradient or fringing effects (influenced to a degree by the nonplanar configuration of the photoconductive surface), or, most probably, some combination of these effects.

The exclusion effect is particularly important to the use of photoconductive supports having microareas that cannot be uniquely addressed. For example, three interlaid sets of nonoverlapping red, green, and blue filter segments can be formed on the supports 100, 200, 300, and 400 by exposing at three angles (each successive angle being larger than the preceding angle) and using the same general procedure described in connection with FIGS. 15A through 15D. Only the first exposed microareas are uniquely addressed. The second and third exposures overlap previously addressed sets of microareas. However, the exclusion effect prevents any significant deposition of the second and third electrographic imaging compositions in previously exposed and toned microareas. The exclusion effect can be relied upon in placing one or more compositions selectively in the microareas 7 through 18 in FIG. 6A; in placing one or more compositions selectively in the microareas 816B and 816C in FIG. 8; in placing one or more compositions selectively in the microareas 916B and 916C in FIG. 9; and in placing the third composition in the microcells 1006C in FIG. 10. In supports 1100, 1200, and 1300 the exclusion effect can be relied upon to selectively position an electrographic opacifying composition in the shaded microareas that cannot be uniquely addressed. (The exhaustion effect previously described in connection with the use of silver halide can be applied to the same support configurations as the exclusion effect.)

By modifying according to the teachings of this invention supports having microgrooves or microcells that can be uniquely addressed having photoconductive bottom walls that cannot be entirely uniquely addressed, it is possible to position an electrographic imaging composition over the entire bottom wall of each microcell or microgroove that is uniquely, but partially addressed. This allows a fill pattern as shown in FIG. 14B to be achieved, for example, even though support 1100 contains microareas, shown in shadow in FIG. 11, that cannot be uniquely addressed. It is a recognition of this invention that uniform toning of uniquely but partially addressed microcells or microgrooves in photoconductive supports and be achieved by positioning a thin conductive layer on the bottom walls thereof.

If support 1100 as shown in FIG. 11 is modified to provide a thin conductive layer overlying the bottom wall of each microcell 1106, the capability of uniform toning described above is achieved. It is, of course, important that conductivity not extend through or over the lateral walls 1108, although this may be occasionally employed to a limited degree for specialized imaging effects.

After uniform electrostatic charging of the support 1100 similarly as the support 600 in FIG. 15A, exposure in the direction of arrow 1126, as previously described, allows radiation to strike only the bottom wall microareas 1128 of one set of microcells. In FIG. 15B it can be seen that in the absence of a conductive bottom wall electrostatic charge is dissipated only in the radiation struck microareas; however, with a conductive bottom wall present, electrostatic charge is drained from the entire bottom wall of each microcell of the exposed set. Hence a second exposure of the exposed set of microcells in the direction of the arrow 1130, as previously described, is not required and would normally serve no useful purpose, although it is not precluded. Toning as described in connection with FIG. 15C results in a first composition, such as a red filter composition, being deposited uniformly over the entire bottom wall of each microcell of the exposed set. By repeating the above-described procedure twice more, exposing from different directions and using different compositions, an element can be produced as shown in FIG. 14B. Although the above description refers specifically to support 1100, essentially the same procedure can be applied to supports 800, 900, 1200, and 1300. The procedure can be applied to support 1000 as well, although it does not require this technique to achieve uniform toning of each microcell set.

The extent to which different compositions are interdigitated on the supports can be varied, depending upon the requirements of the contemplated application being served. For photographic applications, it is preferred that each microarea corresponding to one occurrence of an interdigitated composition, hereinafter referred to as composition microareas (as opposed to shadowing microareas, which can be smaller), be sufficiently small that it cannot be readily resolved with the unaided human eye. In this way, for example, interlaid blue, green, and red filter segments are readily fused by the human eye on viewing. For ease of description, the size of composition microareas formed by microgrooves is indicated in terms of the width thereof measured perpendicularly to one lateral wall of the microgroove. The sizes of composition microareas formed in microcells correspond to the diameter of a circle of equal area.

Where a photographic image is to be viewed without enlargement and minimal visible graininess is desired, composition microareas having sizes within the range of from about 1 to 200 microns, preferably from about 4 to 100 microns, are contemplated for use in the practice of this invention. To the extent that visible graininess can be tolerated for specific photographic applications, the composition microareas can be still larger in size. Where the photographic images produced are intended for enlargement, composition microarea sizes in the lower portion of the size ranges are preferred. It is accordingly preferred that the composition microareas be about 20 microns or less in size where enlargements are to be made of the images produced. Where the composition microareas of the support provide a radiation-sensitive material to perform an imaging function, the lower limit on the size of the microareas is a function of the photographic speed desired. As the areal extent of the microareas is decreased, the probability of an imaging amount of radiation striking a particular microarea on exposure is reduced. Microarea sizes of at least about 7 microns, preferably at least 8 microns, optimally at least 10 microns, are contemplated where the microareas contain radiation-sensitive materials of camera speed. At sizes below 7 microns, silver halide emulsions in the microareas can be expected to show significant reductions in speed.

In some of the preferred supports described above a single composition microarea corresponds to the entire bottom wall of a microgroove or microcell. In this instance the sizes of the microgrooves and microcells correspond to the stated sizes of the composition microareas. In other supports a number of laterally displaced composition microareas can be present in a single microcell or microgroove. For these supports the microgrooves and/or microcells can range upward in size by a multiple of the number of composition microareas contained.

The lateral walls can be of any height convenient for shadowing. When the lateral walls form microgrooves or microcells, the height is chosen so that the microgrooves or microcells can be of any necessary depth to contain the compositions intended to be placed therein. It is generally preferred that the microgrooves or microcells be sized sc that they are entirely filled, although in some forms of the invention partial filling is contemplated. In terms of actual dimensions, the height of the microcells is chosen as a function of the compositions to be placed therein. For example, in photographic applications the height of the microgrooves or microcells is chosen to permit the composition contained therein to provide a desired optical density. The height of the lateral walls can be less than, equal to, or greater than their lateral spacing. For photographic applications the height of the lateral walls is typically chosen to correspond to the thickness to which the same compositions are coated on planar supports. It is generally contemplated that the height of the lateral walls (and hence the depth of the microcells or microgrooves) will fall within the range of from about 1 to 1000 microns. For silver halide emulsions, dyes, and dye image forming components commonly employed in conjunction with silver halide emulsions, it is generally preferred that the lateral walls be in the range of from 5 to 20 microns in height.

The thickness of the lateral walls can be varied, depending upon the application and the effect intended. It is generally preferred for the practice of this invention that the thickness of the lateral walls range from about 0.5 to 5 microns, although both greater and lesser thicknesses are contemplated. The bottom walls for photographic applications normally occupy at least 50 percent (preferably at least 80 percent) of the array area. The microcells can occupy as much as 99 percent of the support area, but more typically in the practice of this invention occupy no more than 90 percent of the support area. In the preferred support configurations shown the microcells and microgrooves are arranged in closely packed patterns which allow the lateral walls to occupy the least possible area. It is recognized, however, that the microcells and microgrooves can be separated by lateral walls of substantial areal extent where this is not objectionable to the end use contemplated. In other words, closely packed patterns are not essential.

In some instances the supports employed in the practice of this invention are identical to those disclosed by Whitmore, Gilmour, and Blazey et al. These supports can be prepared by any of the techniques disclosed therein, here incorporated by reference. Certain preferred supports employed in the practice of this invention are similar to those previously disclosed, but differ in the configuration of the lateral and bottom wall patterns. The preparation techniques of Whitmore, Gilmour, and Blazey et al can be readily modified to prepare these supports. Still other supports, such as those requiring conductive bottom walls in a photoconductive support portion, require fabrication techniques not previously known to the art.

A preferred technique for forming lateral and bottom walls in the supports is to form a plastic deformable material as a planar element or as a coating on a relatively nondeformable support element and then to form the lateral and bottom walls in the relatively deformable material by embossing. An embossing tool is employed which contains projections corresponding to the desired shape of the bottom walls. The projections can be formed on an initially plane surface by conventional techniques, such as coating the surface with a photoresist, imagewise exposing in a desired pattern and removing the photoresist in the areas corresponding to the spaces between the intended projections (which also correspond to the configuration of the lateral walls to be formed in the support). The areas of the embossing tool surface which are not protected by photoresist are then etched to leave the projections. Upon removal of the photoresist overlying the projections and any desired cleaning step, such as washing with a mild acid, base or other solvent, the embossing tool is ready for use. In a preferred form the embossing tool is formed a metal, such as copper, and is given a metal coating, such as by vacuum vapor depositing chromium or silver. The metal coating results in smoother walls being formed during embossing.

In various forms of the supports described above the portion of the support forming the bottom walls is transparent, and the portion of the support forming the lateral walls is either opaque or dyed to interrupt light transmission therethrough. As has been discussed above, one technique for achieving this result is to employ different support materials to form the bottom and lateral walls of the supports.

A preferred technique for achieving dyed lateral walls and transparent bottom walls in a support formed of a single material is as follows: A transparent film is employed which is initially unembossed and relatively nondeformable with an embossing tool. One or a combination of dyes capable of imparting the desired color to the lateral walls to be formed is dissolved in a solution capable of softening the transparent film. The solution can be a conventional plasticizing solution for the film. As the plasticizing solution migrates into the film from one major surface, it carries the dye along with it, so that the film is both dyed and softened along one major surface. Thereafter the film can be embossed on its softened and therefore relatively deformable surface. This produces dyed lateral walls and transparent bottom walls in the film support.

To position a conductive layer on each bottom wall while avoiding conductively connecting adjacent bottom wall areas, a continuous, thin conductive layer is first formed on a planar surface of an embossable support. Although the conductive layer can be formed by any convenient method, it is preferred to form the conductive layer by vacuum vapor deposition, since this permits uniform layers which are very thin to be easily formed. Generally preferred conductive vacuum vapor depositions are metals at coverages of from 0.5 to 50 $mg/dm^2$, preferably 1 to 10 $mg/dm^2$. The embossing procedure described above is performed on the surface bearing the conductive layer. This results in breaking the conductive layer into discrete segments corresponding to the bottom wall areas, thereby obviating electrical conduction across the lateral walls between adjacent bottom walls. The use of conductive layers as described is particularly contemplated in combination with embossable photoconductive supports. The conductive layer can be formed of any conductive material. Where the conductive layer remains on the support after a photographic image is produced and viewing is through the bottom walls of the support, the conductive layer is preferably of relatively low optical density—e.g., less than about 0.5. On the other hand, if reflection viewing is contemplated and/or the conductive layer is removed before viewing, the optical density of the conductive layer need not be limited. Silver conductive layers are specifically preferred, since silver can be removed before the photographic element is viewed by well known bleaching techniques.

Although certain combinations of materials offer distinct advantages in the practice of this invention, none of the materials employed are in and of themselves new. Once the principles of this invention are understood by those skilled in the art, selection of materials for practicing this invention can be readily undertaken from a general knowledge of photographic chemistry and, particularly, from a familiarity with the teachings of Whitmore, Gilmour, and Blazey et al, each cited above and here incorporated by reference for the purpose of suggesting particularly advantageous materials. Nevertheless, certain preferred materials for use in the practice of this invention are set forth, but are not intended to be limiting.

The supports can be formed of the same types of materials employed in forming conventional photographic supports. Such supports are disclosed, for example, in *Research Disclosure,* Vol. 176, December 1978, Item 17643, paragraph XVII, here incorporated by reference. *Research Disclosure* and *Product Licensing Index* are publications of Industrial Opportunities Ltd., Homewell, Havant Hampshire, PO9 1EF, United Kingdom. Polymeric film supports and resin coated reflective supports are particularly preferred.

Second support elements, such as 308, which define only lateral walls can be selected from a variety of materials lacking sufficient structural strength to be employed alone as supports. It is specifically contemplated that the second support elements can be formed using conventional photopolymerizable or photocrosslinkable materials—e.g., photoresists. Exemplary conventional photoresists are disclosed by Arcesi et al U.S. Pat. Nos. 3,640,722 and 3,748,132, Reynolds et al U.S. Pat. Nos. 3,696,072 and 3,748,131, Jenkins et al U.S. Pat. Nos. 3,699,025 and '026, Borden U.S. Pat. No. 3,737,319, Noonan et al U.S. Pat. No. 3,748,133, Wadsworth et al U.S. Pat. No. 3,779,989, DeBoer U.S. Pat. No. 3,782,938, and Wilson U.S. Pat. No. 4,052,367. Still other useful photopolymerizable and photocrosslinkable materials are disclosed by Kosar, *Light-Sensitive Systems: Chemistry and Application of Nonsilver Halide Photographic Processes,* Chapters 4 and 5, John Wiley and Sons, 1965. It is also contemplated that the second support elements can be formed using radiation-responsive colloid compositions, such as dichromated colloids—e.g., dichromated gelatin, as illustrated by Chapter 2, Kosar, cited above. The second support elements can also be formed using silver halide emulsions and processing in the presence of transition metal ion complexes, as illustrated by Bissonette U.S. Pat. No. 3,856,524 and McGuckin U.S. Pat. No. 3,862,855. Once formed, the second support elements are not themselves further responsive to exposing radiation.

It is contemplated that the second support elements can alternatively be formed of materials commonly employed as vehicles and/or binders in radiation-sensitive materials. The advantage of using vehicle or binder materials is their known compatibility with radiation-sensitive materials that may be used to fill the microcells. The binders and/or vehicles can be polymerized or hardened to a somewhat higher degree than when employed in radiation-sensitive materials to insure dimensional integrity of the lateral walls which they form. Illustrative of specific binder and vehicle materials are those employed in silver halide emulsions, typically gelatin, gelatin derivatives, and other hydrophilic colloids. Specific binders and vehicles are disclosed in *Research Disclosure,* Vol. 176, December 1978, Item 17643.

Any conventional photoconductive material or combination of photoconductive materials can be employed to form the bottom walls of the supports of this invention. Suitable photoconductive materials are disclosed, for example, in *Research Disclosure,* Vol. 109, May 1973, Item 10938, Paragraph IV, here incorporated by reference. Photoconductive materials which in themselves are capable of forming lateral and bottom walls can be employed alone, as in the case of polymeric organic photoconductors which are plastically deformable. The photoconductive material is preferably incorporated in a separate insulative binder to form a support having a lateral wall array, as disclosed by Wiegl U.S. Pat. No. 3,561,358, here incorporated by reference. Preferred photoconductive supports and support portions can be formed as taught by Contois et al, *Research Disclosure,* Vol. 108, April 1979, Item 10823, here incorporated by reference. Other support portions, such as the conductive layers and base portions, can take any conventional form, exemplary materials being disclosed in *Research Disclosure,* Item 10938, cited above, Paragraphs II Supports and III Interlayers, here incorporated by reference.

In a specific preferred form at least the photoconductive portion of each support is substantially transparent. Where the photoconductive material forms a part of a multicolor reflective photographic print, for instance, even a slight coloration is apparent to the human eye and therefore objectionable. For such applications, preferred photoconductive materials are those sensitive to the ultraviolet portion of the spectrum, but not sensitized to the visible spectrum, to avoid imparting a visible minimum density. Such photoconductive materials can be exposed by shadowing techniques described above using ultraviolet radiation.

In certain applications, as where radiation-sensitive materials are intended to be located on the supports, it is not practical to use ultraviolet radiation to address the photoconductive portion, since many radiation-sensitive imaging materials exhibit a native sensitivity in the ultraviolet region of the spectrum. For example, silver halide possesses a native sensitivity in the near portion of the ultraviolet spectrum. For introducing each of blue, green, and red-sensitized silver halide into separate sets of microareas, the photoconductive portion is preferably sensitized to the red or a longer wavelength region of the spectrum. The first and second sets of microareas can be addressed with a red light without fogging the blue and green-sensitized silver halides introduced into the first and second sets of microareas. Even if a third exposure is employed, the red-sensitized silver halide introduced into the third set of microareas is not fogged, since the red-sensitized silver halide is not introduced until after the third exposure is completed.

Sensitization of photoconductive materials to a selected portion of the spectrum can be undertaken employing spectral sensitizing dyes well known in the electrophotographic arts, such as those disclosed in *Research Disclosure,* Item 10838, cited above, Paragraph IV-C. Any minimum density imparted by spectral sensitization need not be objectionable. For example, if the photographic image to be produced is not intended to be viewed directly, such as a multicolor negative image used for printing a multicolor positive image, coloration due to spectral sensitization is not objectionable, since color correction can be introduced in printing by procedures well known to those skilled in the art.

The light transmision, absorption, and reflection qualities of the supports can be varied for different applications. The supports can be substantially transparent or reflective, preferably white, as are the majority of conventional photographic supports. In every instance, however, the lateral walls must be capable of interrupting radiation employed for shadowing exposures. The lateral walls of supports that are otherwise transparent can in some applications contain dyes or pigments (colorants) to render them substantially light impenetrable. Levels of dye or pigment incorporation can be chosen to retain the light transmission characteristics in the thinner regions of the supports—e.g., in the bottom wall region—while rendering the supports relatively less light penetrable in thicker region—e.g., in the lateral wall regions. The lateral walls can contain neutral colorant or colorant combinations. Alternatively, the lateral walls can contain radiation absorbing materials which are selective to a single region of the electromagnetic spectrum—e.g., blue dyes. The lateral walls can contain materials which alter radiation transmission qualities, but are not visible, such as ultraviolet absorbers.

Where the supports are formed of conventional photographic support materials, they can be provided with reflective and absorbing materials by techniques well known by those skilled in the art. In addition, reflective and absorbing materials can be employed of varied types conventionally incorporated directly in radiation-sensitive materials, particularly in second supports formed of vehicle and/or binder materials or using photoresists or dichromated gelatin. The incorporation of pigments of high reflection index in vehicle materials is illustrated, for example, by Marriage U.K. Pat. No. 504,283 and Yutzy et al U.K. Pat. No. 760,775. Absorbing materials incorporated in vehicle materials are illustrated by Jelley et al U.S. Pat. No. 2,697,037; colloidal silver (e.g., Carey Lea Silver widely used as a filter for blue light); super fine silver halide used to improve sharpness, as illustrated by U.K. Pat. No. 1,342,687; finely divided carbon used to improve sharpness or for antihalation protection, as illustrated by Simmons U.S. Pat. No. 2,327,828; filter and antihalation dyes, such as the pyrazolone oxonol dyes of Gaspar U.S. Pat. No. 2,274,782, the solubilized diaryl azo dyes of Van Campen U.S. Pat. No. 2,956,879, the solubilized styryl and butadienyl dyes of Heseltine et al U.S. Pat. Nos. 3,423,207 and 3,384,487, the merocyanine dyes of Silberstein et al U.S. Pat. No. 2,527,583, the merocyanine and oxonol dyes of Oliver U.S. Pat. Nos. 3,486,897 and 3,652,284 and Oliver et al U.S. Pat. No. 3,718,472 and the enamino hemioxonol dyes of Brooker et al U.S. Pat. No. 3,976,661 and ultraviolet absorbers, such as the cyanomethyl sulfone-derived merocyanines of Oliver U.S. Pat. No. 3,723,154, the thiazolidones, benzotriazoles and thiazolothiazoles of Sawdey U.S. Pat. Nos. 2,739,888, 3,253,921 and 3,250,617 and Sawdey et al U.S. Pat. No. 2,739,971, the triazoles of Heller et al U.S. Pat. No. 3,004,896 and the hemioxonols of Wahl et al U.S. Pat. No. 3,125,597 and Weber et al U.S. Pat. No. 4,045,229. The dyes and ultraviolet absorbers can be mordanted, as illustrated by Jones et al U.S. Pat. No. 3,282,699 and Heseltine et al U.S. Pat. Nos. 3,455,693 and 3,438,779.

In those instances in which an image-bearing photographic element according to this invention is a multicolor negative intended to be used in printing a multicolor positive image or a multicolor positive intended for projection viewing, it is preferred that the lateral walls between adjacent microareas exhibit an elevated optical density and, preferably, the lateral walls should be substantially opaque, but the bottom walls forming the microareas should remain substantially transparent. Where the microareas are intended to contain radiation-sensitive material, increasing the absorption of exposing radiation by the lateral walls can reduce halation and resulting loss of image definition. For each of these purposes the lateral walls are preferably of increased optical density, but the bottom walls forming the microareas preferably remain substantially transparent. This can be achieved by introducing a dye selectively into the lateral walls of the support. In general any dye which absorbs light over at least a portion of the visible spectrum and which can interrupt radiation employed for shadowing exposures can be employed. Preferred dyes for projection and printing applications are of neutral density. For antihalation purposes, the absorption of the dye at least extends over a spectral region within which the radiation-sensitive material exhibits an absorption peak. For example, dyes which absorb in at least the blue portion of the spectrum are useful with radiation-sensitive silver halides. Sudan Black B and Genacryl Orange are exemplary of useful absorbing dyes for incorporation in lateral walls of otherwise transparent supports, particularly the photoconductive supports.

Generally any conventional combination of materials known to be useful when related in an interlaid pattern can be selected for incorporation in the separate sets of microareas. Virtually any known additive primary dye or pigment can, if desired, be selected for use in the multicolor filters described above. Further, the additive primary color can be imparted by blending two subtractive primary dyes or pigments. Additive and subtractive primary dyes and pigments mentioned in the *Color Index,* Volumes I and II, 2nd Edition, are generally useful in the practice of at least one form of the present invention.

For photographic applications it has been recognized that the incorporation of radiation-sensitive and/or image-forming materials in microareas has the effect of limiting lateral image spreading. Lateral image spreading has been observed in a wide variety of conventional photographic elements. Lateral image spread can be a product of optical phenomena, such as scattering of exposing radiation; diffusion phenomena, such as lateral diffusion of radiation-sensitive and/or imaging materials in the radiation-sensitive and/or imaging layers of the photographic elements; or, most commonly, a combination of both. Lateral image spreading is particularly common where the radiation-sensitive and/or other imaging materials are dispersed in a vehicle or binder intended to be penetrated by exposing radiation and/or processing fluids. While the present invention can be practiced with conventional radiation-sensitive and image-forming materials known to be useful in photography, it is appreciated that materials which exhibit visually detectable lateral image spreading are particularly benefited by incorporation into microareas according to this invention.

A variety of useful nonsilver imaging materials useful in the practice of this invention are disclosed by Kosar, *Light-Sensitive Systems: Chemistry and Application of Nonsilver Halide Photographic Processes,* John Wiley and Sons, 1965. Generally any imaging system capable of forming a multicolor image can be applied to the practice of this invention. It is specifically preferred to employ in the practice of this invention, radiation-sensitive silver halide and the image forming materials associated therewith in multicolor imaging. Exemplary materials are described in *Research Disclosure,* Vol. 176, December 1978, Item 17643, the disclosure of which is here incorporated by reference. Particularly pertinent are paragraphs I. Emulsion types, III. Chemical sensitization, IV. Spectral sensitization, VI. Antifoggants and stabilizers, IX. Vehicles, and X. Hardeners, which set out conventional features almost always present in preferred silver halide emulsions useful in the practice of this invention.

In the image transfer element 1400 described above, the microcells 1106 form three separate interlaid sets each containing a differing imaging composition. Each of the imaging compositions contains (1) one or more immobile colorants collectively capable of producing an additive primary color and/or (2) a subtractive primary dye or dye precursor capable of shifting between a mobile and an immobile form as a function of silver halide development, hereinafter collectively referred to as a colorant portion. The preparation of the photographic element 1400 is described by reference to FIGS. 15A through 15D, above, using at least one and preferably three separate electrographic imaging compositions.

Preferred electrographic imaging compositions are comprised of a colorant portion, as described above, and from 0.1 to 10 (preferably 0.3 to 3.0) parts by weight per part of the colorant portion of a resinous portion capable of forming a particulate dispersion with the colorant portion in a liquid carrier vehicle having a dielectric constant of less than 3.0 and a resistivity of at least $10^{10}$ ohm-cm. At least one of the colorant and resinous portions is chosen to impart an electrostatic charge of a selected polarity to the particulate dispersion in the liquid carrier.

It is specifically contemplated to incorporate the radiation-sensitive imaging materials in the colorant portion of electrographic imaging compositions as described above. The appropriate proportion of radiation-sensitive materials to subtractive primary dyes and dye precursors will be apparent from conventional photographic compositions, where mole ratios of silver halide to subtractive primary dye or dye precursor ranges from about 1 to 100:1. For example, radiation-sensitive silver halide is commonly employed in combination with dye-forming couplers in mole ratios of from about 2 to 100:1, more typically from about 3 to 60:1; however dye-forming couplers require at least two equivalents of silver to form one equivalent of image dye, whereas other subtractive primary dyes and dye precursors provide at least theoretically image dye in a 1:1 molar ratio with silver halide. Radiation-sensitive silver halide is typically formed in a peptizer, such as gelatin, and can be incorporated in the colorant portion as an emulsion, wherein the nonsilver or vehicle portion of the emulsion can be present in any conventional weight ratio, typically up to about 2:1.

The disclosure of the patents and publications cited above, here incorporated by reference, provide a variety of examples of positive and negative-working dye image providing compounds which can be employed as subtractive dyes or dye precursors in the electrographic imaging compositions of this invention. The colorant portion of the preferred electrographic imaging compositions is additionally comprised of at least one immobile additive primary colorant or a combination of immobile colorants capable of collectively providing a desired additive primary color. Unlike the subtractive primary dyes and dye precursors, the immobile additive colorants which provide an additive primary color should remain immobile at all times and should not wander from the microcells either before, during, or after a photographic image is obtained. Suitable immobile colorants can be selected from among a variety of materials, such as dyes and pigments, but are more preferably pigments, since these can be more readily obtained in highly immobile forms. Useful immobile colorants can be selected from the *Color Index,* 2nd Edition, 1956, Vols. I and II. Useful immobile polymeric dyes are illustrated by Goldman et al U.S. Pat. No. 3,743,503. Specific preferred immobile pigments are disclosed in *Research Disclosure,* Vol. 109, May 1973, Item 10938, Paragraph IX-C-2, here incorporated by reference. Exemplary of preferred green, red, and blue immobile pigments are Monolite Green GN, Red Violet MR ® (Hoechst), Pyrazalone Red ® (Harmon), Alkali Blue MG ® (Sherwin-Williams), and Monolite Blue ® (ICI). Exemplary of useful green, red, and blue substantially immobile dyes are Renazol Brilliant Green 6B, Red Dye R3G (Drimarene Scarlet ®) (Sandoz), and MX-G Procion Blue. The proportions of the subtractive primary dye or dye precursor to the immobile additive primary colorant can be varied as desired to achieve an intended imaging result without the exercise of invention. The proportions will vary, depending upon the specific materials selected. For most materials ratios of subtractive primary dye or dye precursor to immobile additive colorant in the range of from about 1:10 to 10:1, most commonly 1:2 to 2:1, are operative, although optimum color balancing for a specific application requires individual adjustment by empirical procedures well known to those skilled in the art.

The resinous portion which together with the colorant portion forms dispersed particles in the liquid electrographic developer is preferably insoluble in the liquid carrier vehicle or only slightly soluble therein. Resinous materials acting as binders appear to form a coating around the colorants and thus facilitate dispersion in the liquid carrier. Examples of useful resins are: alkyd resins as described in Australian Pat. No. 254,001; acrylic resins described, for example, in U.S. Pat. Nos. 3,671,646 and 3,334,047; alkylated polymers described, for example, in U.S. Pat. Nos. 3,542,681 and '682; rosins described, for example in U.S. Pat. No. 3,399,140; polystyrene as described, for example in Australian Pat. No. 253,986 and U.S. Pat. No. 3,296,140; addition polymers containing a polar moiety as described, for example, in U.S. Pat. No. 3,788,995; ethyl cellulose described in U.S. Pat. No. 3,703,400; cellulosic polymers as described, for example, in U.S. Pat. No. 3,293,183; polyamides, shellac as described, for example, in U.S. Pat. No. 2,899,335; waxes or rubber-modified polystyrenes as described, for example, in U.S. Pat. No. 3,419,411; rosin-modified as described, for example, in U.S. Pat. No. 3,220,830; silica aerogels as described, for example, in U.S. Pat. No. 2,877,133; halogenated polyethylenes described, for example, in U.S. Pat. No. 2,891,911; graft copolymers described, for example, in U.S. Pat. No. 3,623,986; cyclized rubbers described, for example, in U.S. Pat. No. 3,640,863; vinyl polymers described, for example, in U.S. Pat. No. 3,585,140 as well as coumarone-indene resins; ester gum resins; and polymerized blends of certain soluble monomers, polar monomers and, if desired, insoluble monomers as described in Belgian Pat. No. 784,367.

In order to exhibit electrographic properties, the imaging composition must have an electrostatic charge when dispersed as particles in a liquid carrier. The colorants can themselves impart the desired electrostatic charge to the dispersed particles. The colorants are selected to exhibit a single polarity of charge to insure the lowest possible minimum densities. The electrostatic charge polarity of the dispersed particles can be enhanced or controlled by the selection of resinious binder materials and/or charge control agents. Illustrative charge control agents are the polyoxyethylated alkyl surfactants such as polyoxyethylated alkylamine, polyoxyethylene palmitate, and polyoxyethylene stearate. Other useful materials are magnesium and heavier metal soaps of fatty and aromatic acids as described in U.S. Pat. Nos. 3,417,019, 3,032,432, 3,290,251, 3,554,946, 3,528,097, and 3,639,246. Useful metal soaps include cobalt naphthenate magnesium naphthenate and manganese naphthenate, zinc resinate, calcium naphthenate, zinc linoleate, aluminum resinate, isopropyltitanium stearate, aluminum stearate, and others many of which are also described in Matkan U.S. Pat. No. 3,259,581. Typically, the amount of such materials used is less than about 2 percent by weight based on the weight of the imaging composition. In certain instances, the resinous binder materials per se can function as the charge control agent as disclosed, for example in U.S. Pat. No. 3,788,995, cited above. A dispersing aid can also be added as shown, for example in U.S. Pat. No. 3,135,695. This patent shows an electrographic liquid developer prepared by surrounding or dispersing electrographic-type pigment particles with a suitable resinous binder envelope and treating the pigment-binder combination with a small amount of an alkylaryl compound before suspending the combination in a liquid aliphatic carrier. This type of liquid electrographic developer is especially useful due to its relatively high stability. Other addenda may include: a phospholipid charge stabilizing material, e.g., lecithin, as described in U.S. Pat. Nos. 3,220,830, 3,301,677, 3,301,698, 3,241,957, 3,668,126, and 3,674,693, and U.K. Pat. 1,337,325; noble metal salts as described in French Pat. No. 1,354,520, isocyanate compounds as described in U.K. Pat. No. 654,977, and U.S. Pat. No. 3,383,316; magnetic particles as described in U.S. Pat. No. 3,155,531; conductive materials as described in U.S. Pat. Nos. 3,300,410 and 3,409,358; fatty acid esters as described in U.S. Pat. No. 3,692,520; manganese salts as described in U.S. Pat. No. 3,438,904; antistain agents as described in U.S. Pat. No. 3,681,243; and hydroxy-stearins as described in U.S. Pat. No. 3,701,731.

Conventionally, the liquid carrier vehicle used in liquid electrographic developers has a low dielectric constant less than about 3.0 and a resistivity of at least about $10^8$ ohm-cm, preferably at least $10^{10}$ ohm-cm. These requirements automatically eliminate water and most alcohols. However, a number of liquids still are available to satisfy the above-noted requirements and have been found to function as effective carrier vehicles for liquid developers. Among the various useful liquid carrier vehicles are alkylaryl materials such as the xylenes, benzene, alkylated benzenes and other alkylated aromatic hydrocarbons such as are described in U.S. Pat. No. 2,899,335. Other useful liquid carrier vehicles are various hydrocarbons and halogenated hydrocarbons such a cyclohexane, cyclopentane, n-pentane, n-hexane, carbon tetrachloride, fluorinated lower alkanes, such as trichloromonofluorane and trichlorotrifluorethane, typically having a boiling range of from about 2° C. to about 55° C. Other useful hydrocarbon liquid carrier vehicles are the paraffinic hydrocarbons, for example, the isoparaffinic hydrocarbon liquids having a boiling point in the range of 145° C. to 185° C. (sold under the trademark Isopar by Exxon) as well as alkylated aromatic hydrocarbons having a boiling point in the range of from 157° to 177° C. (sold under the trademark Solvesso 100 by Exxon). Various other petroleum distillates and mixtures thereof may also be used as liquid carrier vehicles. Additional carrier liquids which may be useful in certain situations include polysiloxane oils such as dimethyl polysiloxane as described in U.S. Pat. Nos. 3,053,688 and 3,150,976; Freon carriers as described in Canadian Pat. No. 701,875 and U.S. Pat. No. 3,076,722; mixtures of polar and nonpolar solvents as described in U.S. Pat. No. 3,256,197; aqueous conductive carriers such as described in U.S. Pat. No. 3,486,922; nonflammable liquid carriers such as described in U.S. Pat. No. 3,058,914; polyhydric alcohols such as described in U.S. Pat. No. 3,578,593; and emulsified carriers such as described in U.S. Pat. Nos. 3,068,115 and 3,507,794. Electroscopic imaging composition can be dispersed in the liquid carrier vehicle in any convenient conventional concentration, typically in the range of from 0.01 to 10 percent by weight based on total weight. Conventional techniques for dispersing the electrographic imaging composition can be employed, as disclosed, for example, in *Research Disclosure*. Item 10938, cited above, Paragraph IX-E and F.

The invention has been described by reference to certain preferred embodiments and additional embodiments chosen for their simplicity in illustrating basic concepts. Although an exhaustive discussion of the invention is neither intended nor considered necessary, certain additional variations are discussed below to illustrate additional concepts.

In the foregoing discussion the direction of exposure of microcells which differ in length and width (hereinafter referred to as elongated microcells) has been illustrated by showing the direction of exposing radiation striking the bottom wall of each of the microcells to be aligned with its major axis—that is, the axis along which its length is measured. It is appreciaterd that the direction of angled light exposure striking the bottom wall of an elongated microcell need not be aligned with its major axis. Departure from alignment can be tolerated to the extent that exposure of remaining sets of microcells not intended to be exposed does not occur. In many instances distinct advantages can be realized by controlled departures from major axis alignment during angled exposure.

Figure 16A:
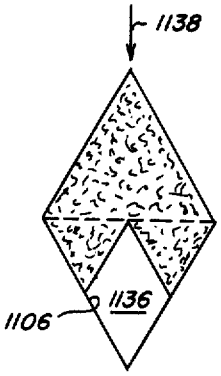

FIGS. 16A through 16D illustrate how advantage can be realized by varying the alignment of exposing radiation. In FIG. 16A a microcell 1106 is shown having a portion of its bottom wall exposed over a microarea 1136 similarly as has already been discussed in connection with support 1100 as shown in FIG. 11. Microarea 1136 accounts for only about one quarter of the total bottom wall area of the microcell. By rotating the microcell 180° it is possible to expose a second portion of the microcell equal in area to microarea 1136 to provide an exposure pattern of the bottom wall as shown in FIG. 11. This, however, still leaves approximately half of the bottom wall area unexposed.

Figure 16B:
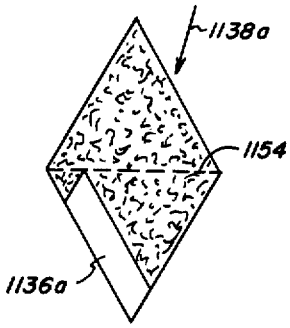
Figure 16C:
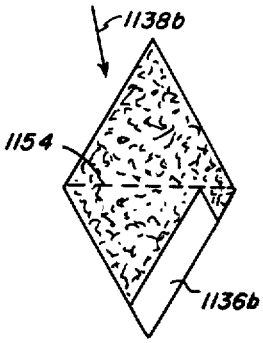

In FIG. 16B the result is shown of rotating the angle of exposure with respect to the major axis of the microcell. If the angle of exposure is shifted as indicated by arrow 1138*a*, then the portion 1136*a* of the bottom wall of the microcell exposed is changed. If the direction of exposure is rotated in the opposite direction in reference to the major axis, as illustrated by arrow 1138*b*, then an area 1136*b* of the microcell bottom wall is exposed. It can be seen that the area 1136 occupies a greater percentage of the bottom wall area than either of the areas 1136*a* or 1136*b*. Thus, choice of alignment with respect to the major axis of the microcell can control the proportion of the bottom wall of the microcell exposed.

It is to be noted that the areas 1136, 1136*a*, and 1136*b* overlap in part and in part occupy different portions of the bottom wall of the microcell. It can also be seen that at the exposure angle chosen with respect to the axial plane of the support each of the areas exposed extend to the minor axis 1154 bisecting the microcell. It is possible to expose identically all of the microcells 1106 of one set in support 1100 by using three different exposures in the directions indicated by arrows 1138, 1138*a*, and 1138*b*. In this case the bottom wall exposure of each microcell 1106 is the sum of the individual exposures. If, instead of exposing the one set of microcells 1106 three times, the support or the exposing radiation source is rotated during exposure, a larger proportion of the bottom wall of each microcell can be exposed.

Figure 16D:
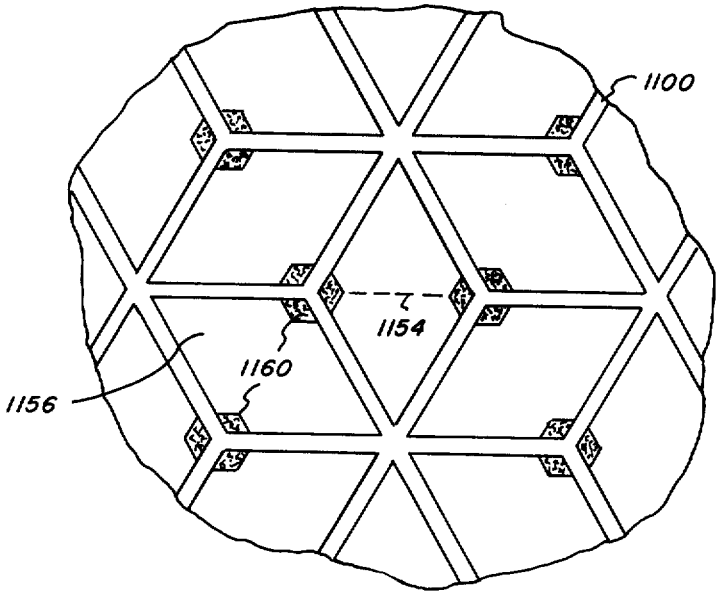

In FIG. 16D the result is shown of rotating the support during exposure between the exposure angle positions indicated by arrows 1138*a* and 1138*b* and then duplicating the exposure from the opposite direction so that the half of each microcell originally entirely shadowed is also addressed. Such procedure only addresses one set of microcells, but all three set of microcells can be uniquely addressed by repeating the procedure twice, as has been previously described in reference to FIG. 11. In FIG. 16D each microcell is shown to have been addressed over a major portion of its bottom wall, as indicated by microarea 1156 while only microareas 1160 are not addressed by exposing radiation. In comparing FIG. 16D with FIG. 11 it can be seen that rotation during exposure can be relied upon to increase greatly the proportion of the bottom walls uniquely addressed. While, in theory, all of the bottom walls of each set can be entirely uniquely addressed by the procedure described above, in practice the risk of inadvertently exposing an additional set of microcells while addressing an intended set of microcells increases as the angle of exposure departs from the major axis. For the particular configuration shown in FIG. 16D only a 30° departure from the major axis would achieve exposure of the entire bottom wall without exposing any additional microcell set.

In FIG. 17 the support 600 described above is shown with three interlaid sets of microcells each entirely occupied by a green, red, or blue material, as taught by Whitmore and Blazey et al, cited above. In discussing the image transfer application of FIG. 14A, it has been pointed out that, when subtractive dyes or dye precursors are employed, it is essential that overlapping of these materials in a controlled manner occur to permit the formation of a multicolor transferred image. In FIG. 14A a spacing layer 1454 is provided for the purpose of facilitating lateral spreading during image transfer.

In FIG. 18 support 1800 according to this invention is disclosed which differs from support 600 only in distinctive features discussed. Specifically, the support 1800 forms a plurality of identical microcells 1802 each of which correspond to three separate microcells 602. Initially the microcells are empty. By exposing the support at an acute angle with respect to the axial plane of the support, microareas B1 forming a portion of the bottom wall of each of the microcells are uniquely addressed. The dashed lines 1806, 1808, and 1810 together with two sides of each microcell circumscribe each exposed microarea B1 which is uniquely addressed.

This initial exposure, however, leaves unaddressed each microarea B2, which desirably should receive exposure along with each microarea B1. The microareas B2 can be addressed by repeating the first angled exposure, but only after the direction (but not the acute angle) of exposure has been changed as indicated by arrow 1812. After exposure in the directions indicated by arrows 1804 and 1812, each microcell can be provided with a suitable imaging material in microareas B1 and B2.

During the above exposures the microareas R and G of the support remain entirely in shadow and are not addressed. These microareas can be uniquely addressed by rotating the support and repeating the exposure sequence described above. The result is to create in a single microcell three materials laterally related similarly as in support 600, but not separated by a lateral wall (although adjacent microcells are separated by lateral walls). If during imaging blue, green, and red colorants occupy the correspondingly initialed microareas each associated with yellow, magenta, and cyan mobile dyes or dye precursors, respectively, the result, when the support is substituted in FIG. 14A for support 1100, is to permit lateral spreading of the subtractive primary dyes or dye precursors to occur in a controlled manner within each microcell. This can permit reduction in the thickness of the spacing layer 1454. As described by Whitmore, it is possible to confine also the layers 1452, 1454, and 1456 within microcells in a modified form of support 1450 and thereby further control lateral spreading of the subtractive primary dyes or dye precursors during image transfer.

In addition to providing a useful imaging advantage the exposure procedure described in connection with FIG. 18 illustrates further the advantages that can be realized according to the present invention when more than one direction of exposure is employed to address what is intended to constitute a single set of microareas of the final product. In the case of support 1800 changing directions of exposure permits the use of the entire bottom wall area of the support, whereas this could not be otherwise readily achieved.

In the foregoing discussion of the invention microcellular supports have been described with specific reference to supports having three interlaid sets of microcells, since multicolor photography typically employs a triad of color-forming units. In connection with FIG. 6A it has been pointed out that many microareas can be present within a single microcell. Hence even though only three sets of microcells are present in a support, it is apparent that a much larger set of microareas can be created by appropriate addressing. Still, there are applications in which it is desirable to have more than three sets of microareas and at the same time to have the microareas entirely laterally separated by being positioned in separate microcells. This can be achieved according to the present invention by providing four or more interlaid sets of microcells.

The use of four interlaid sets of microcells can be appreciated by reference to FIG. 19, wherein a support 1900 is illustrated. Support 1900 is generally similar to support 1000, but differs in having four rather than three sets of microcells interlaid. The supports 1900 and 1000 also differ in the relative position of the microcells of the different sets. Microcells 1906A, 1906B, and 1906C are identical to microcells 1006A, 1006B, and 1006C, respectively. In addition support 1900 contains a fourth set of microcells 1906D. The dashed line indicates the boundary of a single pixel 1918. It can be seen that each set of microcells within the pixel presents an approximately equal area.

The microcells 1906D can be initially uniquely addressed by employing radiation directed in any one or each of the directions indicated by arrows 1912D. The radiation is at an acute angle with respect to the axial plane of the support, but the angle is limited to prevent exposure of the bottom walls of the remaining microcells. After microcells 1906D have been exposed selectively to radiation, they can be filled by techniques heretofore described. Thereafter microcells 1906A and 1906B can be addressed identically as microcells 1006A and 1006B by employing radiation at an acute angle with respect to the axial plane of the support in the directions indicated by arrows 1912A and 1912B. Exposure of the microcells 1906A and 1906B can be undertaken in any sequence. In both cases radiation will also fall within the microcells 1906D; however, since these microcells have already been filled, either the exclusion or the exhaustion principles described above can be relied upon to avoid contamination of microcells 1906D with unwanted material. After microcells 1906A, 1906B, and 1906D have been addressed and filled with material, the microcells 1906C can be addressed by radiation which is directed substantially perpendicular to the axial plane of the support. All of the microcells of the support are thereby addressed, but the exclusion or exhaustion principle can be relied upon to avoid unwanted contaminatin of the remaining microcells. From the foregoing is is apparent that the support 1900 differs from support 1000 in providing four rather than three interlaid sets of microcells, thereby permitting the formation of four sets of microareas each coextensive with one set of microcells.

An advantageous application of the support 1900 can be illustrated by substituting the support 1900 for the support 1100 in FIG. 14A. The contents of the microareas of the suport 1100 labeled B, G, and R can be positioned in the microcells 1906A, 1906B, and 1906C, respectively, of the support 1900. The three sets of microareas can each contain a silver halide emulsion responsive to the blue, green, and red portions of the spectrum, respectively, and yellow, magenta, and cyan dye or dye precursor, respectively. The microcells 1906D of the fourth set can contain a panchromatically sensitized silver halide emulsion of higher speed than contained in the remaining sets of microcells and a dye or dye precursor (which can be a combination of dyes or dye precursors, if desired) capable of producing a substantially neutral hue, preferably black. The silver halide emulsions and the dyes or dye precursors are chosen so that the image transfer system is positive-working—that is, a positive transferred image is produced in the dye immobilizing layer 1452.

Upon exposure and processing a transferred multicolor dye image is produced for viewing. Absent the fourth set of microcells 1906D areas that have received little or no exposure will appear black and nearly black. In conventional photographic elements this results in many details being lost in shadowed areas—particularly where the photographic subject spans the entire gamut from brightly lighted areas to deep shadows, as occurs in a landscape scene on a bright day. However, by providing in the fourth set of microcells a faster silver halide emulsion which modulates the transfer of neutral dye, it is possible to define image that would otherwise be lost in shadow. The fact that the observable shadowed detail will be near monochromatic constitutes no disadvantage, since the eye tends to see highly shadowed subject features monochromatically. This is attributable to the human eye's requirement for higher levels of lighting to perceive images in color. Thus, the fourth set of microcells and microareas in the support 1900 can be applied usefully to extending the range of image definition. There are, of course, many other useful applications for the support 1900, the above being merely exemplary.

Although three and four interlaid sets of microcells have been demonstrated to be useful in the practice of this invention, it is appreciated that larger numbers of interlaid sets of microcells each capable of providing microareas isolated from other microareas by lateral cell walls can be provided. This can be illustrated by reference to FIG. 20, wherein a pixel of a support 2000 is shown. To avoid needless repetition in description, the support can be viewed as containing within the pixel four areas 1018 identical to pixels 1018 in FIG. 10A. In addition the pixel is comprised of an additional area 1018A which is identical to pixel 1018 in FIG. 10A, but larger in size. It can be seen that overall the pixel shown of the support 2000 contains one microcell 2004, four microcells 2005, and eight microcells 2006. Thus, in a support 2000 comprised of a large number of repeating pixels there are six distinct interlaid sets of microcells present.

It is possible to address the microcells 2001 and 2002 in directions indicated by the arrows contained therein without addressing the bottom walls of the remaining microcells. The procedure for addressing and filling these microcells is essentially similar to the description previously provided in connection with support 1000. Once material is in place in microcells 2001 and 2002, microcells 2003 can be addressed in any or all of the directions indicated by the arrows therein without exposing the bottom walls of microcells other than those of microcells 2001 and 2002. However, since these microcells have already been addressed, exclusion or exhaustion effects can be relied upon to prevent their contamination with unwanted materials in filling the microcells 2003. After microcells 2003 have been addressed and filled, the procedure for addressing microcells 2001 and 2002 is repeated, but with exposures at an increased acute angle with respect to the axial plane of the support. This permits the bottom walls of the microcells 2004 and 2005 to be addressed without addressing the bottom walls of the microcells 2006. In exposing the bottom walls of microcells 2004 and 2005 the bottom walls of the microcells 2001, 2002, and 2003 are addressed, but exclusion or exhaustion effects can be relied upon to avoid contamination of these microcells with unwanted materials. Microcells 2006 cannot be selectively addressed by radiation. However, exposure substantially perpendicular to the axial plane of the support allows these microcells to be addressed concurrently with the remaining microcells. Exclusion or exhaustion effects can be relied upon to avoid contamination of the remaining microcells with unwanted materials. Hence, it is possible to place six different compositions selectively in six interlaid sets of microcells using the support 2000.

The advantages by the six interlaid sets of microcells of support 2000 can be illustrated by reference to a specific imaging application. In conventional multicolor photographic elements it is common practice to divide blue, green, and red recording silver halide emulsions into faster and slower layers. It has been observed that this permits higher photographic speeds to be obtained than when only one emulsion layer is provided to record each third of the spectrum. Further, earlier in the discussion of the invention, it has been pointed out that silver halide contained in microcells of less than 8 microns in average diameter will exhibit a loss of speed. Thus, a choice is required between the best possible image definition afforded by the smallest possible microcells and the highest attainable photographic speeds.

In one application the support 2000 can contain microcells 2001, 2002, and 2003 sized so that they are sufficiently large to exhibit no adverse effect on the speed of silver halide emulsions contained therein. Fast blue, green, and red-sensitive silver halide emulsions can then be located in these microcells. Alternatively, a single panchromatically sensitized relatively fast silver halide emulsion can be associated with these three sets of microcells and blue, green, and red filters positioned in the individual microcells, as has been previously described. The three sets of microcells contained in the areas 1018 can now be sized to provide the best possible sharpness for the image, but attaining the highest possible speed need not be given importance, as the microcells in the area 1018A can be relied upon for speed. Thus, in an illustrative application, the microcells in areas 1018A can have an average diameter in excess of 20 microns while the microcells in areas 1018 can have an average diameter of less than 10 microns or even less than 7 microns. The same material can be placed in the microcells of areas 1018A and 1018. Alternatively the silver halide emulsion or emulsions employed in the areas 1018 can be slower than employed in the areas 1018A. In one preferred form one set of microcells in each of the areas 1018A and 1018 together form a smooth modulated blue characteristic curve, another set of microcells in each of the areas 1018A and 1018 together form a smooth green modulated characteristic curve, and a third set of microcells in each of the areas 1018A and 1018 together form a smooth red modulated characteristic curve.

Use of the support 2000 can be illustrated by considering its substitution for the support 1100 in FIG. 14A. Upon exposure through transparent bottom walls of the support the silver halide emulsion responds in each of the microareas corresponding to the microcells 2001, 2002, and 2003 to a different one of the blue, green, and red portions of the spectrum and modulates the transfer of a complementary subtractive primary dye or dye precursor. In so doing, the areas 1018A impart to the photographic element its threshold speed. This is achieved to some extent by providing relatively larger microcells in the areas 1018A as compared to the areas 1018 and therefore relatively lower sharpness capabilities. However, lower sharpness is relatively unimportant in the threshold regions of exposure as compared to sharpness in the mid-region of the exposure scale.

During exposure silver halide emulsion in light struck microareas corresponding to each of the microcells 2004, 2005, and 2006 similarly responds to a different one of the blue, green, and red portions of the spectrum and modulates the transfer of a complementary subtractive primary dye or dye precursor. It is the areas 1018 that record mid-scale exposures. Since the microcells are relatively smaller in these areas, a relatively sharper dye image is afforded by mid-scale exposures. Thus, the advantages of high speed and sharpness are combined by employing a combination of six interlaid sets of microcells.

It should be noted that in many conventional multicolor photographic elements there are three separate color-forming units to record a single third of the spectrum. It is therefore appreciated that nine interlaid sets of microcells could be employed to provide the advantages obtained in conventional photography by dividing the blue, green, and red color-forming units each into three separate emulsion layer components. Even larger numbers of interlaid microcell sets are possible.

A further advantage of the invention can be appreciated by considering that the multicolor photography in which retained dye images are formed it is common practice to provide more than one blue, green, and/or red recording silver halide emulsion layer to achieve maximum efficiency in imaging. However, in multicolor image transfer photography, it is uncommon to divide the blue, green, and red recording silver halide emulsions among separate layers, since in so doing the advantages in imaging are offset by the increased numbers of layers required and the increase in the diffusion paths of the dyes. By contrast, in the present invention, the diffusion paths for the dyes using the support 2000 as described above are not appreciably longer than the diffusion paths when the support 1100 is employed. Hence, it is an important advantage that the offsetting disadvantages of multicolor color-forming units encountered in multicolor image transfer photographic elements employing superimposed silver halide emulsion layers are not encountered in the image transfer applications of this invention.

The invention can be more specifically appreciated by reference to the following illustrative examples:

EXAMPLE 1—Preparation of Green Pigment Concentrates

A. Nine grams of a finely divided immobile particulate green pigment, Monolite Green GN, were mixed with 4.5 grams of a copolymer of tert-butylstyrene and lithium methacrylate along with 85.5 grams of Solvesso 100®. The concentrate was ball-milled for two weeks at room temperature.

B. Eight grams of a finely divided immobile particulate green pigment, Monolite Green GN, were mixed with 8.0 of a copolymer of tert-butylstyrene, lauryl methacrylate, lithium methacrylate, and methacrylic acid in the weight ratio of 60:36:3.6:0.4 (hereinafter designated TBS) and 72.0 grams of Solvesso 100®. The concentrate was ball-milled for two weeks at room temperature.

EXAMPLE 2—Preparation of Red Pigment Concentrates

Nine grams of a finely divided immobile particulate red pigment, Pyrazolone Red® (Harmon), were mixed with 9.0 grams of TBS and 81.0 grams of Solvesso 100®. The concentrate was ball-milled for two weeks at room temperature.

EXAMPLE 3—Preparation of Blue Pigment Concentrates

Five grams of a finely divided immobile particulate blue pigment, Alkali Blue MG® (Sherwin-Williams) were mixed with 5.0 grams of TBS and 45.0 grams of Solvesso 100®. The concentrate was ball-milled for two weeks at room temperature.

EXAMPLE 4—Preparation of Mobile Magenta Dye-Forming Coupler Concentrate

Four and one-half grams of a mobile magenta dye-forming coupler, 1-(2-benzothiazolyl)-3-amino-5-pyrazolone, were mixed with 4.5 grams of TBS and 40.5 grams of Solvesso 100®. The concentrate was ball-milled for two weeks at room temperature.

EXAMPLE 5—Preparation of Mobile Cyan Dye-Forming Coupler Concentrate

The procedure of Example 4 was repeated, except a mobile cyan dye-forming coupler, 2,6-dibromo-1,5-naphthalenediol, was substituted for the magenta dye-forming coupler.

EXAMPLE 6—Preparation of Mobile Yellow Dye-Forming Coupler Concentrate

A mobile yellow dye-forming coupler, α-(4-carboxyphenoxy)-α-pivalyl-2,4-dichloroacetanilide, in the amount of 3.14 grams was mixed with 3.14 grams of TBS and 28.3 grams of Solvesso 100®. The concentrate was ball-milled for two weeks at room temperature.

EXAMPLE 7—Preparation of Green Pigment and Magenta Dye-forming Coupler Containing Electrographic Imaging Composition Dispersed in Carrier Vehicle to Form Electrographic Developer A green pigment concentrate of Example 1 and the magenta dye-forming coupler concentrate of Example 4 were mixed in equal weights of 3.85 grams each with 4.55 grams of a 10 percent by weight solution of a copolymer of ethyl acrylate, ethyl methacrylate, lauryl methacrylate, and lithium sulfoethyl methylacrylate in Solvesso 100®. To this mixture was added Isopar G® at the rate of 6 ml per minute for the first 50 ml and then at the rate of 15 ml per minute until the volume of the developer reached 500 ml. This addition was performed under ultrasonic shear.

EXAMPLE 8—Preparation of Red Pigment and Cyan Dye-forming Coupler Containing Electrographic Imaging Composition Dispersed in Carrier Vehicle to Form Electrographic Developer The procedure of Example 7 was repeated, except a red pigment concentrate of Example 2 was substituted for the green pigment concentrate of Example 1 and the cyan dye-forming coupler concentrate of Example 5 was substituted for the magenta dye-forming coupler concentrate of Example 4.

EXAMPLE 9—Preparation of Blue Pigment and Yellow Dye-forming Coupler Containing Electrographic Imaging Composition Dispersed in Carrier Vehicle to Form Electrographic Developer The procedure of Example 7 was repeated, except a blue pigment concentrate of Example 3 was substituted for the green pigment concentrate of Example 1 and the yellow dye-forming coupler concentrate of Example 6 was substituted for the magenta dye-forming coupler concentrate of Example 4.

EXAMPLE 10—Preparation of Photoconductive Microcellular Support

A conventional planar photoconductive element consisting of a transparent 102 micron thick poly(ethylene terephthalate) film base coated with a transparent 0.2 micron cuprous iodide electrically conductive layer which was in turn overcoated with a 2 micron cellulose nitrate charge control barrier layer, and an 8 micron organic photoconductive layer, was employed as a starting material. The photoconductive element is similar to a commercially available recording film sold under the trademark Kodak Ektavolt SO-101. The recording film and its characteristics are generally described in *A Mini-Textbook—KODAK Products for Electrophotography*, Kodak Publication No. G-95, Standard Book Number 0-87985-233-X, Eastman Kodak Company, 1979. The conductive layer and film base extend laterally beyond the photoconductive layer along one edge to allow convenient electrical contact with the conductive layer.

A microcellular array was thermally embossed in the photoconductive layer of the support. The microcellular pattern was similar to that shown in FIGS. 10A through 10C, except that pixels were displaced along glide planes so that the second set of microcells 1006B were out of major axis alignment by one-half of their width. That is, viewing FIG. 10A, the microcells appearing above the horizontal dashed line were all displaced to the right one width of the microcells 1006B from the position shown. The microcells were 25 microns deep from the wall widths between adjacent microcells being 15 microns. The inside width of the square microcells of the third set 1006C was 125 microns. Thermal embossing was conducted at a temperature of 82.2° and at a pressure of 172 kPa applied to the embossing master.

EXAMPLE 11—Introduction of Imaging Compositions into Microcells of Support

The embossed photoconductive portion of the support was given a charge of +460 volts by being passed through a corona discharge. The conductive electrode was attached to ground. Except as stated, the support was exposed as shown in FIG. 10B. A Xenon arc lamp was employed controlled by an electronic shutter. Light was substantially collimated and directed at an acute angle of 12° with respect to the axial plane 1014 of the support. After exposure the support was rotated 180° in the axial plane 1014 and exposed a second time. Each exposure was for 2 seconds, and the bottom walls of the first set of microcells 1006A received during each exposure approximately 600 ergs/cm$^2$ in the areas exposed. Direct light exposure of bottom wall areas were limited to the bottom walls of the first set of microcells. The 15 microns width of the lateral walls was sufficient to prevent light exposure of the remaining sets of microcells through the lateral walls.

After angled exposure of the first set of microcells was completed, the microcellular support was electrographically developed using the electrographic developer of Example 8 and a development time of 15 seconds. A development electrode biased to +200 volts was employed.

The procedure described in the two preceding paragraphs was repeated, except that the electrographic developer of Example 9 was employed and the exposure was as shown in FIG. 10C rather than FIG. 10B. That is, the second set of microcells 1006B were selectively addressed and filled. Thereafter the support was again recharged to +460 volts and exposed perpendicular to the axial plane 1014 at a distance of 15.24 cm to give an exposure of approximately 1,300 ergs/cm$^2$ using a UVL Mineralite. Development was repeated as described above, but using the electrographic developer of Example 7. After each development step and prior to recharging a forced air dryer was employed to evaporate developer solvent.

EXAMPLE 12—Preparation of Photoconductive Support Having Hexagonal Microcells

A conventional planar photoconductive element similar to that described in Example 10 was solvent embossed using an embossing master having an array of hexagonal projections 20 microns in width and approximately 7 microns high. An embossing solvent was placed on the plate between one edge of the array of projections and a strip of pressure-sensitive tape employed to restrain migration of the solvent away from the projections. A sheet of the recording film was placed on the plate with the photoconductive layer adjacent the projections, and the resulting sandwich was advanced beneath a roller with the edge bearing the embossing solvent passing beneath the roller first. The pressure exerted by the roller and the softening action of the embossing solvent being spread laterally at the roller nip resulted in a hexagonal array of microcells being formed on the photoconductive layer having lateral bottom walls corresponding to the walls of the hexagonal projections. The embossing solvent was a roughly equal volume mixture of methanol and dichloromethane containing 0.2 gram per 10 ml of solvent Sudan Black B (Color Index No. 26150). As a result, the lateral walls of the microcells were dyed black, since the dye entered the photoconductive layer along with the embossing solvent. The bottom walls of the microcells remained substantially transparent, however.

EXAMPLE 13—Introduction of Imaging Compositions into Hexagonal Microcells of Support The photoconductive portion of the support embossed with hexagonal microcells was given a charge of +460 volts by being passed through a corona discharge. The conductive electrode was attached to ground. Except as stated, the support was not identically exposed to light to which the photoconductive portion was responsive. The positively charged support was exposed as shown in FIG. 6B. A Xenon arc lamp was employed controlled by an electronic shutter. Light was substantially collimated and directed at an acute angle of 26° with respect to the axial plane of the support. Exposure was in the direction indicated by the arrow 1 in FIG. 6B. The time of exposure was 0.3 second. Only the bottom wall areas 1 were exposed. The microcellular support was electrographically developed using the electrographic developer of Example 9 and a development time of 10 seconds. A development electrode biased to +200 volts was employed. The developer solvent was evaporated using heated forced air. Material was selectively deposited in the microareas 1 of the support.

The support was rotated 120° in the axial plane with respect to the light source, and the procedure described above was repeated, but with the substitution of the electrographic developer of Example 7 for the developer of Example 9. After the developer solvent was evaporated, the support was again rotated 120° so that it occupied yet a third position with respect to the light source, and the procedure described above was again repeated, but with the substitution of the electrographic developer of Example 8. The result was the selective placement of material in the microareas 1, 2, and 3 as shown in FIG. 6B in each of the hexagonal microcells.

The invention has been described in detail with particular reference to preferred embodiments thereof, but it will be understood that variations and modifications can be effected within the spirit and scope of the invention.

What is claimed is:

1. In a process comprising locating adjacent support means areally extended along an axial plane a predetermined, ordered array of lateral wall means capable of defining microareas on the support means, positioning a first composition in one set of microareas on the support means, positioning a second composition on the support means in another, laterally displaced set of microareas which form an interlaid pattern with the one set of microareas, the improvement comprising establishing an electrostatic charge on a photoconductive portion of the support means defining the microareas, directing radiation toward the array at an acute angle with respect to the axial plane of the support means, the lateral wall means interrupting a portion of the radiation to create a first, shadowed set of microareas on the support means while permitting impingement of an uninterrupted portion of the radiation on a second, unshadowed, interlaid set of microareas of the support means, thereby removing the electrostatic charge in the second, unshadowed set of microareas by impingement of the uninterrupted portion of the radiation while retaining the electrostatic charge on the support means in the first, shadowed set of microareas, and selectively positioning an electrographic composition comprised of the first composition as a function of shadowing and the resulting electrostatic charge pattern in one set of the microareas.

2. The improved process according to claim 1, wherein the lateral wall means are located to present an array of substantially parallel lateral walls.

3. The improved process according to claim 2, wherein the parallel lateral walls are located on the support means to form microgrooves.

4. The improved process according to claim 3, wherein the parallel lateral walls are formed to present serpentine microgrooves.

5. The improved process according to claim 3, wherein the parallel lateral walls are located to form at least two interlaid sets of microgrooves.

6. The improved process according to claim 5, wherein the parallel lateral walls are spaced to form one set of microgrooves which differ in width from microgrooves of remaining sets.

7. The improved process according to claim 5, wherein the parallel lateral walls and the support means are formed to provide one set of microgrooves which differ in depth from remaining sets of microgrooves.

8. The improved process according to claim 1, wherein the lateral wall means are located on the support means to form microcells.

9. The improved process according to claim 8, wherein the microcells are formed to include at least one microarea from each set of microareas.

10. The improved process according to claim 8, wherein the lateral wall means are located on the support means to form at least two different sets of microcells.

11. The improved process according to claim 10, wherein the lateral wall means are located on the support means to form one set of microcells which are elongated, as compared to microcells of a second set, in a direction parallel to the axial plane of the support means.

12. The improved process according to claim 11, wherein the lateral wall means are located on the support means to form a second set of microcells which are elongated as compared to the microcells of the one set in a second direction parallel to the axial plane of the support means.

13. The improved process according to claim 11, wherein the two sets of microcells are related so that the second, unshadowed set of microareas are located entirely in the elongated set of the microcells.

14. The improved process according to claim 13, wherein means are positioned in the elongated set of microcells to enlarge the microareas of the second set so that the microareas of the first set are entirely excluded from the elongated set of microcells.

15. The improved process according to claim 1, wherein the microareas are less than 200 microns in size.

16. The improved process according to claim 15, wherein the microareas are in the range of from 4 to 100 microns in size.

17. The improved process according to claim 1, wherein the support means adjacent the microareas is formed of a substantially transparent material.

18. The improved process according to claim 17, wherein the lateral wall means are dyed to enhance their capability of interrupting radiation.

19. In a process of producing an element useful in multicolor photography comprising forming support means areally extended along an axial plane comprised of lateral wall portions and photoconductive bottom wall portions cooperating to form an array of microcells and sequentially positioning first, second, and third imaging compositions in first, second, and third interlaid sets of the microcells, respectively, the first, second, and third imaging compositions being chosen from among compositions which are responsive to or useful for absorbing light each in a different portion of the visible spectrum, the improvement comprising in forming the microcells, differentiating in at least one of depth, lateral extent along the axial plane, and orientation the microcells of the first set from the microcells of the remaining sets, establishing an electrostatic charge on the photoconductuve bottom wall portions forming the microcells, directing radiation toward the support means at an acute angle with respect to the axial plane, a portion of the radiation impinging on the bottom walls of the first set of the microcells while a remaining portion of the radiation is interrupted by the lateral walls to entirely shadow the bottom walls of the second and third sets of microcells, thereby removing the electrostatic charge from at least a portion of each of the photoconductive bottom wall portions of the first set of microcells while retaining the electrostatic charge on the photoconductive bottom wall portions of the second and third sets of microcells, and selectively positioning an electrographic composition comprised of the first imaging composition on the exposed bottom walls of the support in the first set of microcells.

20. The improved process according to claim 19, wherein the first set of microcells are formed to be diamond-shaped with their major axes aligned in a single direction.

21. The improved process according to claim 19, wherein the first set of microcells are formed to be rectangular with their major axes aligned in a single direction.

22. The improved process according to claim 19, wherein the first set of microcells are formed to be of lesser depth than the remaining sets of microcells.

23. The improved process according to claim 19, wherein, after initially directing radiation toward the support means at an acute angle with respect to the axial plane and before positioning the first imaging composition, the relationship of the support means to the initial direction of radiation is reversed 180° in the axial plane and the step of directing radiation toward the support means at an acute angle with respect to the axial plane is repeated to selectively expose portions of the bottom walls of the first set of microcells which were shadowed during the first exposure.

24. In a process of producing an element useful in multicolor photography comprising forming support means areally extended along an axial plane comprised of lateral wall portions and photoconductive bottom wall portions cooperating to form an array of microcells and sequentially positioning first, second, and third imaging compositions in first, second, and third interlaid sets of microcells, respectively, the first, second, and third imaging compositions being chosen from among compositions each responsive to or useful in absorbing light in a different portion of the visible spectrum, the improvement comrising in forming the microcells, differentiating the microcells of each set from the microcells of the remaining sets in at least one of depth, lateral extent along the axial plane, and orientation, establishing an electrostatic charge on the photoconductive bottom wall portions forming the microcells, directing radiation toward the support means at an acute angle with respect to the axial plane to impinge a portion of the readiation on the bottom walls of the first set of the microcells while a remaining portion of the radiation is interrupted by the lateral walls to entirely shaodow the bottom walls of the second and third sets of microcells, thereby removing the electrostatic charge from at least a portion of each of the bottom wall portions of the first set of microcells while retaining the electrostatic charge on the photoconductive bottom wall portions of the second and third sets of microcells, selectively positioning a first electrographic composition comprised of the first imaging composition on the exposed bottom walls of the support in the first set of microcells, establishing an electrostatic charge on the photoconductive bottom wall portions of the second and third sets of microcells, directing radiation toward the support means at an acute angle with respect to the axial plane to impinge a portion of the radiation on the bottom walls of the second set of microcells while a remaining portion of the radiation is interrupted by the lateral walls to entirely shadow the bottom walls of the third set of microcells, thereby removing the electrostatic charge from at least a portion of each of the bottom wall portions of the second set of microcells while retaining the electrostatic charge on the photoconductive bottom wall portions of the third set of microcells, and selectively positioning a second electrographic composition comprised of the second imaging composition on the exposed bottom walls of the support in the second set of microcells.

25. The improved process according to claim 24, wherein radiation is subsequently directed toward the support means substantially perpendicularly to the axial plane to expose the bottom walls of the third set of microcells and selectively positioning the third imaging composition on the exposed bottom walls of the support in the third set of microcells.

26. The improved process according to claim 19, 20, 21, 22, 23, 24, or 25, wherein the first, second, and third compositions are each comprised of radiation-sensitive means responsive to a different portion of the spectrum.

27. The improved process according to claim 26, wherein the radiation-sensitive means is silver halide.

28. The improved process according to claim 19, 20, 21, 22, 23, 24, or 25, wherein the first, second, and third compositions are each comprised of a subtractive primary dye or dye precursor.

29. The improved process according to claim 28, wherein the first, second, and third compositions are each comprised of a different subtractive primary dye or dye precursor capable of shifting between a mobile and an immobile form as a function of silver halide development.

30. The improved process according to claim 19, 20, 21, 22, 23, 24, or 25, wherein the first, second, and third compositions are each comprised of a different additive primary colorant means.

31. A process comprising forming support means areally extended along an axial plane comprised of lateral wall portions and photoconductive bottom wall portions forming an interlaid pattern of at least two sets of microcells, the microcells of at least first and second sets each being relatively extended along a major axis parallel to the axial plane, the major axes of microcells of the same set being substantially aligned, and the major axes of microcells of the first and second sets being relatively oriented to intersect, whereby the microcells of at least the first and second sets can be uniquely addressed by radiation directed toward the support means at an acute angle with respect to the axial plane and substantially aligned with their major axes, establishing an electrostatic charge on photoconductive surfaces of the support means, uniquely addressing the bottom walls of the first set of microcells with radiation substantially aligned with their major axes and at an acute angle with respect to the axial plane, thereby removing the electrostatic charge from at least a portion of the each of the bottom wall portions of the first set of microcells while retaining the electrostatic charge on the photoconductive bottom wall portions of the remaining microcells, selectively positioning a first electrographic composition comprised of a first radiation-sensitive material, colorant, or colorant precursor in the first set of microcells as a function of selective exposure of the bottom walls thereof, again establishing an electrostatic charge on photoconductive surfaces of the support means, uniquely addressing the bottom walls of the second set of microcells with radiation substantially aligned with their major axes and at an acute angle with respect to the axial plane, thereby removing the electrostatic charge from at least a portion of each of the bottom wall portions of the second set of microcells while retaining the electrostatic charge on the bottom wall photoconductive surfaces of remaining of the microcells, and selectively positioning a second electrographic composition comprised of a second radiation-sensitive material, colorant, or colorant precursor in the second set of microcells as a function of selective exposure of the bototom walls thereof.

32. A process comprising forming support means areally extended along an axial plane comprised of bottom wall portions and lateral wall portions forming an interlaid pattern of at least two sets of microcells, the microcells of at least first and second sets each being relatively extended along a major axis parallel to the axial plane, the major axes of microcells of the same set being substantially aligned, and the major axes of microcells of the first and second sets being relatively oriented to intersect, whereby the microcells of at least the first and second sets can be uniquely addressed by radiation directed toward the support means at an acute angle with respect to the axial plane and substantially aligned with their major axes, positioning a radiation-sensitive means on the bottom walls of the microcells, uniquely addressing the bottom walls of the first set of microcells with radiation substantially aligned with their major axes and at an acute angle with respect to the axial plane, selectively immobilizing a first dye on the bottom walls of the first set of microcells as a function of exposure to radiation, uniquely addressing the bottom walls of the second set of microcells with radiation substantially aligned with their major axes and at an acute angle with respect to the axial plane, and selectively immobilizing a second dye on the bottom walls of the second set of microcells as a function of exposure to radiation.

33. A process according to claim 32 in which silver halide is positioned as the radiation-sensitive means on the bottom walls of the microcells.

34. A process according to claim 33 in which the first and second dyes are formed by development of exposed silver halide to form oxidized developing agent and reacting the oxidized developing agent with a mobile dye-forming coupler to form an immobile dye.

35. A process comprising forming support means areally extended along an axial plane comprised of bottom wall portions and lateral wall portions forming an interlaid pattern of at least two sets of microcells, the microcells of at least first and second sets being relatively extended along a major axis parallel to the axial plane, the major axes of microcells of the same set being substantially aligned, and the major axes of microcells of the first and second sets being relatively oriented to intersect, whereby the microcells of at least the first and second sets can be uniquely addressed by radiation directed toward the support means at an acute angle with respect to the axial plane and substantially aligned with their major axes, positioning a dye immobilizing layer on the bottom walls of the microcells, overcoating the dye immobilizing layer with a positive-working photoresist, uniquely addressing the bottom walls of the first set of microcells with radiation substantially aligned with their major axes and at an acute angle with respect to the axial plane, removing the photoresist that is exposed to radiation, so that the photoresist is at least partially removed from the bottom walls of the microcells of the first set, but remains on the bottom walls of the remaining microcells, spreading a first mobile dye over the support means so that it is immobilized by the dye immobilizing layer on the bottom walls of the first set of microcells, but prevented from contacting the immobilizing layer on the bottom walls of the remaining microcells by the overcoated photoresist, removing the first mobile dye from the bottom walls of the remaining microcells, again overcoating the dye immobilizing layer with a positive-working photoresist, uniquely addressing the bottom walls of the second set of microcells with radiation substantially aligned with their major axes and at an acute angle with respect to the axial plane, removing the photoresist that is exposed to radiation, so that the photoresist is at least partially removed from the bottom walls of the microcells of the second set, but remains on the bottom walls of the remaining microcells, spreading a second mobile dye over the support means so that it is immobilized by the dye immobilizing layer on the bottom walls of the second set of microcells, but prevented from contacting the immobilizing layer on the bottom walls of the remaining microcells by the overcoated photoresist, and removing the second mobile dye from the bottom walls of the remaining microcells.

36. A process comprising forming support means areally extended along an axial plane comprised of bottom wall portions and lateral wall portions forming an interlaid pattern of at least two sets of microcells, the microcells of at least first and second sets being extended along a major axis parallel to the axial plane as compared to their width, the major axes of microcells of the same set being substantially aligned, and the major axes of microcells of the first and second sets being relatively oriented to intersect, whereby the microcells of at least the first and second sets can be uniquely addressed by radiation directed toward the support means at an acute angle with respect to the axial plane and substantially aligned with their major axes, positioning a first mobile dye on the bottom walls of the microcells, overcoating the mobile dye with a first negative-working photoresist layer, uniquely addressing the bottom walls of the first set of microcells with radiation substantially aligned with their major axes and at an acute angle with respect to the axial plane, removing the first photoresist layer that is unexposed to radiation, so that the first photoresist layer remains only on the bottom walls of the first set of microcells, but is entirely removed from the bottom walls of the microcells, of the second set, removing the first mobile dye from areas where the first photoresist layer is removed, locating a second mobile dye on the support so that it is positioned in the bottom walls of the microcells overcoating the second mobile dye with a second, negative-working photoresist layer, uniquely addressing the bottom walls of the second set of microcells with radiation substantially aligned with their major axes and at an acute angle with respect to the axial plane, removing the second photoresist layer that is unexposed to radiation, so that the second photoresist layer remains only on the bottom walls of the second set of microcells, but is entirely removed from the bottom walls of the first set of microcells, and removing the second mobile dye from areas where the second photoresist layer is removed.

37. A process comprising forming support means areally extended along an axial plane comprised of lateral wall portions and photoconductive bottom wall portions forming an interlaid pattern of at least two sets of microcells, the microcells of at least first and second sets each being extended as compared to their width along a major axis parallel to the axial plane as compared to their width, the major axes of the microcells of the same set being substantially aligned, and the major axes of microcells of the first and second sets being relatively oriented to intersect, whereby the microcells of at least the first and second sets can be uniquely addressed by radiation directed toward the support means at an acute angle with respect to the axial plane and substantially aligned with their major axes, establishing an electrostatic charge on photoconductive surfaces of the support means, uniquely addressing the bottom wall portions of the first set of microcells with radiation substantially aligned with their major axes and at an acute angle with respect to the axial plane, thereby selectively removing electrostatic charge from the exposed bottom wall portions of the first set of microcells while retaining the electrostatic charge on the bottom wall portions of the second set of microcells, selectively depositing a first electrographic imaging composition in the first set of microcells, uniquely addressing the bottom wall portions of the second set of microcells with radiation substantially aligned with their major axes and at an acute angle with respect to the axial plane, thereby selectively removing electrostatic charge from the exposed, second set of microcells, and selectively depositing a second electrographic imaging composition in the second set of microcells.

38. A process according to claim 37 in which radiation penetrable conductive layer segments are positioned on the bottom walls of the microcells, so that the electrostatic charge is reduced over the entire bottom wall surface of each microcell at least partially addressed by radiation.

39. A process according to claim 38 in which the support means initially presents a substantially planar photoconductive surface and a planar conductive layer coated on the planar surface, the microcells being formed in the support by embossing the planar surface, and the planar conductive layer being separated by embossing into discrete laterally spaced segments laying on the bottom walls of the microcells.

40. In a process comprising locating adjacent support means areally extended along an axial plane a predetermined, ordered array of lateral wall means capable of defining microareas on the support means, positioning a first composition in one set of microareas on the support means, positioning a second composition on the support means in another, laterally displaced set of microareas which form an interlaid pattern with the one set of microareas, the improvement comprising positioning a radiation-sensitive material on the support means, directing radiation toward the array at an acute angle with respect to the axial plane of the support means, the lateral wall means interrupting a portion of the radiation to create a first, shadowed set of microareas on the support means while permitting impingement of an uninterrupted portion of the radiation of a second, unshadowed, interlaid set of microareas of the support means, so that the radiation-sensitive material is selectively exposed in the second set of microareas by impingement of the radiation, but is not exposed to radiation in the first, shadowed set of microareas, visibly differentiating the first and second sets of microareas as a function of exposure exposure or shadowing of the radiation-sensitive material, and selectively positioning the first composition as a function of exposure or shadowing in one set of the microareas.

41. The improved process according to claim 40, wherein the lateral wall means are located to present an array of substantially parallel lateral walls.

42. The improved process according to claim 41, wherein the parallel lateral walls are located on the support means to form microgrooves.

43. The improved process according to claim 42, wherein the parallel lateral walls are formed to present serpentine microgrooves.

44. The improved process according to claim 42, wherein the parallel lateral walls are located to form at least two interlaid sets of microgrooves.

45. The improved process according to claim 44, wherein the parallel lateral walls are spaced to form one set of microgrooves which differ in width from microgrooves of remaining sets.

46. The improved process according to claim 44, wherein the parallel lateral walls and the support means are formed to provide one set of microgrooves which differ in depth from remaining sets of microgrooves.

47. The improved process according to claim 40, wherein the lateral wall means are located on the support means to form microcells.

48. The improved process according to claim 47, wherein the microcells are formed to include at least one microarea from each set of microareas.

49. The improved process according to claim 47, wherein the lateral wall means are located on the support means to form at least two different sets of microcells.

50. The improved process according to claim 49, wherein the lateral wall means are located on the support means to form one set of microcells which are elongated, as compared to microcells of a second set, in a direction parallel to the axial plane of the support means.

51. The improved process according to claim 50, wherein the lateral wall means are located on the support means to form a second set of microcells which are elongated as compared to the microcells of the one set of in a second direction parallel to the axial plane of the support means.

52. The improved process according to claim 50, wherein the two sets of microcells are related so that the second, unshadowed set of microareas are located entirely in the elongated set of the microcells.

53. The improved process according to claim 52, wherein means are positioned in the elongated set of microcells to enlarge the microareas of the second set so that the microareas of the first set are entirely excluded from the elongated set of microcells.

54. The improved process according to claim 40, wherein the microareas are less than 200 microns in size.

55. The improved process according to claim 46 wherein the microareas are in the range of from 4 to 100 microns in size.

56. The improved process according to claim 40, wherein the support means adjacent the microareas is formed of a substantially transparent material.

57. The improved process according to claim 56, wherein the lateal wall means are dyed to enhance their capability of interrupting radiation.

58. In a process of producing an element useful in multicolor photography comprising forming support means areally extended along an axial plane comprised of bottom wall portions and lateral wall portions cooperating to form an array of microcells and sequentially positioning first, second, and third imaging compositions in first, second, and third interlaid sets of the microcells, respectively, the first, second, and third imaging compositions being chosen from among compositions which are responsive to or useful for absorbing light each in a different portion of the visible spectrum, the improvement comprising in forming the microcells, differentiating in at least one of depth, lateral extent along the axial plane, and orientation the microcells of the first set from the microcells of the remaining sets, positioning a radiation-sensitive material in the microcells, directing radiation toward the support means at an acute angle with respect to the axial plane, a portion of the radiation impinging on the radiation-sensitive material in the first set of the microcells while a remaining portion of the radiation is interrupted by the lateral walls to entirely shadow the radiation-sensitive material in the second and third sets of microcells, visibly differentiating the first and second sets of microcells as a function of exposure of the radiation-sensitive material, and selectively positioning the first imaging composition on the exposed bottom walls of the support in the first set of microcells.

59. The improved process according to claim 58, wherein the microcells of the first set are formed to be diamond-shaped with their major axes aligned in a single direction.

60. The improved process according to claim 58, wherein the microcells of the first set are formed to be rectangular with their major axes aligned in a single direction.

61. The improved process according to claim 58, wherein the first set of microcells are formed to be of lesser depth than the remaining sets of microcells.

62. The improved process according to claim 58, wherein, after initially directing radiation toward the support means at an acute angle with respect to the axial plane and before positioning the first imaging composition, the relationship of the support means to the initial direction of radiation is reversed 180° in the axial plane and the step of directing radiation toward the support means at an acute angle with respect to the axial plane is repeated to selectively expose portions of the radiation-sensitive material in the first set of microcells which were shadowed during the first exposure.

63. In a process of producing an element useful in multicolor photography comprising forming support means areally extended along an axial plane comprised of bottom wall portions and lateral wall portions cooperating to form an array of microcells and sequentially positioning first, second, and third imaging compositions in first, second, and third interlaid sets of microcells, respectively, the first, second, and third imaging compositions being chosen from among compositions each responsive to or useful in absorbing light in a different protion of the visible spectrum, the improvement comprising in forming the microcells, differentiating the microcells of each set from the microcells of the remaining sets in at least one of depth, lateral extent along the axial plane, and orientation, positioning a radiation-sensitive material in the microcells, directing radiation toward the support means at an acute angle with respect to the axial plane to impinge a portion of the radiation on the radiation-sensitive material in the first set of the microcells while a remaining portion of the radiation is interrupted by the lateral wall portions to entirely shadow the radiation-sensitive material in the second and third sets of microcells, visibly differentiating the first set of microcells from the second and third sets of microcells as a function of exposure of the radiation-sensitive material, selectively positioning the first imaging composition on the exposed bottom walls of the support in the first set of microcells, directing radiation toward the support means at an acute angle with respect to the axial plane to impinge a portion of the radiation on the radiation-sensitive material in the second set of microcells while a remaining portion of the radiation is interrupted by the lateral walls to entirely shadow the radiation-sensitive material in the third set of microcells, visibly differentiating the second set of microcells from the third set of microcells as a function of exposure of the radiation-sensitive material, and selectively positioning the second imaging composition on the exposed bottom walls of the support in the second set of microcells.

64. The improved process according to claim 63, wherein radiation is subsequently directed toward the support means substantially perpendicular to the axial plane to expose the bottom walls of the third set of microcells and selectively positioning the third imaging composition on the exposed bottom walls of the support in the third set of microcells.

65. The improved process according to claim 58, 59, 60, 61, 62, 63, and 64, wherein the first, second, and third compositions are each comprised of radiation-sensitive means responsive to a different portion of the spectrum.

66. The improved process according to claim 65, wherein the radiation-sensitive means is silver halide.

67. The improved process according to claim 58, 59, 60, 61, 62, 63, and 64, wherein the first, second, and third compositions are each coprised of a subtractive primary dye or dye precursor.

68. The improved process according to claim 67, wherein the first, second, and third compositions are each comprised of a different subtractive primary dye or dye precursor capable of shifting between a mobile and an immobile form as a function of silver halide development.

69. The improved process according to claim 58, 59, 60, 61, 62, 63, or 64, wherein the first, second, and third compositions are each comprised of a different additive primary colorant means.

70. A process comprising forming support means areally extended along an axial plane comprised of bottom wall portions and lateral wall portions forming an interlaid pattern of at least two sets of microcells, the microcells of at least first and second sets each being relatively extended along a major axis parallel to the axial plane, the major axes of microcells of the same set being substantially aligned, and the major axes of microcells of the first and second sets being relatively oriented to intersect, whereby the microcells of at least the first and second sets can be uniquely addressed by radiation directed toward the support means at an acute angle with respect to the axial plane and substantially aligned with their major axes, positioning a radiation-sensitive material in the microcells, uniquely addressing the radiation-sensitive material in the first set of microcells with radiation substantially aligned with the major axes of the first set of microcells and at an acute angle with respect to the axial plane, visibly differentiating the first set of microcells from remaining microcells as a function of exposure of the radiation-sensitive material contained therein, selectively positioning a first radiation-sensitive material, colorant, or colorant precursor in the first set of microcells as a function of selective exposure of the radiation-sensitive material contained therein, uniquely addressing the radiation-sensitive material in the second set of microcells with radiation substantially aligned with their major axes and at an acute angle with respect to the axial plane, visibly differentiating the second set of microcells from remaining microcells as a function of exposure of the radiation-sensitive material contained therein, and selectively positioning a second radiation-sensitive material, colorant, or colorant precursor in the second set of microcells as a function of selective exposure of the radiation-sensitive material contained therein.

* * * * *